US007066457B2

(12) United States Patent
Gerritsen et al.

(10) Patent No.: US 7,066,457 B2
(45) Date of Patent: Jun. 27, 2006

(54) APPARATUS FOR SECURING A WORKPIECE

(75) Inventors: John T. Gerritsen, Carpentersville, IL (US); William J. Phillips, Bolingbrook, IL (US)

(73) Assignee: WMH Tool Group, Inc., Palatine, IL (US)

( * ) Notice: Subject to any disclaimer, the term of this patent is extended or adjusted under 35 U.S.C. 154(b) by 88 days.

(21) Appl. No.: 10/348,162

(22) Filed: Jan. 21, 2003

(65) Prior Publication Data

US 2004/0140602 A1 Jul. 22, 2004

(51) Int. Cl.
*B25B 1/00* (2006.01)

(52) U.S. Cl. ..... 269/6; 269/3

(58) Field of Classification Search ..... 269/3, 269/6, 168–171.5, 197–199, 203, 209; 81/487
See application file for complete search history.

(56) References Cited

U.S. PATENT DOCUMENTS

| | | | |
|---|---|---|---|
| 449,987 | A | 4/1891 | Wies |
| 457,710 | A | 8/1891 | Emmert |
| 693,811 | A | 2/1902 | Yonge |
| 703,376 | A | 7/1902 | Bingham |
| 753,837 | A | 3/1904 | Barcus |
| 777,611 | A | 12/1904 | Dodge |
| 979,305 | A | 12/1910 | Hunt |
| 1,106,096 | A | 8/1914 | Hunt |
| 1,410,184 | A | 3/1922 | Hunter |
| 1,497,107 | A | 6/1924 | Lasell |
| 1,739,488 | A | 12/1929 | Thayer |
| 1,811,518 | A | 6/1931 | Palmer |
| 1,890,114 | A | 12/1932 | Fulton |
| 2,149,541 | A | 3/1939 | Nagle |
| 2,430,458 | A | 11/1947 | Farrell |
| 2,559,925 | A | 7/1951 | Barker |
| 2,669,958 | A | 2/1954 | Sweeney |

(Continued)

FOREIGN PATENT DOCUMENTS

| | | |
|---|---|---|
| BE | 442 004 | 8/1941 |

(Continued)

OTHER PUBLICATIONS

WMH Tool Group, Inc. drawings illustrating an apparatus that was on sale or publically available more than one year before the filing date of the instant application (7 pp.).

(Continued)

*Primary Examiner*—Lee D. Wilson
(74) *Attorney, Agent, or Firm*—Fitch, Even, Tabin & Flannery

(57) ABSTRACT

An apparatus for securing a workpiece comprising first and second clamp members, and a transportable elongate member to which the clamp members are mounted and are operable for being shifted between work engaging and work releasing positions. In one form, the apparatus may be configured with clamp members capable of being fully removed from the elongate member and placed back thereon while maintaining the operability of the clamp members. At least one of the clamp members may be capable of being mounted on the elongate member in a plurality of directions, or may include jaw assemblies which are removable from and/or rotatable with respect to the elongate member. In addition, the apparatus may include a base for securing the base to a work surface and a catch for securing the elongate member to the base. In another form, the base may be configured to receive and secure the elongate member in a plurality of directions.

24 Claims, 34 Drawing Sheets

U.S. PATENT DOCUMENTS

| | | | | |
|---|---|---|---|---|
| 2,704,951 | A | | 3/1955 | Petersen |
| 2,734,409 | A | | 2/1956 | Schum et al. |
| D181,115 | S | | 10/1957 | Vogl |
| 3,007,358 | A | | 11/1961 | Vogl et al. |
| 3,096,975 | A | | 7/1963 | Irwin |
| 3,193,277 | A | | 7/1965 | Nagamori |
| 3,224,752 | A | | 12/1965 | Benbow |
| 3,281,140 | A | | 10/1966 | Smierciak |
| 3,307,843 | A | | 3/1967 | Torossian |
| 3,377,061 | A | | 4/1968 | Watson |
| 3,492,886 | A | | 2/1970 | Naureckas |
| 3,663,005 | A | | 5/1972 | Peddinghaus |
| 3,669,440 | A | | 6/1972 | Kartasuk et al. |
| 3,675,916 | A | | 7/1972 | Kartasuk et al. |
| 3,768,797 | A | | 10/1973 | Kartasuk et al. |
| 3,883,128 | A | | 5/1975 | Breese |
| 4,040,613 | A | | 8/1977 | Kartasuk et al. |
| 4,057,239 | A | | 11/1977 | Hopf et al. |
| 4,081,112 | A | | 3/1978 | Chang |
| 4,185,811 | A | | 1/1980 | Long |
| 4,220,322 | A | | 9/1980 | Hobday |
| 4,253,648 | A | | 3/1981 | Meeks |
| 4,339,113 | A | | 7/1982 | Vosper |
| 4,436,294 | A | | 3/1984 | Irelan |
| 4,534,547 | A | | 8/1985 | Cox |
| 4,563,921 | A | | 1/1986 | Wallace |
| 4,830,350 | A | | 5/1989 | Kuei |
| 4,893,801 | A | | 1/1990 | Flinn |
| 4,926,722 | A | | 5/1990 | Sorensen et al. |
| 4,932,638 | A | | 6/1990 | Chen |
| 4,989,847 | A | | 2/1991 | Chapman |
| 5,005,449 | A | | 4/1991 | Sorensen et al. |
| 5,009,134 | A | | 4/1991 | Sorensen et al. |
| 5,022,137 | A | | 6/1991 | Sorensen et al. |
| D320,919 | S | | 10/1991 | Sorensen |
| 5,094,131 | A | | 3/1992 | Sorensen et al. |
| 5,161,787 | A | | 11/1992 | Hobday |
| 5,191,821 | A | * | 3/1993 | Metzger et al. ..... 83/425 |
| 5,197,360 | A | | 3/1993 | Wooster, Jr. |
| 5,222,420 | A | | 6/1993 | Sorensen et al. |
| 5,348,276 | A | | 9/1994 | Blacker |
| 5,421,384 | A | | 6/1995 | Nuwordu |
| 5,454,551 | A | | 10/1995 | Hobday |
| 5,568,916 | A | | 10/1996 | Gibbons et al. |
| 5,586,754 | A | | 12/1996 | Williams |
| 5,593,147 | A | | 1/1997 | Read |
| 5,692,734 | A | | 12/1997 | Aldredge, Sr. |
| 5,775,680 | A | | 7/1998 | Sorensen et al. |
| 5,826,310 | A | * | 10/1998 | Hobday ..... 24/514 |
| 5,830,091 | A | | 11/1998 | Romanick |
| 5,853,168 | A | | 12/1998 | Drake |
| D417,377 | S | | 12/1999 | Blank et al. |
| 6,113,085 | A | | 9/2000 | Lindenthal et al. |
| 6,135,435 | A | | 10/2000 | Schmitz |
| 6,161,823 | A | | 12/2000 | Bradford |
| 6,220,589 | B1 | | 4/2001 | Smith, III et al. |
| 6,347,792 | B1 | | 2/2002 | O'Brien |
| 6,412,158 | B1 | * | 7/2002 | Moore ..... 29/249 |
| 6,412,767 | B1 | | 7/2002 | Beckmann et al. |
| 6,450,489 | B1 | * | 9/2002 | Wang ..... 269/6 |
| 6,530,565 | B1 | | 3/2003 | Simpson |
| 2003/0090048 | A1 | * | 5/2003 | Varzino et al. ..... 269/95 |

FOREIGN PATENT DOCUMENTS

| | | | |
|---|---|---|---|
| DE | 175 307 | | 9/1906 |
| DE | 328149 | | 10/1920 |
| DE | 332373 | | 2/1921 |
| DE | 942 320 | | 5/1956 |
| DE | 1 099 478 | | 2/1961 |
| DE | 2 149 012 | | 4/1972 |
| DE | 2 326 546 | | 12/1974 |
| DE | 24 03 830 | | 3/1975 |
| DE | 75 13 254 | U | 8/1975 |
| DE | 28 06 555 | | 8/1979 |
| DE | 87 03 379.8 | | 9/1987 |
| DE | 8907067 | | 10/1989 |
| GB | 443381 | | 2/1936 |
| GB | 819 506 | | 9/1959 |
| GB | 819506 | | 9/1959 |
| GB | 956 390 | | 4/1964 |
| GB | 956390 | | 4/1964 |
| GB | 973 387 | | 10/1964 |
| GB | 973387 | | 10/1964 |
| GB | 1 408 886 | | 10/1975 |
| GB | 1 555 455 | | 11/1979 |
| GB | 2 063 111 | | 6/1981 |
| GB | 2 178 689 | A | 2/1987 |
| GB | 2 182 271 | | 5/1987 |
| GB | 2 204 260 | A | 11/1988 |
| GB | 2 204 263 | A | 11/1988 |
| GB | 2 204 264 | A | 11/1988 |
| GB | 2 214 109 | A | 8/1989 |
| GB | 2 221 634 | | 2/1990 |

OTHER PUBLICATIONS

Rhombus Tools Limited, United Kingdom Publication entitled *A Sliding Jaw Clamp*, Nov. 9, 1988 (2 pages).

Phil McCafferty, *One-hand clamp*, Popular Science, Aug. 1989, (at p. 79).

Wilton Corporation 2001 Catalog (21 pages).

* cited by examiner

APPARATUS FOR SECURING A WORKPIECE

BACKGROUND OF THE INVENTION

This invention relates generally to an apparatus for securing a workpiece and more particularly to a bar clamp having a variety of clamp features and a mating base to which the bar clamp may be mounted for performing additional workpiece securing applications.

Presently, the tool industry offers a variety of tools for securing workpieces such as vises, bar clamps, C-clamps and the like. Each of these tools offer advantages over their alternatives. For example, a vise may be mounted to a work surface, such as a bench top, in order to provide a strong and sturdy apparatus for securing a workpiece. Unfortunately, however, traditional vises are not designed to be readily transported from one place to another so that the vise may be used in locations remote from the bench top. This may be due in part to the weight of the vise (which is often heavy), or in the alternative due to the way in which it is mounted to the bench top (which typically requires a base of the vise to be bolted to a work surface).

Bar clamps and C-clamps serve as alternatives to the vise in applications which are remote from a bench top and require an apparatus for securing a workpiece. An additional advantage of bar clamps is their ability to be used as both a clamp and a spreader. Applications in which bar clamps and C-clamps are used, however, are limited due to their inability to be used in applications which require a stationary bench top mounted apparatus for securing a workpiece. For example, in applications where the workpiece is not self standing or self supporting, a bar clamp may be an unacceptable alternative due to its inability to support the workpiece as desired and/or in the position desired.

Another problem associated with traditional bar clamps is that the clamp members and bars of the bar clamp are sold as a set rather than being sold separately. For example, most bar clamps are sold in varying bar lengths with the clamp members attached and are marketed by the size workpiece the tool is capable of clamping, (e.g., the clamp members are capable of clamping a 6", 12", 18", 24" 30" or 36" workpiece). The reason the clamp members are not sold separately from the bar is primarily due to the fact that at least one of the clamp members, (i.e., the movable clamp), is incapable of being removed from the bar without disassembling (e.g., losing parts, having parts become misaligned, etc.). In fact, several of the commercially available bar clamps prevent both of the clamp members (i.e., the stationary and movable clamps) from being removed from the bar. This prevents users from purchasing one set of clamp members for use with varying bar lengths, or from purchasing replacement clamp members and bars.

In addition, the inability to adjust the position or direction with which the clamps and/or jaw assemblies of a bar clamp are capable of engaging a workpiece may also prevent such tools from being used in certain applications. For example, when trying to use a bar clamp on a variety of different workpieces, (e.g., workpieces having differing shapes and sizes), the inability to position the clamp or jaw in a plurality of different directions to account for the differing shapes or sizes of the workpieces may reduce the number of applications in which the bar clamp may be used, or even prevent the bar clamp from being used at all. Although some bench vises have a rotatable jaw feature which may be useful in such applications, the relative immobility of the bench vise may preclude it from being used for the reasons discussed above.

Furthermore, the inability to add and replace clamps and/or the jaw assemblies of bar clamps further limits the use of such tools in a variety of applications. For example, when working with a workpiece that requires the clamp to engage or secure the workpiece in a plurality of positions, but does not have enough room for multiple bar clamps to be positioned thereon, a bar clamp may not be sufficient for the task at hand due to the operator's inability to add clamps and/or jaw assemblies. Moreover, the inability to replace broken clamps and/or jaw assemblies or to use different types of jaws and jaw assemblies may also prevent a user from using a bar clamp in applications where such options are needed.

Thus, a need exists for an apparatus for securing a workpiece which can be used in a variety of locations, e.g., mounted to a bench top, remote from a bench top, etc., for a variety of different applications, such as a vise, clamp, spreader, work station, etc., and which overcomes the aforementioned limitations and further provides capabilities, features and functions, not available in current devices.

Figure 1:
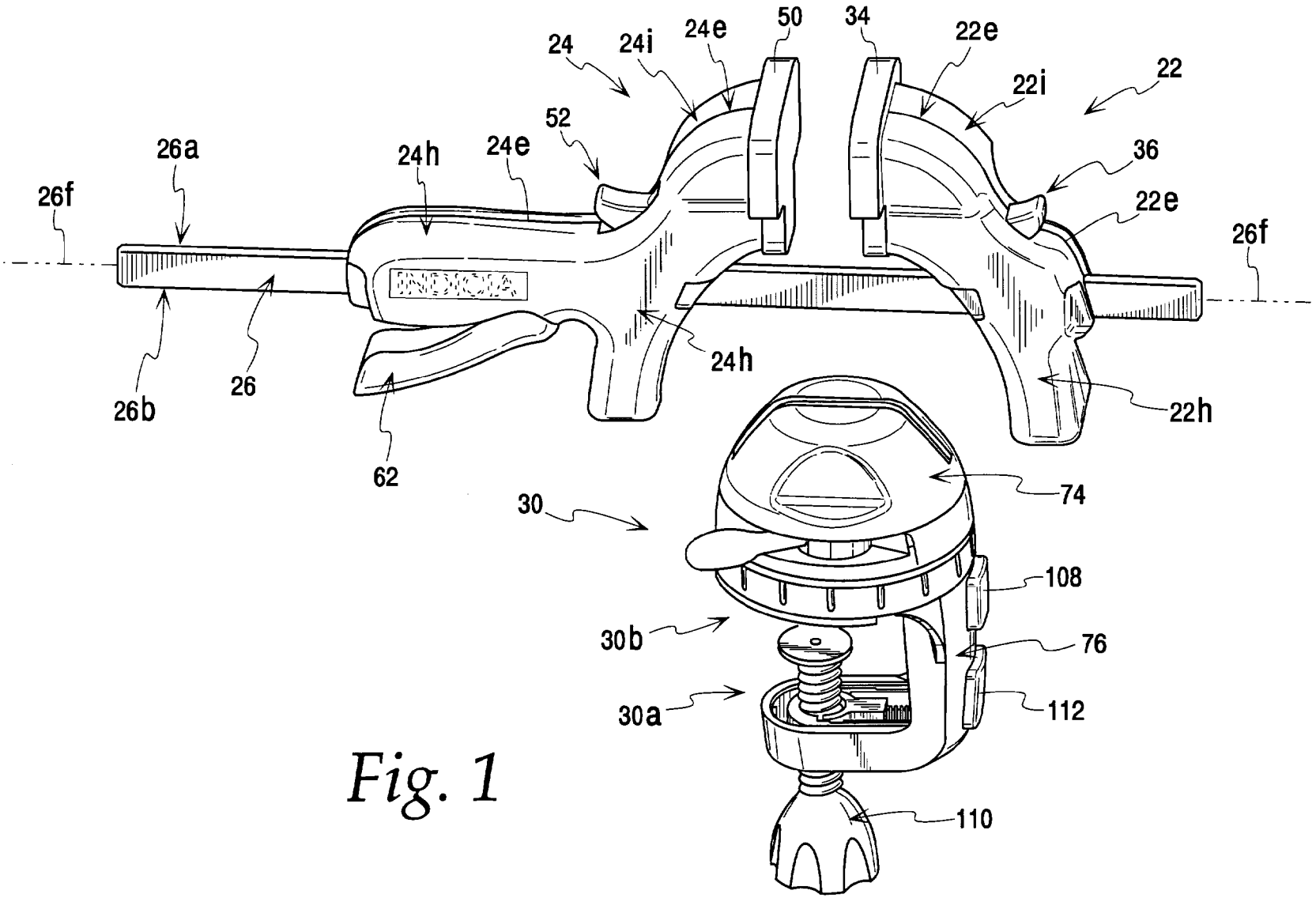
FIG. 1 is a perspective view of an apparatus for securing a workpiece in accordance with the invention showing a removable bar clamp assembly exploded from a movable base.

While the invention will be described in connection with preferred embodiments, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

Referring now to the drawings, and especially FIGS. 1–7H, an apparatus for securing a workpiece is shown and is generally identified by reference numeral 20. The apparatus 20 includes a pair of clamp members 22 and 24, and a transportable elongate member, such as a bar 26, to which the clamp members 22 and 24 are adjustably mounted for being shifted between clamped and unclamped positions to secure a workpiece. As shown, clamp member 22 remains stationary on member 26 during a workpiece clamping operation while the other clamp member 24 is advanced therealong by a trigger mechanism 62 thereof to form a bar clamp portion 28 of the preferred apparatus 20 herein. The apparatus further includes a base 30 having an upper portion 74 for connecting the elongate member 26 to the base 30, and a lower portion 76 with a base securing mechanism 30*a*, such as a clamp mechanism, for mounting the base to a support surface such as a table top. In this manner the bar clamp assembly 28 is removable and can be used apart from the base 30, or it can be attached to the base 30 to allow the apparatus herein to function more akin to a tabletop clamp, vise or spreader. The lower base portion 76 preferably includes a bar capturing mechanism or catch 76*a* that is operable to fix the bar 26 to the base 30 at various positions along its length. This allows the bar 26 to be mounted to the base 30 so that various lengths of the bar 26 may extend beyond the base 30 on either side thereof to provide a user flexibility in using the apparatus 20 herein. Accordingly, if there is more room on one side of the base, the bar can be fixed thereto by the capturing mechanism 76*a* so that a greater amount of the bar 26 extends on this side of the base than the other. Also, a preferred form of the base 30 incorporates a rotational release mechanism 30*b* that allows a user to select a plurality of predetermined rotary positions at which the upper base portion 74 can be fixed to the lower base portion 76. This also enhances flexibility in using the apparatus so that the clamp members 22 and 24 can be disposed in the precise orientation that affords the user the greatest freedom to operate without interference from surrounding walls, tools, or other equipment that may be present near the bench top to which the lower mounting portion 76 is secured.

As illustrated in FIGS. 2A–G, the preferred elongate member 26 is a generally rectangular shaped bar member 16 having a width that is approximately one-fourth ($1/4^{th}$) its height. The length of the elongate member 26 may vary, however, in a preferred form the member 26 is of a sufficient length to allow the first and second clamp members 22 and 24 to be adjusted so that sufficient space is present for the clamping of workpiece portions therebetween, or for the spreading of workpiece portions therewith, with the apparatus 20 having a clamping/spreading dimension of up to three feet extending along the length of the bar member 26.

The top 26*a* and bottom 26*b* of the elongate member 26 can be cornered or rounded, and have substantially flat and parallel uppermost and lowermost surfaces 26*c* so that the flat surfaces 26*c* can provide additional support for workpieces being secured by the clamp members 22 and 24. In other words, a surface of the workpiece may be rested on the bar member's flat upper surface 26*c* as it is being clamped between the clamp members 22 and 24. The rounded ends of bar 26 allow the clamp members 22 and 24 to slide along the bar 26 more easily without hang-ups due to the absence of sharp corners between sides 26*d* and 26*e* of the bar 26 and the upper and lower surfaces 26*c* thereof. It should be understood, however, that in alternate embodiments of apparatus 20 the elongate member may be a round bar rather than a generally rectangular bar, if desired.

Figure 2A:
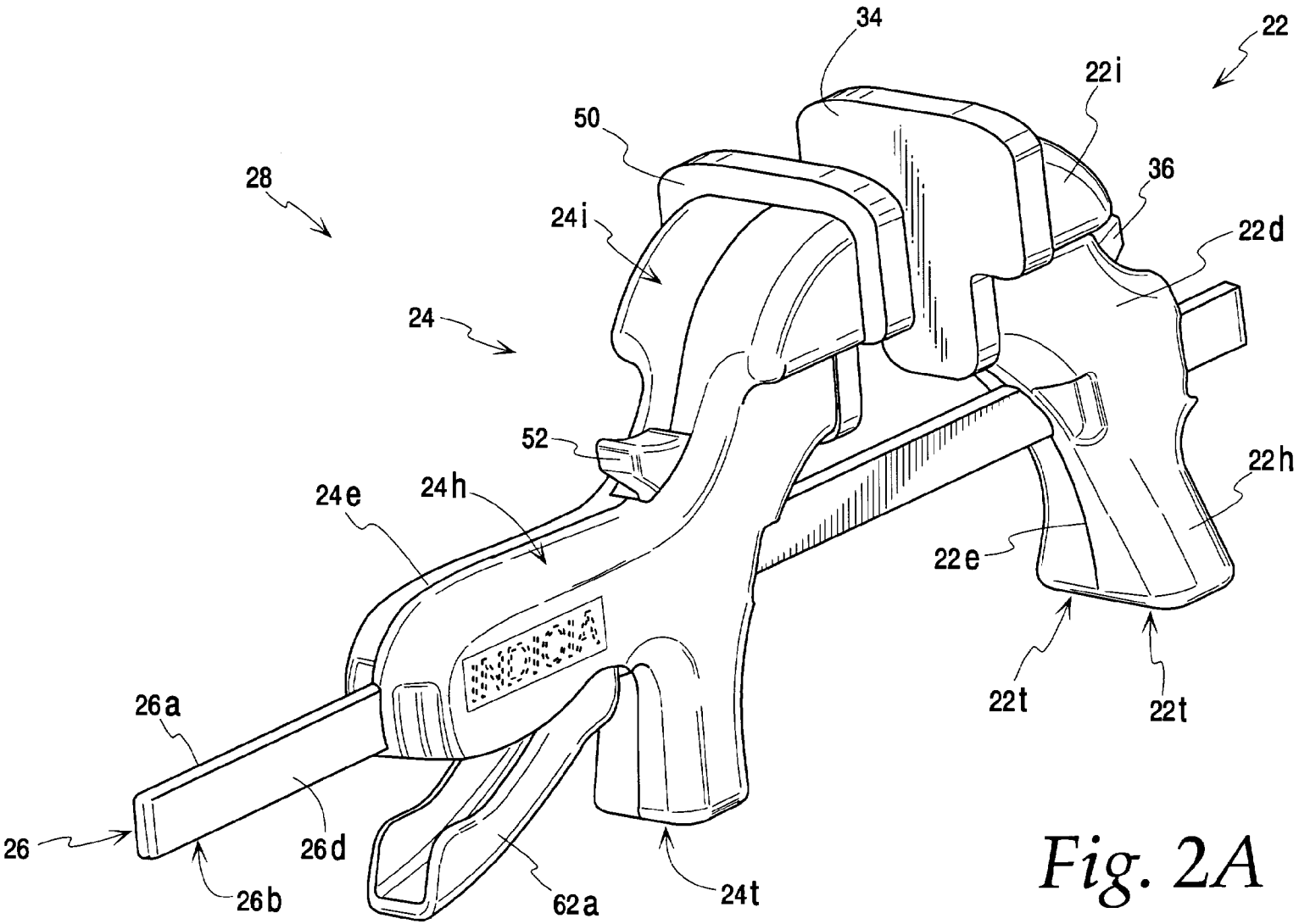
FIG. 2A is a perspective view of the bar clamp assembly of FIG. 1 wherein the clamp structures are positioned about an elongate bar member for applying a clamping force.
Figure 2B:
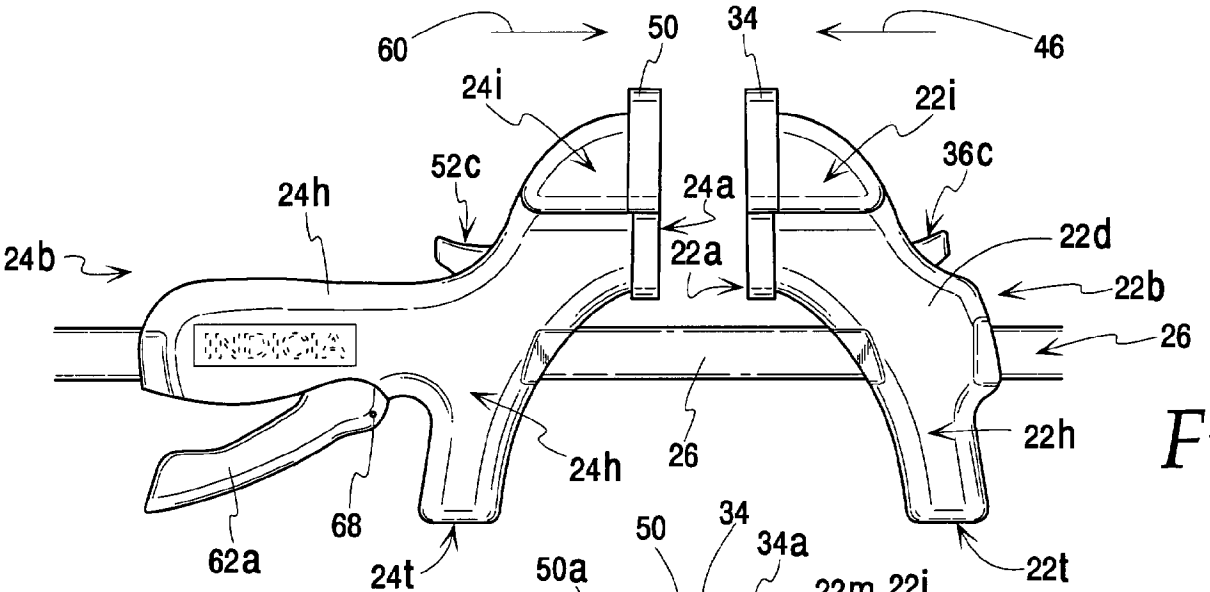
FIGS. 2B–C are a partial right side elevational view and a partial cross-sectional view, respectively, of the bar clamp assembly of FIG. 1.
Figure 2C:
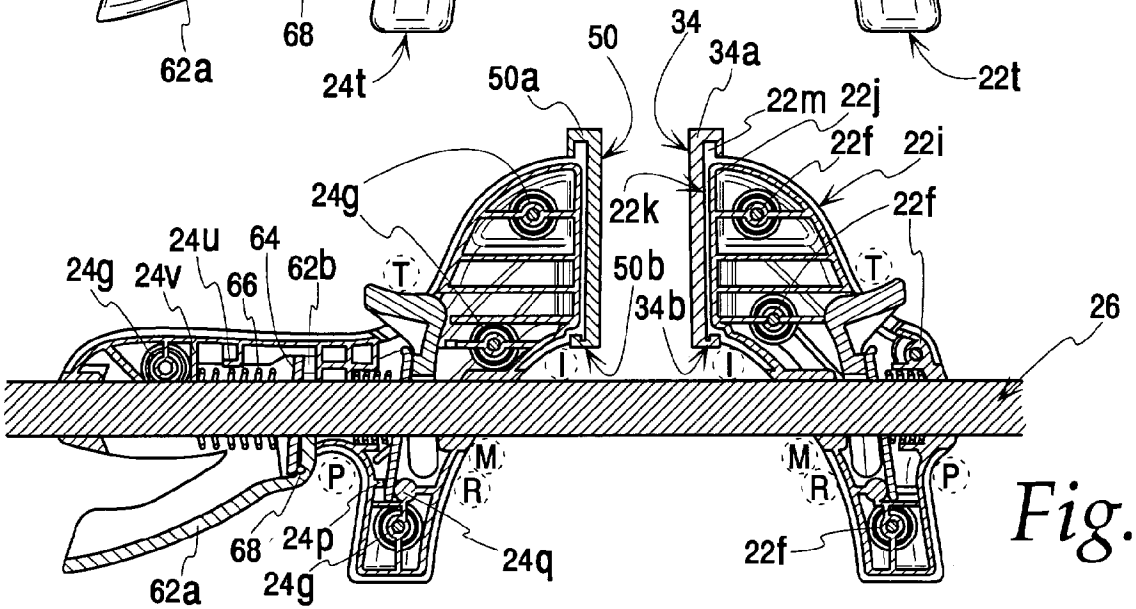
Figure 2D:
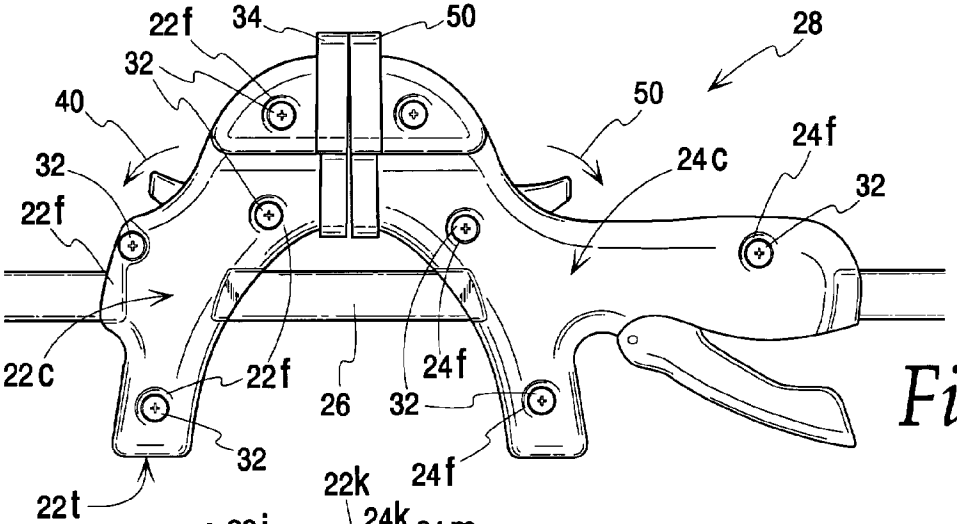
FIGS. 2D–E are partial left side elevational views of the bar clamp assembly of FIG. 1 with the clamp housing covers on and off, respectively.

As illustrated in FIGS. 2A–G, the first clamp member 22 preferably has a generally symmetrical design about a vertical reference plane (not shown) extending centrally from a forward end 22*a* to a rearward end 22*b* (FIG. 2B). The cross-sectional view illustrated in FIG. 2C is taken along the vertical reference plane. The first clamp member 22 has a clam shell housing, including a first housing portion 22*c* and a second housing portion 22*d* which, when connected to each other, interface along a parting line 22*e*. The housing portions 22*c–d* are connected to one another via fasteners such as screws 32 (FIG. 2D). In a preferred embodiment, the threaded portions of the screws 32 pass through recessed openings 22*f* (FIG. 2C) in the first housing portion 12*c* and screw into corresponding bores 22*g* located on the second housing portion 22*d*. The openings 22*f* are recessed so that the heads of the fasteners 32 do not protrude from the first housing portion 22*c*. This configuration allows the first clamp member 22 to maintain a generally smooth gripping surface 22*h* for comfort in use of the apparatus 20.

The gripping portion 22*h* depends, at least in part, from the bar 26 and provides a "pistol grip" like gripping portion 22*h*, and includes a jaw support 22*i* above the gripping portion 22*h*. The jaw support 22*i* includes a jaw plate portion 22*j* (FIGS. 2C, 2E and 3) having a flat face 22*k* which is used to exert a clamping or spreading force on a workpiece. The jaw 22*j* is strengthened and/or stiffened via a plurality of ribs located in the interior of clamp 22 and extending horizontally from the forward end 22*a* of the clamp 22 toward the rearward end 22*b*. In a preferred form of apparatus 20, the jaw 22*j* is T-shaped (see FIG. 3) and has an outer lip 22*m* which protrudes from the jaw support 12*i* and/or jaw plate 12*j* so that a removable jaw pad 34 can be applied over the jaw 22*j*. The jaw pad 34 may be made of a resilient material capable of being pressed into clamping or spreading engagement with a workpiece with minimal marking thereof, or other change thereto. In some applications a flat jaw pad 34 may be desirable for engaging the workpiece, as shown in FIGS. 1–2G. In other applications, however, the jaw pad 34 may include additional shapes or patterns for better engaging the workpiece. For example, the jaw pad 34 may include a curved surface which is capable of engaging rounded workpieces, such as tubes or pipes, better than a flat jaw pad. In other instances, the jaw pads 34 may include ribs or angled indentations which are better capable of engaging workpieces with sharp or pointy edges.

Preferably, the jaw pad 34 will correspond in shape to the jaw 22*j* and have a bent over or u-shaped peripheral rim portion 34*a* to form a channel at the rear of the pad for receiving the outer lip 22*m* of jaw 22*j*. The jaw pad 34 can be secured onto the jaw 22*j* by having a stud or tab portion 22*n* (see FIGS. 2C, 2E and 3) extending from the bottom of the jaw 22*j* and having a corresponding recess, such as receiving slot 34*b* (FIG. 2C), located at the bottom of the rim portion 34*a* of the jaw pad 34. With such a configuration, the jaw pad 34 can be attached to the jaw 22*j* by simply pushing the jaw pad 34 onto the jaw 22*j* with the pad flexing until the outer lip 22*m* snaps into the channel created by rim 34*a* and pressing the lower pad portion of jaw pad 34 over the tab portion 22*n* until the tab portion 22*n* rests in the receiving slot 34*b*. Conversely, the jaw pad 22*j* can be removed by simply pulling the lower pad portion of jaw pad 34 away from the jaw 22*j*, thereby removing the tab portion 22*n* from the receiving slot 34*b*, and sliding pad 34 up off of the outer lip 22*m* and jaw 22*j*.

Figure 2E:
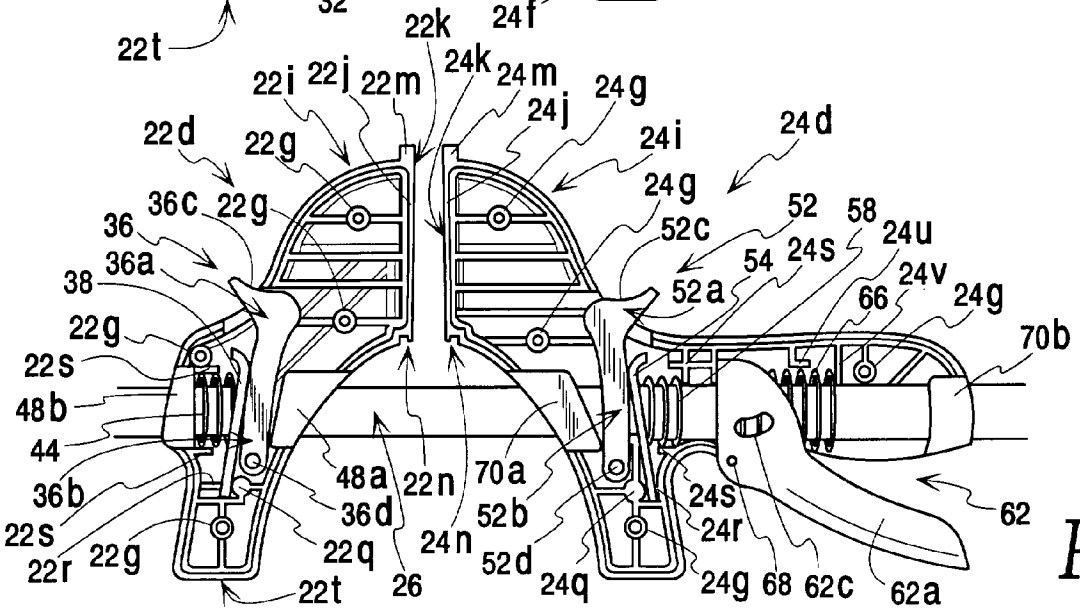
Figure 2F:
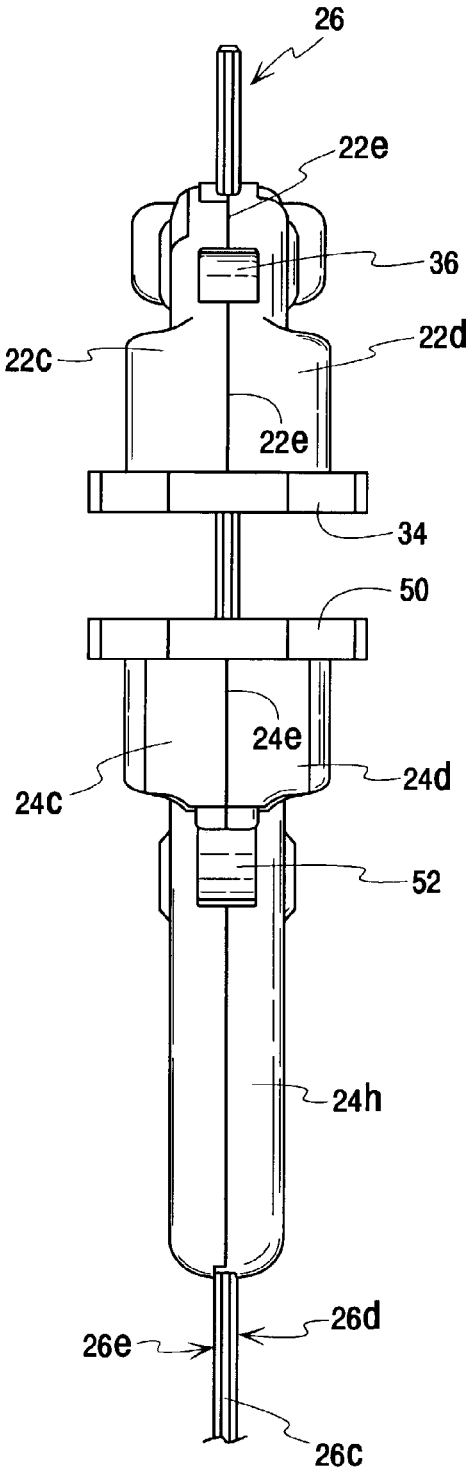
FIGS. 2F–G are partial top and bottom views, respectively, of the bar clamp assembly of FIG. 1.
Figure 2G:
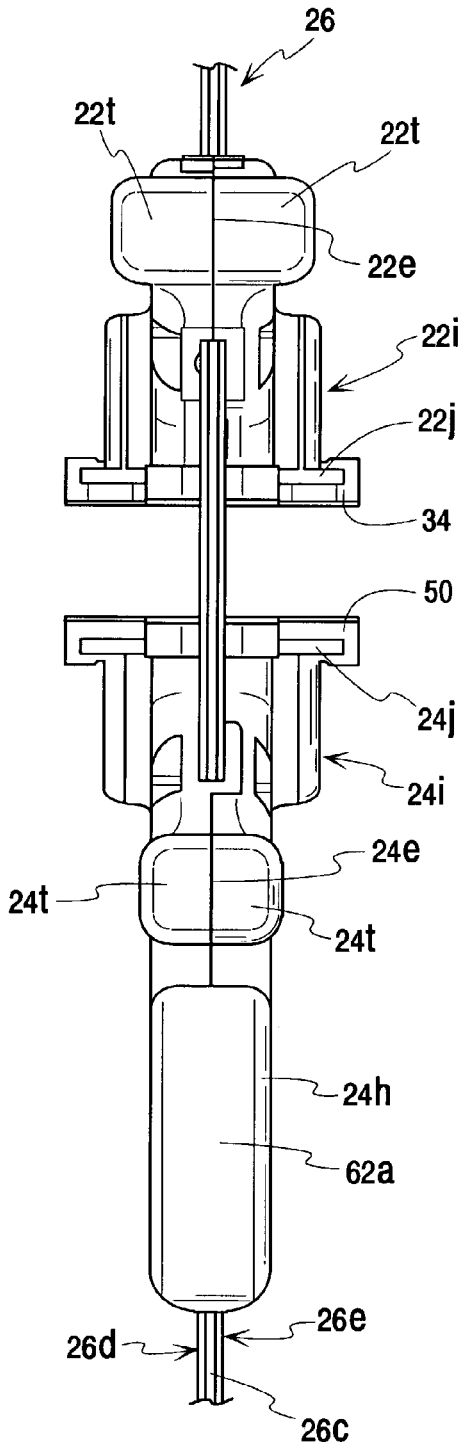

As illustrated in FIG. 2E, the first clamp member 22 preferably includes a brake release mechanism 36 for releasing a brake 38 coupled to the first clamp member 22 so that the position of the first clamp member 22 on the elongate member 26 can be adjusted. The brake release mechanism 36 includes an upper user operated portion 36*a* pivotally mounted to project through a slot opening in the gripping portion 22*h* so that an operator can conveniently actuate the mechanism 36 such as with their thumb while holding the gripping portion 22*h*. A pressing or engagement surface 36*c* is slightly contoured with a concave configuration so that pulling on the surface 36*c* causes pivoting in the direction shown by arrow 40 (FIG. 2D). An example of how an operator may actuate the brake release mechanism 36 is illustrated in FIG. 2C, with the letters T, I, M, R and P representing the location of the operator's thumb (first digit), index finger (second digit), middle finger (third digit), ring finger (fourth digit), and pinky or small finger (fifth digit), respectively. An advantage to this configuration is that the motions required to actuate the release mechanism and back the clamp member 22 along the bar 26 are in the same direction, i.e., requiring movement from the forward end 22*a* toward the rearward end 22*b* of the clamp 22. Thus, the operator is not stuck trying to press the release mechanism forward and pull the clamp 22 in the opposite direction when trying to pull it backwards on the bar 26 or when trying to remove it from the bar 26 altogether.

The brake release mechanism 36 has pivot trunnion mounts 36*d* (FIG. 2E) extending out from opposite sides of the lower lever portion 36*b* of release mechanism 36 which define an axis about which the mechanism 36 is pivoted. The pivot trunnion mounts extend into integral cylindrical pivot bosses or recesses 22*p* (FIG. 3) located on the inner surfaces of housing portions 22*e–d* of clamp member 22. The brake engagement or lever portion 36*b* extends upward from the trunnions to the user operated portion 36*a* so that pulling on the engagement surface 36*c* pivots the portion 36*b* back toward the rear of the housing 22*b*. The location of the pivot trunnions 36*d* and length of the release lever 36 improves the amount of leverage provided to the operator at the user operated portion 36*a* so that the brake release mechanism 36 may be operated more easily. In a preferred embodiment, the lower portion 36*b* of the release mechanism 36 is forked such that the lower portion 36*b* defines a central slot through which the bar 26 passes. Thus, the lower portion 36*b* extends downward from the upper portion 36*a* in the form of two separate legs, each with its own outer trunnion pivot 36*d*. In alternate embodiments, however, the release mechanism may define a hole through which the bar 26 passes, rather than having a slotted leg structure.

As can be seen in FIG. 2E, the brake 38 is preferably in the form of a slotted plate having a central slot opening through which the bar 26 extends. Normally, the plate 38 is biased as by a spring, such as square or rectangular spring 44, into tight engagement with the bar 16 at upper and lower edges defining the slot or opening. To this end, the slot opening is configured to be larger than the bar such that when in braking engagement therewith, the plate is extending at other than a perpendicular angle to the axis 26*d* (FIG. 1) of the bar so that the space or play between the larger slot opening and the bar is taken up. In addition, the slot opening of the brake plate 38 can have a symmetrical shape for ease in assembly thereof (e.g., by making brake plate orientation irrelevant during assembly). As shown, brake plate 38 is inclined so that the slot upper edge is closer to the jaw 22*j* than the lower edge. The non-perpendicular orientation is such that it only limits the clamp member 22 from moving along the bar 26 in the opposite direction in which it is inclined, (e.g., it limits movement of the clamp 22 away from the second clamp member 24), and not in the other direction. In this way, the first clamp member 22 can slide along the bar 26 in the direction shown by arrow 46 (FIG. 2B), but cannot be slid along the bar in the opposite direction unless the brake release member 36 is actuated. Pressing or pulling the brake release mechanism 36 causes the brake release 36 to pivot about its pivot axis and to pivot the brake engagement lever portion 36*b* against the top of brake plate 38. The release lever 36 tilts the brake plate 38 against its bias into a more upright position, generally perpendicular to bar axis 26*d*, so that the slot of the brake plate 38 is in a clearance fit or orientation for sliding of the bar 26 therethrough. In this manner, when a user is gripping portion 22*h*, they can simultaneously depress the actuator button portion 36 to move the clamp 22 along the bar 26 in either direction thereon.

Figure 3:
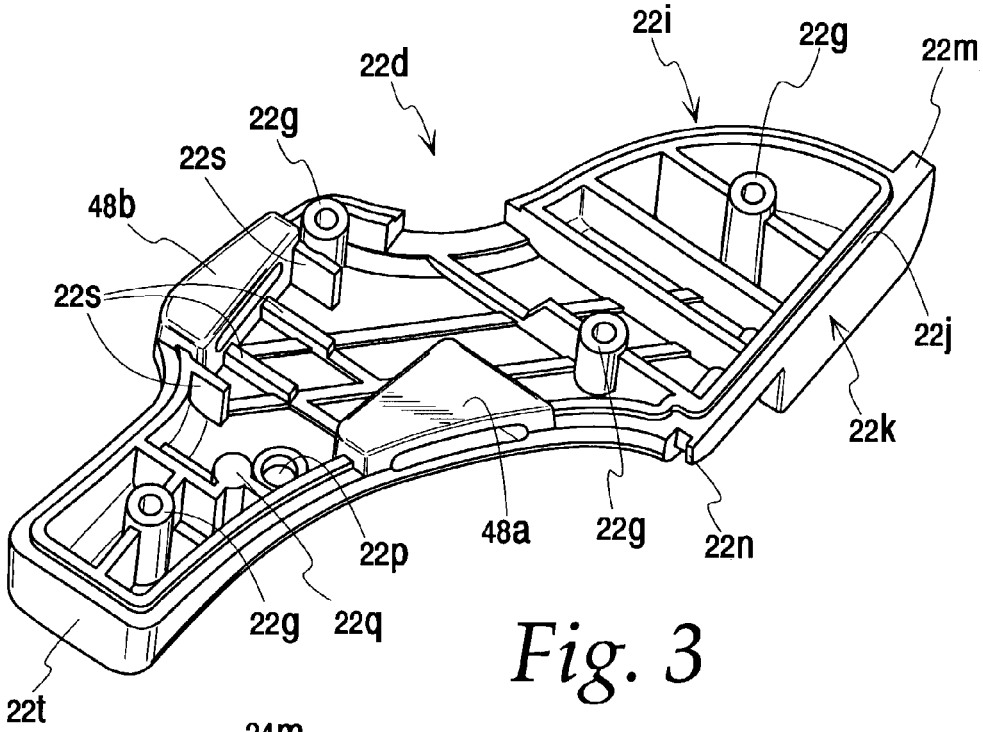
FIG. 3 is a perspective view of a housing portion of the stationary clamp of FIG. 1 illustrating the alignment ribs and cylindrical pivot boss of the braking mechanism among other items.

As earlier mentioned it is preferred that the first clamp member 22 be able to be fully removed from the bar 26. The clamp member 12 includes a pair of guide block portions 48*a* and 48*b* in the interior thereof such as formed on the interior of the housing portion. The guided blocks 48*a–b* have through bores configured with substantially the same configuration as that of the oblong or obround bar. Accordingly, the clamp member 22 is supported for sliding movement along the bar by the guide block portions 48*a–b* through which the bar extends. In order to assist the pivot action of the brake release mechanism 36 and the operator's ability to remove the clamp 22 from the bar 26 without having the clamp 22 disassemble, (e.g., without having the internal clamp mechanisms becoming misaligned), the clamp 22 may also include a brake pivot boss 22*q* and an alignment member such as rib 22*r* (FIG. 2E). Given the brake's movement from its forward inclination to a more upright or perpendicular orientation, the alignment rib 22*r* is positioned behind the brake plate 38, or towards the rear of the clamp 22*b*, and the brake pivot boss 22*q* is positioned in front of the brake plate 38 so that the brake plate 38 can be pivoted about the pivot boss 22*q* more easily due to the pivot boss's rounded edge. When the brake release mechanism 36 is not engaged and/or the clamp 22 is removed from the bar 26, the alignment of the internal mechanisms, (e.g., brake 38, release mechanism 36, etc.), is maintained via the pressure exerted against the brake plate 38 via spring 44. For example, the spring 44 forces the brake plate 38 against the lower lever portion 36*b* of release mechanism 36, thereby sandwiching the brake 38 and release mechanism 36 between the spring 44 and the release mechanism's limit of travel. Thus, preventing the brake plate 38 and release mechanism 36 from becoming misaligned. The tight fit between the lower brake plate portion and both the pivot boss 22*q* and alignment rib 22*r* also helps maintain the alignment of the brake plate 38. Similarly, the cooperative relationship between the trunnion mounts 36*d* and the cylindrical pivot bosses 22*p* help maintain the alignment of the release mechanism 36. The alignment of the spring 44 is generally maintained via its compression between the brake plate 38 and the rear guide block 48*b* and via integral spring alignment ribs 22*s* located on the interior of the clamp housings 22*c–d*. In the embodiment illustrated, the spring 44 is vertically aligned via the uppermost and lowermost spring alignment ribs, horizontally aligned via the brake plate 38 and rear guide block 48*b*, and axially aligned via the intermediate spring alignment ribs (FIGS. 2E and 3).

With the brake 38, spring 44 and elongate member 26 coupled to the second housing portion 22*d* of clamp member 22, the first housing portion 22*c* serves as a cover to enclose these components within the interior region of the clamp member 22. FIG. 2D is a view of the exterior surface of the cover or first housing portion 22*c*, and FIG. 2E is a view of the bar clamp assembly 28 with the cover 22*c* removed. As mentioned above, the first housing portion 22*c* is attached to the second housing portion 22*d* in a clam shell arrangement via fasteners 46. Once the first and second housing portions 22*c–d* are connected, jaw pad 34 may be attached onto the clamp member 22 in the manner set forth above.

The first and second housing portions 22*c–d* of clamp 22 include large and generally flat bottom surfaces 22*t* which allow the clamp 22 to stand upright. To this end, the surfaces taken together comprise a generally rectangular surface (FIG. 2G) which is approximately as wide as the remainder of the clamp 22 (see FIGS. 5–6) and is sufficient to allow the clamp member 22 to stand upright on a flat support surface when the clamp members 22 and 24, and elongate member 26 are used apart from the base 30, as will be discussed more fully herein.

As illustrated in FIGS. 2A–G, the second clamp member 24 preferably has a generally symmetrical design about the vertical reference plane mentioned above which extends centrally from a forward end 24*a* to a rearward end 24*b* (FIG. 2B) of clamp 24. As mentioned above, the cross-sectional view illustrated in FIG. 2C is taken along the vertical reference plane. The second clamp member 24 has a clam shell housing, including a first housing portion 24*c* and a second housing portion 24*d* which, when connected to each other, interface along a parting line 24*e*. The housing portions 24*c–d* are connected to one another in a manner similar to that discussed above with respect to first clamp housing portions 22*c–d*. More particularly, the second housing portions 24*c–d* are connected via fasteners such as screws 32 (FIG. 2D). Preferably, the threaded portions of the screws 32 pass through recessed openings 24*f* (FIGS. 2C–D) in the first housing portion 24*c* and screw into corresponding bores 24*g* located on the second housing portion 24*d*. The openings 24*f* are recessed so that the heads of the fasteners 32 do not protrude from the first housing portion 24*c*. This configuration allows the second clamp member 24 to maintain a generally smooth gripping surface 24*h* for comfort in use of the apparatus 20.

A portion of the gripping portion 24*h* of first and second housing portions 24*c–d* extends outward from the main body of clamp member 24 and has a longitudinal axis that extends generally parallel to the elongate member 26. The outer surface of the gripping portion 24*h* is ergonomically curved to fit the palm of a persons hand so that the clamp 24 is comfortable for an operator to use and grasp. The clamp member 24 further includes a jaw support 24*i* located above the gripping portion 24*h*, which supports an enlarged jaw plate portion 24*j* (FIGS. 2C and 2E) having a flat face 24*k* which is used to exert a clamping or spreading force on a workpiece. The jaw 24*j* is strengthened and/or stiffened via a plurality of ribs located in the interior of clamp 24 and extending horizontally from the forward end 24*a* toward the rearward end 22*b*. In a preferred form of apparatus 20, the jaw 24*j* is T-shaped (FIGS. 2A, 4 and 5) to match the preferred configuration of the jaw 22*j* of the first clamp member 22.

The jaw 24*j* of second clamp member 24 has an outer lip 24*m* which protrudes, or extends, from the jaw support 24*i* and/or jaw 24*j* so that a jaw pad 50 can be applied over the jaw 24*j*. Preferably, the jaw pad 50 is made of a resilient material such as an elastic polymer and has a T-shape similar to that of the jaw 24*j*. With such a configuration, the jaw pad 50 may be pressed into engagement with a workpiece via the jaw 24*j* and jaw support 24*i*. As mentioned above and illustrated in FIGS. 1–2G, in some applications a flat jaw pad 50 may be preferred for engaging a workpiece. In other applications, jaw pads having shaped jaw pad surfaces may be desired for engaging specific types of workpieces. For example, a jaw pad having a curved jaw pad surface may be used when engaging a rounded workpiece such as a pipe, or an indented jaw pad for handling workpieces with corresponding or complimentary shapes and surfaces.

Like the first clamp's jaw pad 34 discussed above, jaw pad 50 preferably has a bent over or u-shaped peripheral rim portion 50*a* which forms a channel at the rear of the pad 50 for receiving the outer lip 24*m* of jaw 24*j*. The jaw pad 50 may be secured onto the jaw 24*j* by sliding the pad 50 over the jaw 24*j* so that the lip 24*m* is positioned within the channel defined by rim 50*a*, and by pressing the lower jaw pad portion onto the jaw 24*j* until tab portion 24*n* of jaw 24*j* is inserted into the corresponding receiving slot 50*b* located in the lower rim portion of pad 50. Conversely, the jaw pad 50 may be removed by pulling the lower rim portion of pad 50 off of the jaw 24*j*, thereby removing the tab portion 24*n* from the slot 50*b*, and then sliding the pad 50 off of the jaw 24*j* until the outer lip 24*m* is fully removed from the channel of the pad 50.

As illustrated in FIG. 2E, the second clamp member 24 preferably includes a brake or clutch release mechanism 52 for releasing or disengaging a brake or clutch 54 so that the position of the second clamp member 24 on the elongate member 26 can be adjusted. The brake release mechanism 52 includes an upper user operated portion 52*a* pivotally mounted to project through a slot opening in the clamp housing proximate to the gripping portion 24*h* so that an operator can conveniently actuate the mechanism 52 such as with their thumb while holding the gripping portion 24*h*. A pressing or engagement surface 52*c* is contoured with a concave configuration so that pushing on the surface causes pivoting in the direction shown by arrow 56 (FIG. 2D). An example of how an operator may actuate the brake release mechanism 52 is illustrated in FIG. 2C, with the letters T, I, M, R and P representing the location of the operator's thumb (first digit), index finger (second digit), middle finger (third digit), ring finger (fourth digit), and pinky or small finger (fifth digit), respectively. Preferably, the clamp 24 includes a finger support located before the trigger mechanism 62 so that the operator may position a finger, such as his or her pinky finger (FIG. 2C), in front of the trigger 62 to simplify the actuation of the release mechanism 52 and movement of the clamp 24 and make such movements easier to do. As mentioned above with respect to first clamp 22, an advantage to this configuration is that the motions required to actuate the release mechanism and back the clamp member 24 along the bar 26 are in the same direction, i.e., requiring movement from the forward end 24*a* toward the rearward end 24*b* of the clamp 24. In this way, the operator is not stuck trying to press the release mechanism forward and pull the clamp 24 in the opposite direction when trying to pull it backwards on the bar 26 or when trying to remove it from the bar 26 altogether.

The brake release mechanism 52 has pivot trunnion mounts 52*d* extending out from opposite sides of the lower lever portion 52*b* which define an axis about which the mechanism 52 is pivoted. The pivot trunnion mounts 52*d* extend into integral cylindrical pivot bosses or recess 24*p* located on the first and second housing portions 24*c*–*d* of clamp member 24. The brake engagement or lever portion 52*b* extends upward from the trunnions 52*d* to the user operated portion 52*a* so that pulling on the engagement surface 52*c* pivots the portion 52*b* back toward the rear of the housing 24*b*. As mentioned above, the location of the trunnion mounts 52*d* and length of the release lever 52 improves the mechanical advantage or leverage provided to the operator at the user operated portion 52*a* so that the brake release mechanism 52 may be operated more easily. More particularly, the lever portion 52*b* is pivoted into engagement with the brake (or clutch) 54 causing the brake 54 to move from a position of angular engagement with the elongate portion 26, to a more upright generally disengaged position with the elongate member 26. In a preferred embodiment, the lower portion 52*b* of mechanism 52 is forked such that the lower portion 52*b* defines a slot through which the bar 26 is allowed to pass. Thus, the lower portion 52*b* extends downward from the upper portion 52*a* in the form of two separate legs, each with its own outer trunnion pivots 52*d*. In a preferred embodiment, the brake release mechanism used in the second clamp 24 will be identical to the mechanism used in the first clamp 22 in order to save on manufacturing costs, such as tooling and time (e.g., by making the brake release mechanisms identical only one tool or mold need be made and makes release mechanism selection irrelevant since both clamp 22 and clamp 24 use the same type of release mechanism).

As can be seen in FIGS. 2C and 2E, the brake 54 is preferably in the form of a slotted plate having a central slot opening through which bar 26 extends. Similar to the brake system described above with respect to clamp 22, the brake 54 is normally held in an angular alignment with the elongate member 26 via springs, such as square spring 58, which make the brake 54 exert a frictional force against the elongate member 26. The angular alignment is such, however, that the frictional force applied to the elongate member 26 only prevents the clamp member 24 from moving about the elongate member 26 in one direction, and not the other. In this way, the second clamp member 24 can be slid along the bar 26 in the direction shown by arrow 60 (FIG. 2B), but cannot be slid along the bar 26 in the opposite direction unless the brake release mechanism 52 is actuated. Actuating, or pressing, the clutch release mechanism 52, causes the mechanism 52 to pivot about the axis defined by pivot trunnion mounts 52*d*, and drives the brake engaging lever portion 52*b* into the upper portion of brake 54. The lever 52*b* tilts the brake 54 into a more upright position, compressing spring 58 and thereby reducing the angular alignment (or engagement) of the brake 54 and elongate member 26. While in this more upright position, the second clamp member 24 is capable of freely moving about the elongate member 26 because the brake 54 is no longer in frictional engagement with the elongate member 26. Once the clutch release mechanism 52 is released, the brake 54 returns to an angular alignment and the frictional engagement created thereby prevents the member 24 from being pushed in a direction other than that shown by arrow 60.

The second clamp member 24 further includes a trigger mechanism 62 having a trigger lever 62*a* which actuates a trigger clutch 64, as shown in FIGS. 2C and 2E. The trigger mechanism 62 may be used to advance the clamp member 24 towards a workpiece so that a strong clamping force or strong spreading force (depending on the clamp configuration) can be applied to the workpiece. The trigger lever 62*a* includes an opening through which the elongate member 26 passes, and pivots about an axis 62*b* defined by the trigger portion located above the opening through which the bar 26 passes. Similarly, the trigger clutch 64 includes an openings through which the elongate member 26 passes. The trigger clutch plate 64 is normally held in a generally upright position proximate to the trigger lever opening 168 via spring 176. When the trigger 62 is actuated, the trigger lever 62*a* is pivoted up toward the elongated horizontal gripping portion 24*h*, driving the distal end of lever 62*a* towards the elongate member 26, which causes the trigger clutch plate 64 to be tilted into an angular alignment with the elongate member 26. This angular alignment allows the trigger clutch plate 64 to frictionally engage the elongate member 26. Further pulling of the trigger lever 62*a* causes the clutch plate 64 to shift away from the trigger lever opening thereby compressing spring 66. This movement of the trigger clutch plate 64, combined with the frictional engagement between the plate 64 and the elongate member 26, causes the elongate member 26 to be pulled through the opening of the trigger lever 62*a*, or causes the clamp member 24 to advance on the elongate member 26 in the direction indicated by arrow 60. The spring 66 compresses when the trigger clutch 64 is shifted away from the trigger lever opening because backstop 24*v* prevents the entire spring 66 from moving with the clutch plate 64 along the bar 26.

In a preferred embodiment, a bearing member such as pin 68 is provided along with the trigger mechanism 62 in order to improve the trigger lever's ability to move the trigger clutch plate 64 and improve the trigger lever's life. For example, the bearing pin 68 improves the trigger lever's ability to move the trigger clutch plate 64 because it provides a hardened bearing surface between the trigger lever 62*a* and the trigger clutch plate 64 which the trigger clutch plate 64 cannot dig into when the trigger lever 62*a* is actuated. Thus, once the trigger lever 62*a* is actuated, the bearing pin 68 engages the trigger clutch plate 64 causing the trigger clutch plate 64 to be tilted into an angular alignment with the elongate member 26. The bearing pin 68 also improves the trigger lever's life by preventing the trigger clutch plate 64 from digging into and/or whittling through the trigger lever 62*a* due to the friction caused between the metal clutch plate 64 and the plastic trigger lever 62*a*.

Once the trigger lever 62*a* is released, the spring 66 forces the trigger clutch plate 64 back toward the trigger lever opening and back into an upright alignment with respect to elongate member 26. With such a configuration, the clamp member 24 remains freely movable over the elongate member 26 in the direction indicated by arrow 60 because the trigger clutch plate 64 is normally biased in an upright position which does not frictionally engage elongate member 26. Thus, the clamp 24 may be moved in the direction of arrow 60 by either pushing the clamp in this direction or by actuating the trigger mechanism 62. In a preferred embodiment, coarse adjustments of the clamp in the direction of arrow 60 are made by simply pushing the clamp in this direction, and fine adjustments of the clamp, such as those made when determining how much clamping or spreading force should be used, are made by actuating the trigger mechanism 62. To remove the clamp 24 or move the clamp in the opposite direction of arrow 60, or to simply make the clamp freely movable about the elongated member 26 in either direction, the operator can simply actuate the brake release mechanism 52.

In a preferred form of apparatus 20, the second clamp member 24 is also fully removable from the elongate member 26. The clamp member 24 includes a pair of guide block portions 70*a* and 70*b* in the interior thereof, and preferably formed on the interior of the second housing portion 24*d*. The guide blocks 70*a–b* have through bores configured with substantially the same configuration as that of the oblong or obround bar 26. Accordingly, the clamp member 24 is supported for sliding movement along the bar 26 by the guide block portions 70*a–b* through which the bar 26 extends. In order to assist the pivot action of the brake release mechanism 52 and the operator's ability to remove the clamp 24 from the bar 26 without having the clamp 24 disassemble, (e.g., without the internal clamp mechanisms becoming misaligned), the clamp 24 may also include a brake pivot boss 24*q* and alignment members such as alignment rib 24*r* (FIG. 2E). Given the brake's movement from its forward inclination to a more upright or perpendicular orientation, the alignment rib 24*r* is positioned behind the brake plate 54, or towards the rear of the clamp 24*b*, and the brake pivot boss 24*q* is positioned in front of the brake plate 54 so that the brake plate 54 can be pivoted about the pivot boss 24*q* more easily due to the pivot boss's rounded edge. When the brake release mechanism 52 is not engaged and/or the clamp 24 is removed from the bar 26, the alignment of the brake 54 and release mechanism 52 is maintained via the pressure exerted against the brake plate 54 via spring 58. For example, the spring 58 forces the brake plate 54 against the lower lever portion 52*b* of release mechanism 52, thereby sandwiching the brake 54 and release mechanism 52 between the spring 58 and the release mechanism's limit of travel. Thus, preventing the brake plate 54 and release mechanism 52 from becoming misaligned once the clamp is removed from the elongated member 26. The tight fit between the lower brake plate portion and both the pivot boss 24*q* and alignment rib 24*r* also helps maintain the alignment of the brake plate 54. Similarly, the cooperative relationship between the trunnion mounts 52*d* and the cylindrical pivot bosses or recess 24*p* help maintain the alignment of the release mechanism 36.

The alignment of the spring 58 is generally maintained via its compression between the brake plate 54 and integral spring alignment ribs 24*s* located on the interior of the clamp housings 24*c–d*. In the embodiment illustrated in FIGS. 2E and 4, the spring 58 is vertically aligned via the uppermost and lowermost horizontal spring alignment ribs, horizontally aligned via the vertical spring alignment ribs, and axially aligned via the intermediate horizontal spring alignment ribs (FIGS. 2E and 3).

With respect to the trigger mechanism 62, the alignment of the internal clamp mechanisms, (e.g., trigger lever 62*a*, trigger clutch 64, etc.), is maintained when the clamp 24 is removed from the elongate member 26 via spring 66 and the pressure it exerts against the clutch plate 64. For example, the spring 66 forces the clutch plate 64 against the forward end of the trigger lever 62*a*, thereby sandwiching the clutch plate 64 and the trigger lever 62*a* between the spring 66 and a backstop formed by a vertical rib integral to the housing portions 24*c–d* of clamp 24. Thus, preventing the clutch plate 64 and trigger lever 62*a* from becoming misaligned once the clamp 24 is removed from elongate member 26.

Trigger guides, such as stud 24*w* (FIG. 4), may also be located on the inner surfaces of housing portions 24*c–d* in order to help maintain the alignment of the trigger lever 62*a* and/or clutch plate 64. For example, in the embodiment illustrated, the trigger lever 62*a* contains two guide recesses 62*c* (FIG. 2E) located on opposite sides of trigger lever 62*a*, and through which the guide studs 24*w* are disposed and travel when the trigger is moved from its normally biased release position to its pivoted bar engagement position. More particularly, guide recesses 62*c* are arcuate in shape and provide a channel for guiding and limiting the travel of stud 24*w* in order to constrain the trigger lever's movement during operation and assist in maintaining the trigger lever's alignment when the clamp 24 is removed from the elongate member 26. This configuration further allows the trigger mechanism 62 to operate more firmly and efficiently, with less play (or wasted movement) in its range of travel.

It should be understood, however, that in alternate embodiments of apparatus 20, the studs 24*w* may extend from the trigger lever 62*a* and the recesses 62*c* may be located in the housing portions 24*c–d*. Furthermore, it should be understood that the trigger guides may take on a variety of shapes and configurations other than studs and recesses that allow the components of clamp 24 to remain aligned when removed from the elongate member. For example, the trigger lever 62*a* and housing portions 24*c–d* may contain cooperating projections which guide the trigger lever 62*a* over its range of travel, and/or provide ends of travel, which maintain the alignment of the trigger lever 62*a* so that the clamp 24 may be fully removed from the elongate member 26, if desired.

Figure 4:
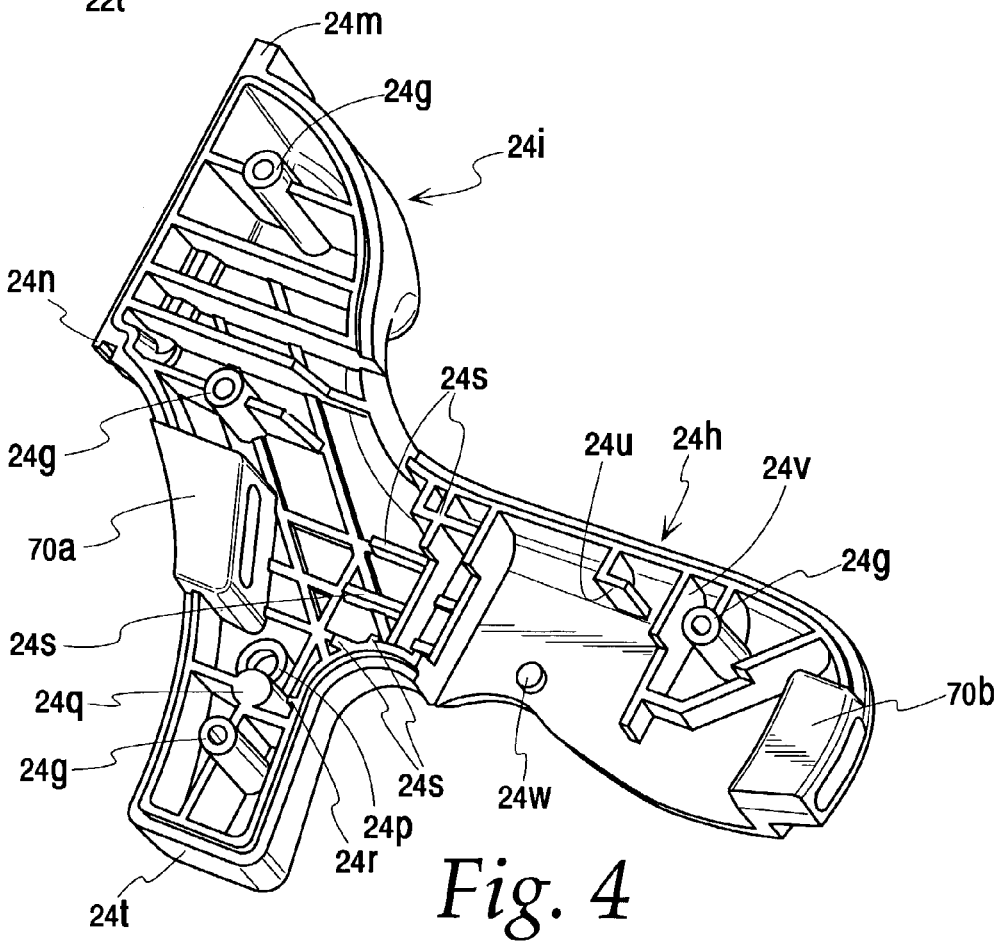
FIG. 4 is a perspective view of a housing portion of the movable clamp of FIG. 1 illustrating the alignment ribs, cylindrical pivot boss, trigger boss, and spring positioning ribs located therein among other items.
Figure 6:
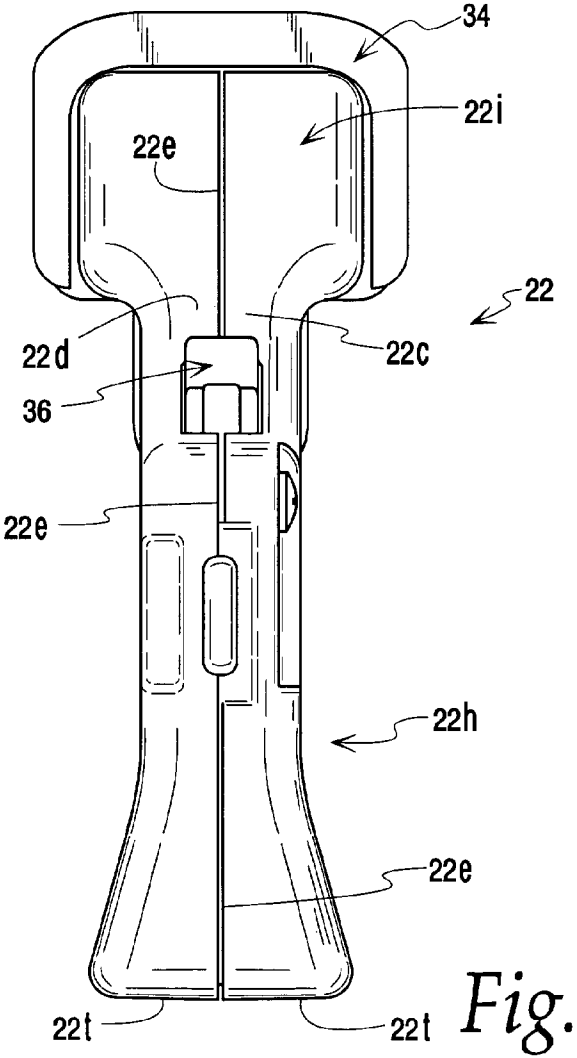
FIG. 6 is a rear elevational view of the stationary clamp of FIG. 1.
Figure 5:
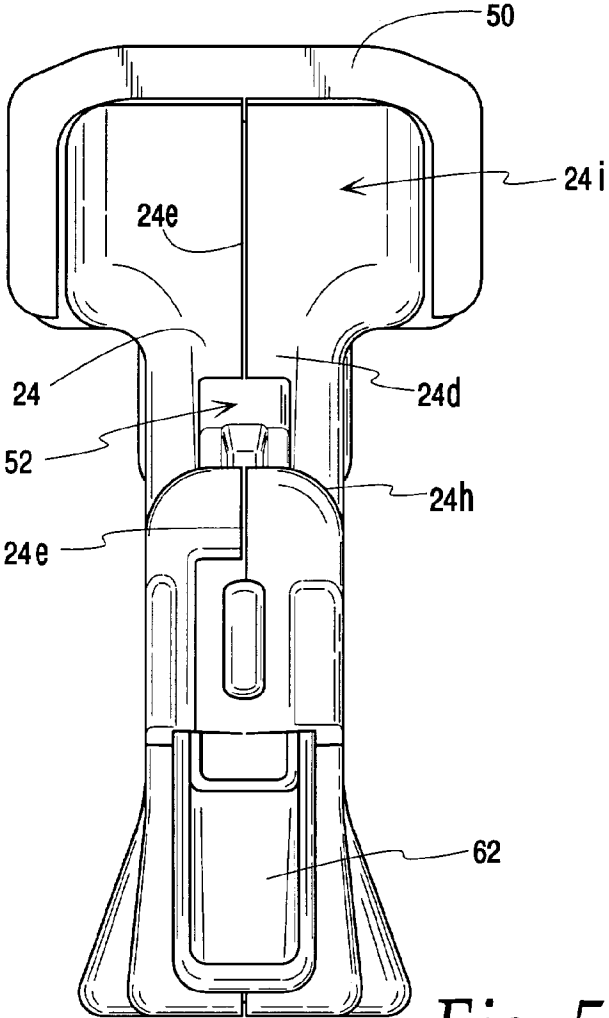
FIG. 5 is a rear elevational view of the movable clamp of FIG. 1.

The alignment of the spring 66 is generally maintained via its compression between the clutch plate 64 and the back stop 24*v* located on the interior of the clamp housings 24*c–d*. In the embodiment illustrated, the spring 66 is vertically aligned via spring alignment rib 24*u*, horizontally aligned via the clutch plate 64 and back stop 24*v*, and axially aligned via the side walls of trigger lever 62*a* (FIGS. 2E and 4). The spring 66 will therefore keep the trigger mechanism 62 and clutch plate 64 in the proper vertical position or alignment. Thus, the clamp 24 may be fully removed from the bar 26 as desired. The ability to remove both clamps 22 and 24 from the bar 26 allows the operator to select different sized elongate members 26 so that the clamp members 22 and 24 may be used to clamp or spread various workpieces. This also allows the operator to simply buy additional elongate members 26 or replacement bars and clamps as needed rather than having to purchase entire bar clamp assemblies in order to clamp or spread different workpieces.

With the brake 54, brake release mechanism 52, spring 58, clutch 64, trigger mechanism 62, spring 66, and elongate member 26 coupled to the second housing portion 24*d* of clamp member 24, the first housing portion 24*c* serves as a cover to enclose these components within the interior region of the clamp member 24. FIG. 2D is a view of the exterior surface of the cover or first housing portion 24*c* and FIG. 2E is a view of the bar clamp assembly 28 with the cover 24*c* removed. As mentioned above, the first housing portion 24*c* is attached to the second housing portion 24*d* in a clam shell arrangement via fasteners 46. Once the first and second housing portions 24*c–d* are connected, jaw pad 50 may be attached onto the clamp member 24 in the manner set forth above.

The first and second housing portions 24*c–d* of clamp 24 include large and generally flat bottom surfaces 24*t* which allow the clamp 24 to stand upright similar to clamp member 22 and its lower surfaces 22*t*. More particularly, the flat bottom surfaces of housing portions 24*c–d* taken together comprise a generally rectangular surface (FIG. 2G) which is approximately as wide as the remainder of the clamp 24 (see FIG. 5) and is sufficient to allow the clamp member 24 to stand upright on a flat support surface, such as a bench top, when the clamp members 22 and 24, and elongate member 26 are used apart from the base 30. Thus, allowing the bar clamp assembly 28 to be freestanding so that it can support smaller workpieces on its own on top of a generally flat work surface, such as a bench top. In addition, the clamp members 22 and 24 are preferably of the same height so that the clamp flat surfaces 22*t* and 24*t* make contact with the work surface even when the bar clamp assembly 28 is secured to the base 30. The benefits of this configuration will be discussed further below.

Referring now to FIGS. 7A–H, in which a variety of views of base 30 are illustrated, the base 30, as mentioned above, includes an upper portion 74 and a lower portion 76. The upper base portion 74 includes a dome-shaped housing 74*b* having recessed areas 74*c* for product labeling, and receiving portion 74*d* with which the elongate member 26 can be connected to the base 30. The recessed areas 74*c* also provide a gripping surface with which the operator can grasp the base (and/or bar clamp assembly if positioned thereon) to move the apparatus 20 to a desired location. The upper base portion 74 further includes securing mechanism 74*a* which fixes the elongate member 26 in place relative to the base 30. The securing mechanism 74*a* is operated by actuating lever 80.

Figure 7A:
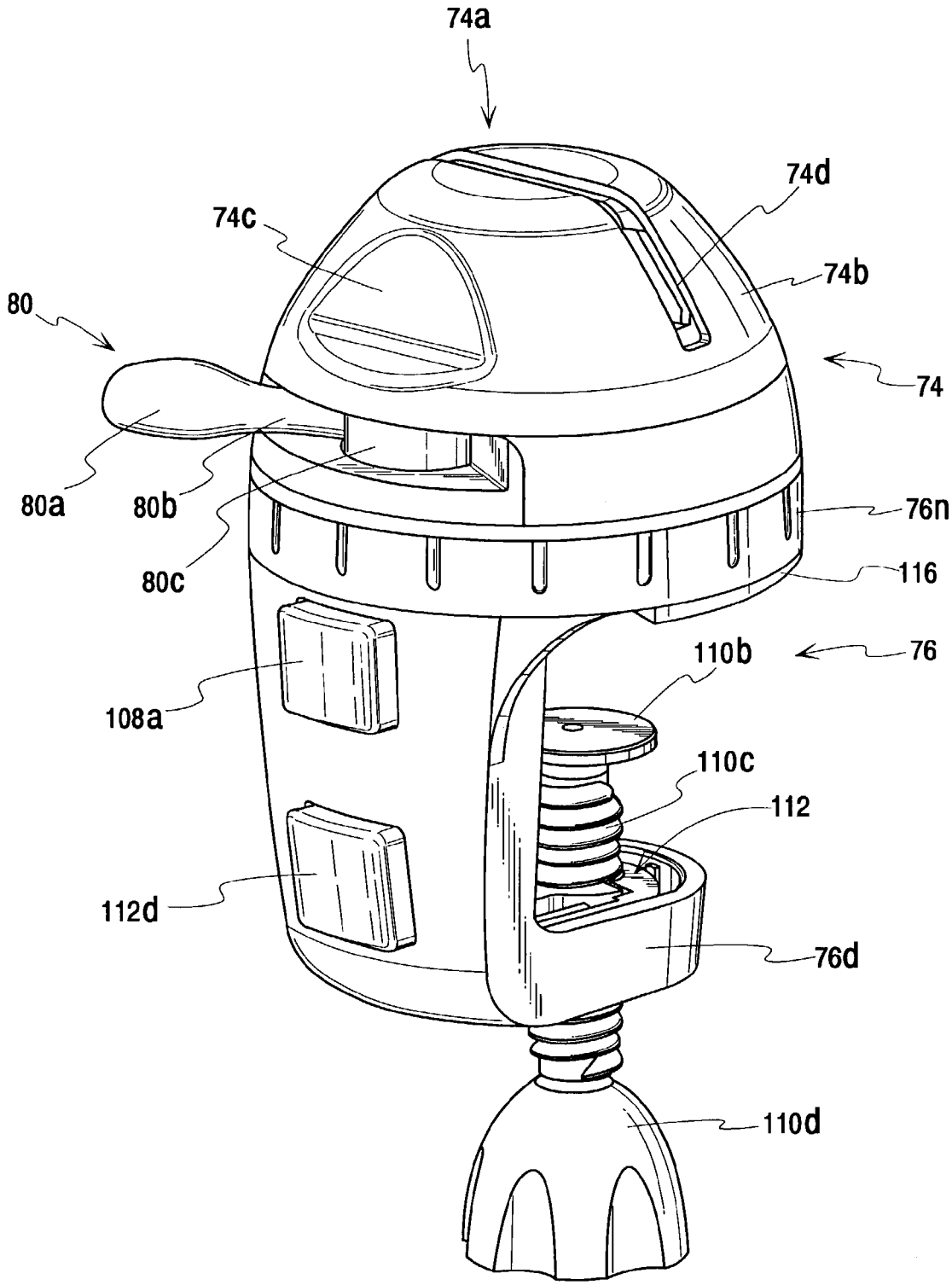
FIG. 7A is a perspective view of the movable base of FIG. 1.
Figure 7C:
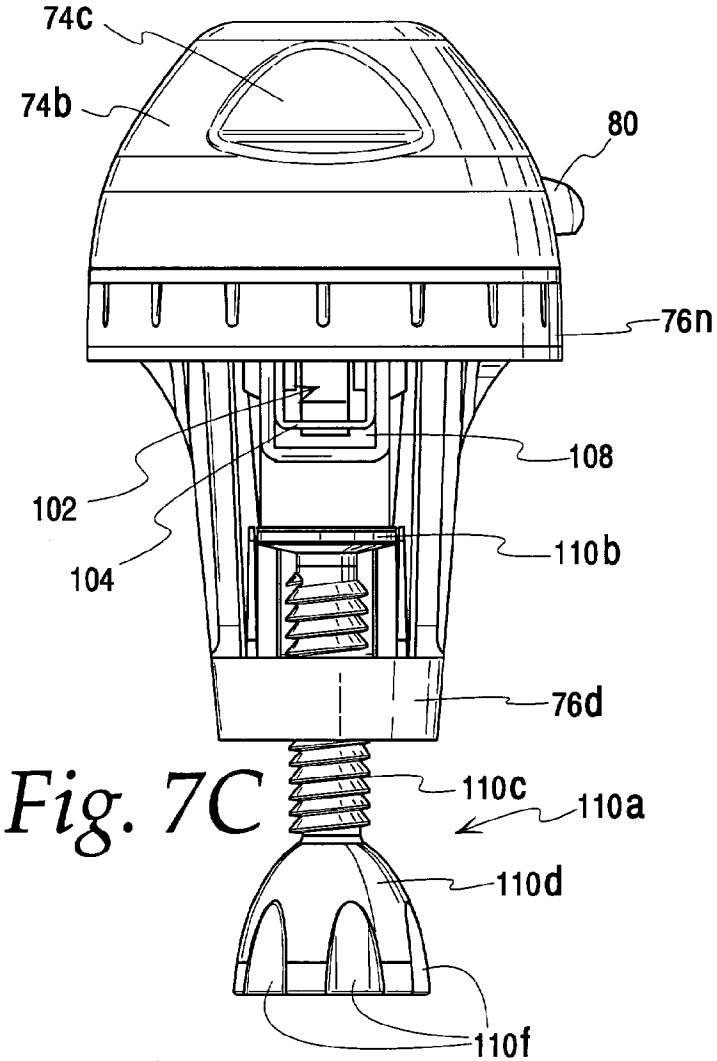
FIGS. 7B–C are front and rear elevational views, respectively, of the movable base of FIG. 1.
Figure 7B:
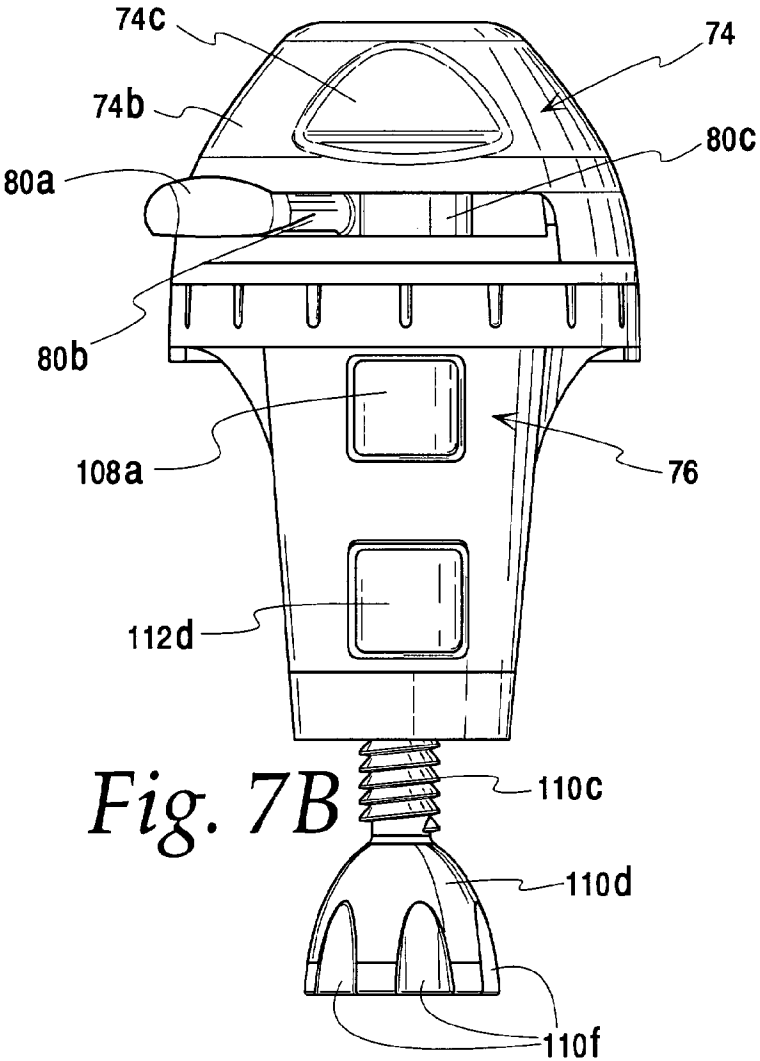
Figure 7E:
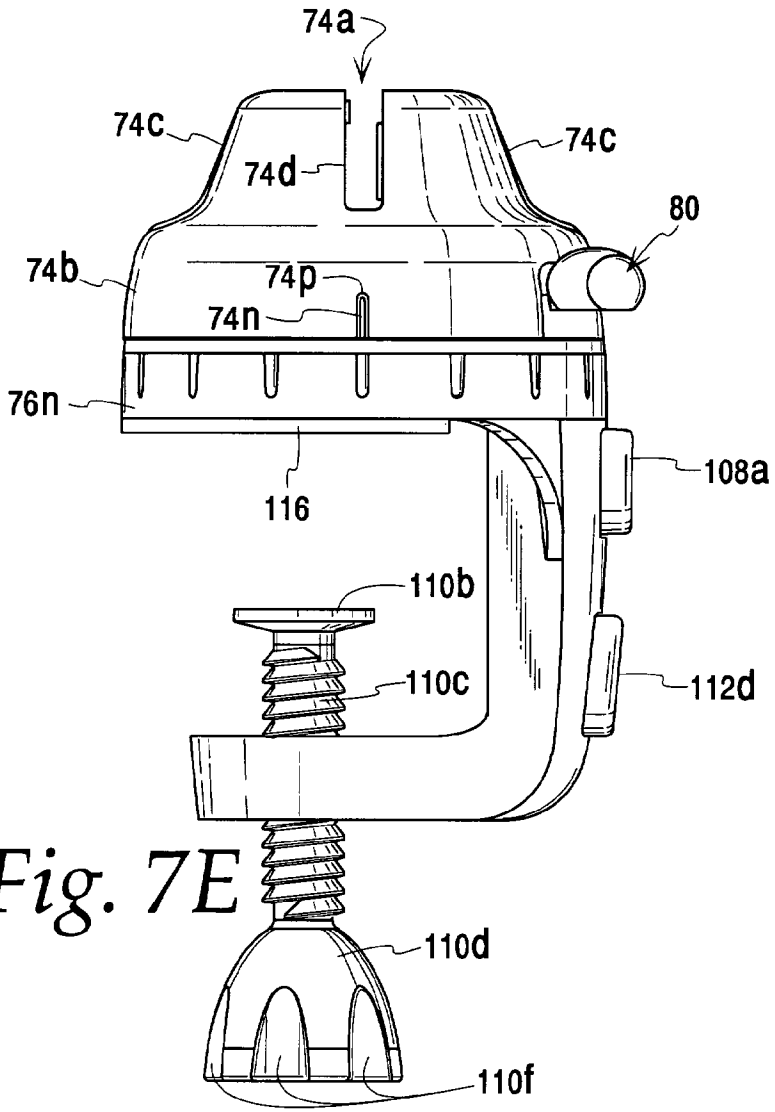
FIGS. 7D–E are left and right side elevational views, respectively, of the movable base of FIG. 1.
Figure 7D:
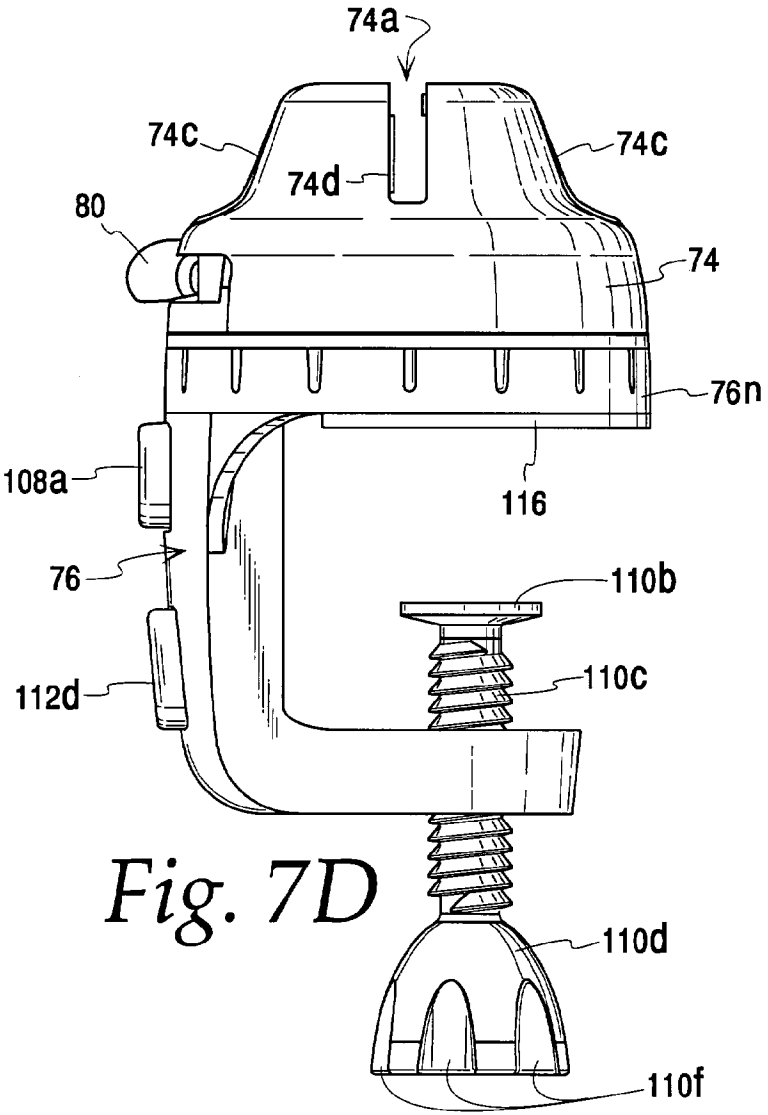
Figure 7F:
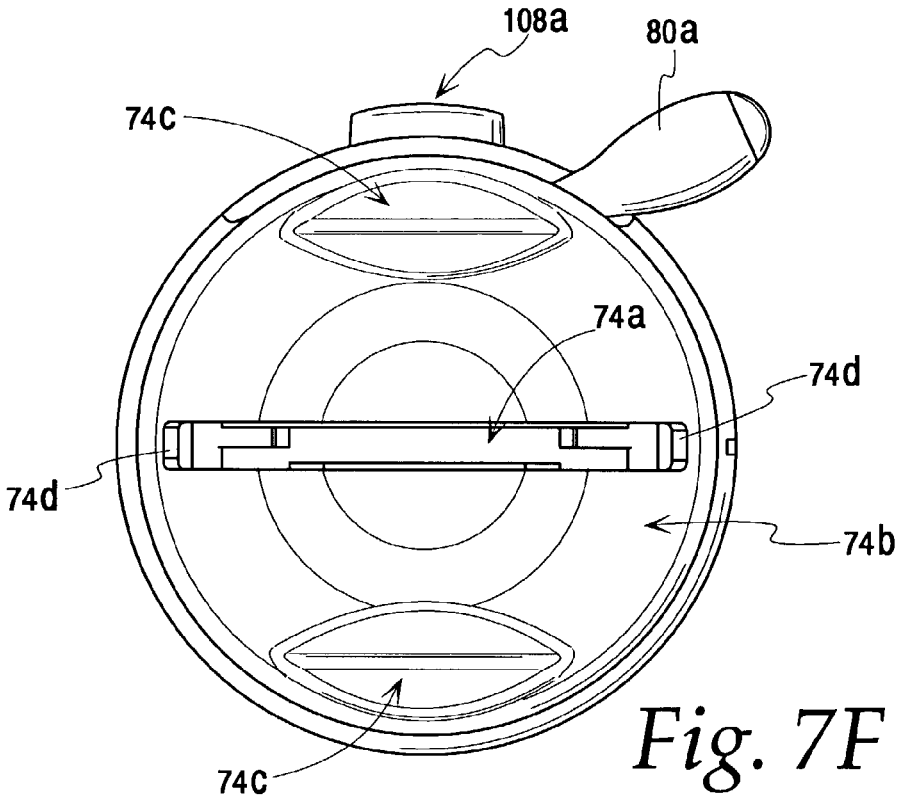
FIGS. 7F–G are top and bottom views, respectively, of the movable base of FIG. 1.
Figure 7G:
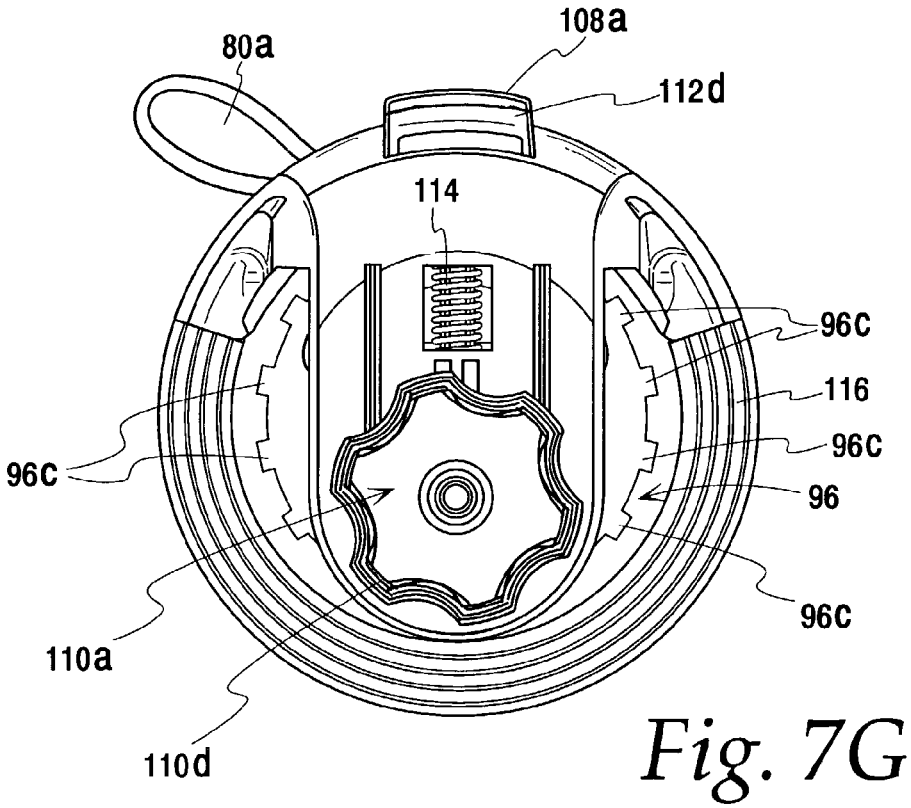
Figure 7H:
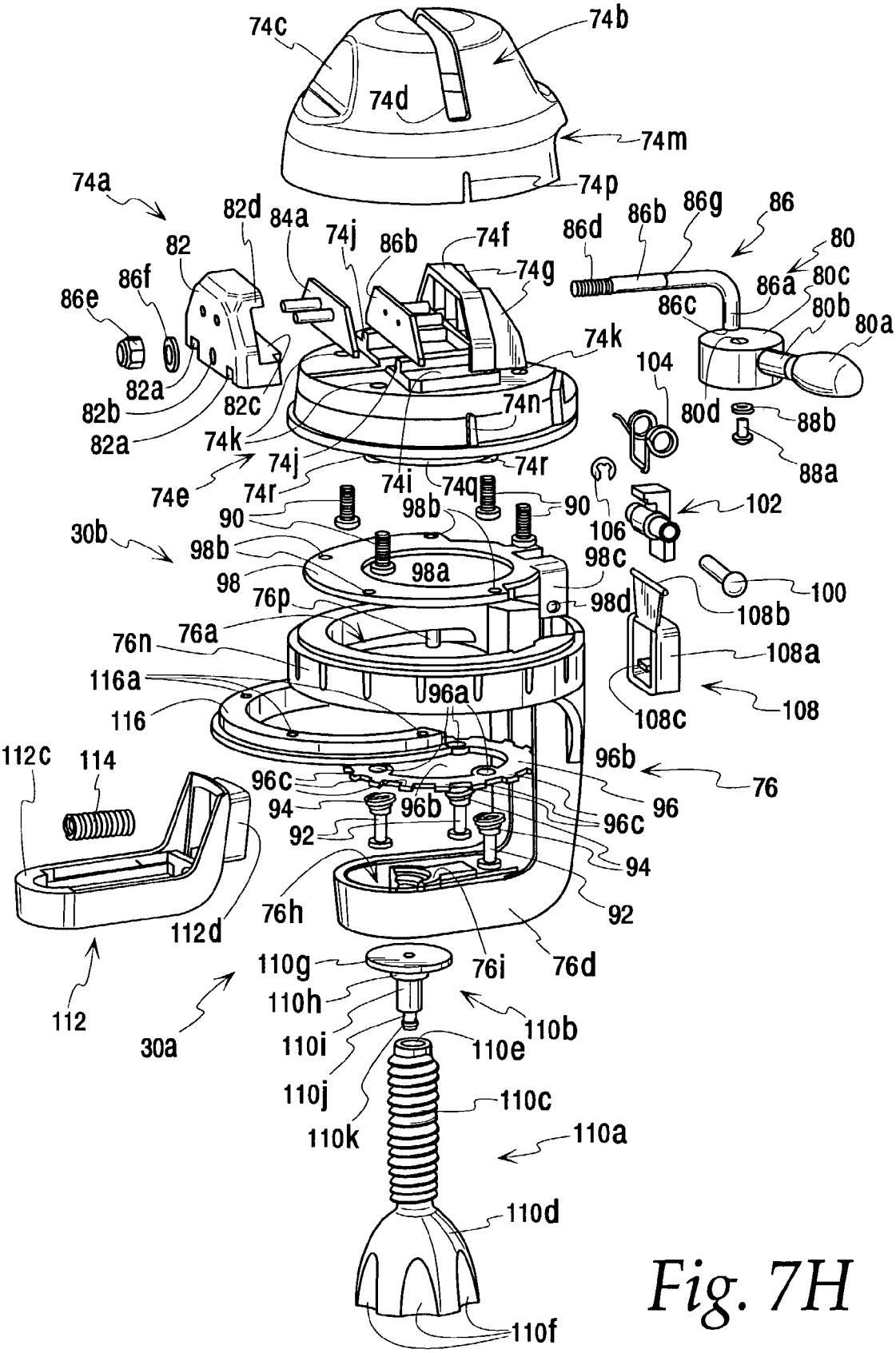
FIG. 7H is an exploded view of the movable base of FIG. 1.

As illustrated in FIG. 7H, a preferred form of securing mechanism 74*a* includes actuating lever 80, clamp block 82, friction pads 84*a–b*, and an internal base plate or frame 74*e*. The internal base frame 74*e* has a generally disk-shaped lower base portion and a vertical wall 74*f* with gusset members 74*g* extending along the side of the wall 74*f*, between it and the disk-shaped lower base portion, to reinforce the wall 74*f*. The base frame 74*e* further includes a cylindrical recess such as circular cup portion 74*h* (FIGS. 7I–J) in the upper surface of the disk-shaped lower portion and an opening in vertical wall 74*f* (see FIG. 7I) which cooperate to mount the actuating lever 80 so that it may be shifted to operate the securing mechanism 74*a*. The actuating lever 80 has an enlarged bulb-shaped handle or gripping portion 80*a* which tapers into a shaft 80*b*. The shaft 80*b* connects the handle 80*a* to an annular block such as cylindrical or cup shaped portion 80*c*, which sets in the recessed cup portion 74*h* of frame 74*e* and uses the recessed cup portion 74*h* as a rotary bearing surface. Actuating or shifting the handle 80*a* rotates the member 80*c* within the recessed cup portion 74*h*. The annular portion 80*c* has an upper wall in which an off-centered opening 80*d* is formed. In a preferred embodiment, the handle 80*a* and shaft 80*b* are partially hollowed (FIG. 7G) in order to provide a lighter end product and reduce material costs.

Movement of the actuator lever 80*a* drives a driver member 86 to move the clamp block 82 between its bar securing and bar releasing positions. More particularly, drive member 86 is preferably L-shaped and has its transverse foot portion 86*a* attached to annular portion 80*c* and its elongate arm portion 86*b* connected to the retaining block 82 via nut 86*e* and washer 86*f* for shifting the block 82 between bar release and bar retaining positions. The L-shaped drive shaft 86 includes a threaded bore 86*c* on the distal end of the foot portion 86*a* and a threaded portion 86*d* on the distal end of the elongate arm portion 86*b*. The link end including threaded bore 86*c* is fed through opening 80*d* of cup-shaped member 80*c* and is coupled to member 80*c* via fastener 88. In a preferred form of the apparatus 20, an annular wall extends down about the opening 80*d* into the interior region of cup-shaped member 80*c* in order to provide a sleeve within which at least a portion of foot 86*a* may be inserted, and the fastener 80 consists of screw 88*a* which is inserted through washer 88*b* and threaded into the receiving bore 86*c* of link 86. The screw 88*a* is tightened until the link 86 is firmly fastened to the actuating lever 80*a*. Once this is complete, the entire actuator mechanism 80, including link 86 and actuator lever 80*a*, is coupled to the internal base frame 74*e*. More particularly, link 86 is fed through the opening (FIG. 7I) in vertical wall 74*f* and the cup-shaped member 80*c* is nested in the cylindrical or cup-shaped recess 74*h* of internal base frame 74*e*.

Figure 7I:
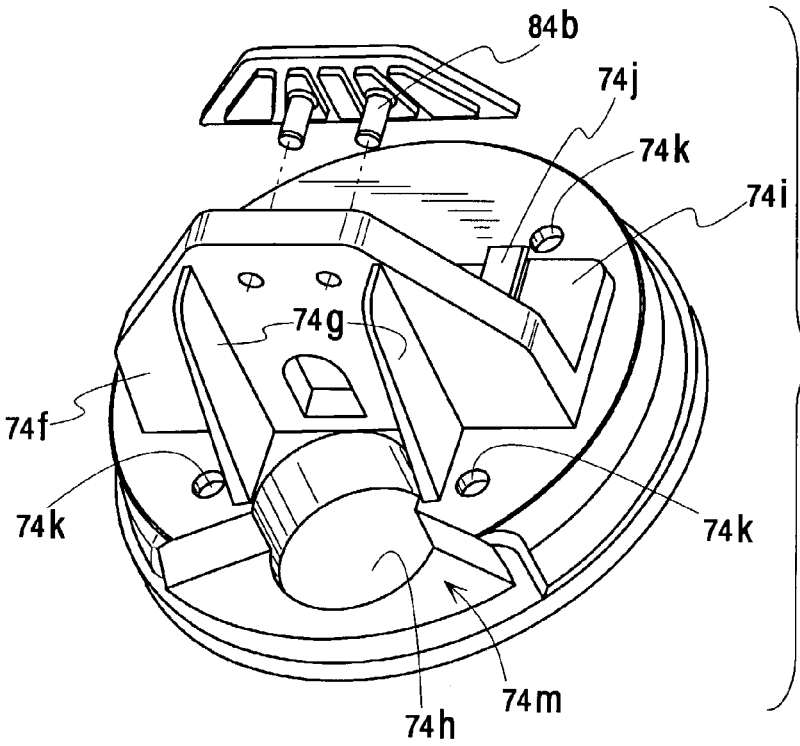
FIGS. 7I–J are partially exploded perspective views of the base plate and bar securing mechanism of FIG. 7H, respectively.
Figure 7J:
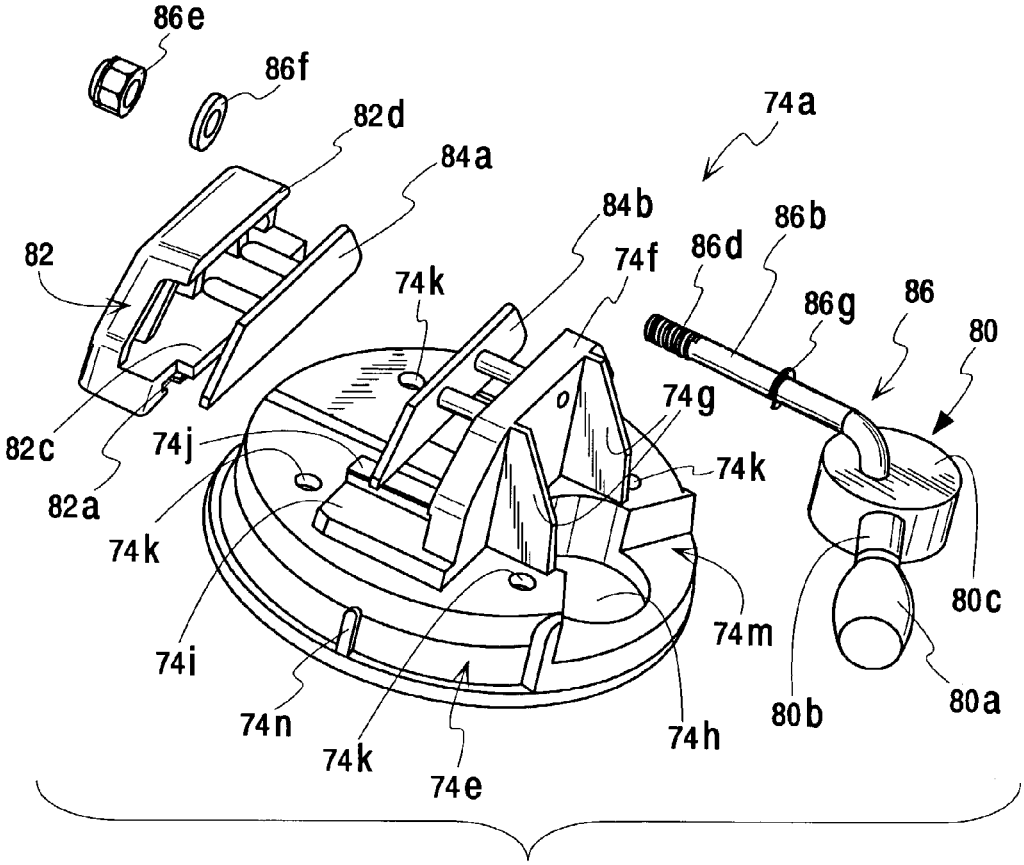
Figure 7K:
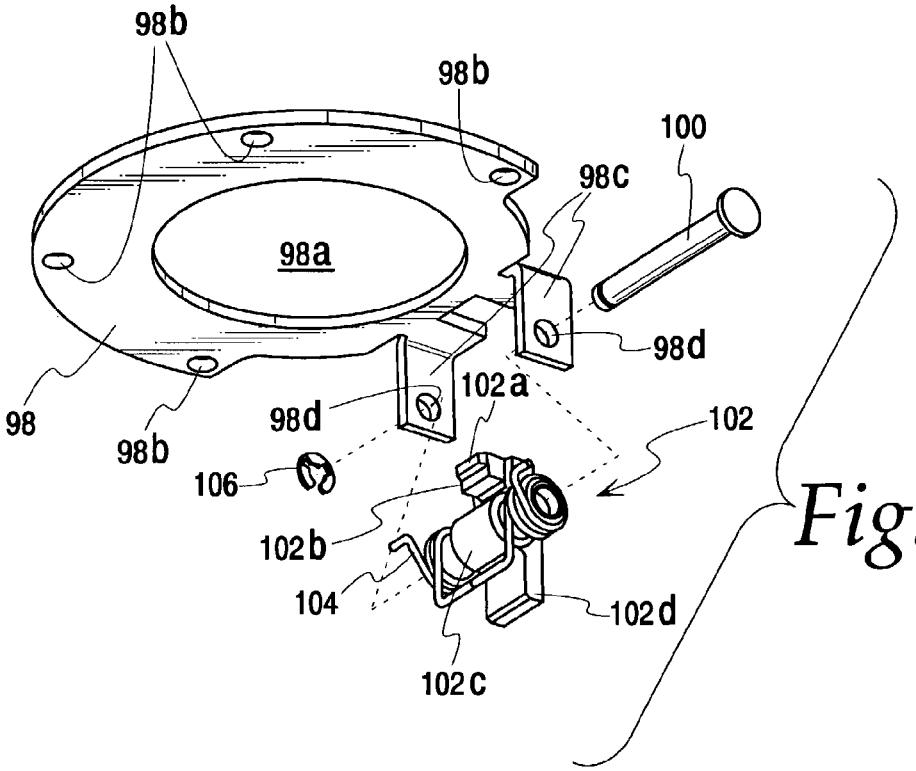
FIGS. 7K–M are exploded, side and bottom views, respectively, of a portion of the rotational release mechanism of FIG. 7H.
Figure 7L:
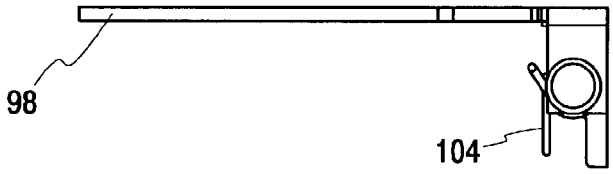
Figure 7M:
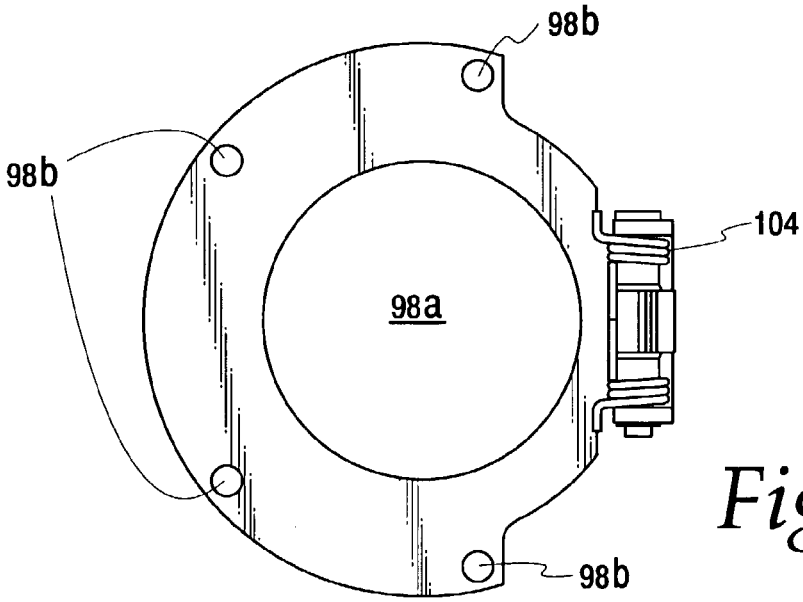

Adjacent the vertical wall 74*f*, as can best be seen in FIGS. 7H–J, is a generally horizontal base portion 74*i* mounted to the disk shaped internal base frame 74*e*. The base portion 74*i* includes guides in the form of slide rails 74*j* for the clamp block 82. At its lower end, the block 82 includes dovetail channels 82*a* for riding on the slide rails or guides 74*j* between bar release and bar retaining positions of the block 82. In addition, the vertical wall 74*f* and clamp block 82 have friction pads 84*b* and 84*a*, respectively, which are positioned on the inner surfaces of the wall 74*f* and block 82 such that the pads 84*a–b* face one another. The friction pads 84*a–b* are preferably made of a rubber, such as neoprene, and include two projecting members which are inserted through complimentary openings in the wall 74*f* and block 82 for attaching the friction pads 84*a–b* thereto. The projecting members may be connected to the wall 74*f* and block 82 in a variety of ways, however, in a preferred form the projections are made of rubber and are secured to the wall 74*f* and block 82 via friction fit arrangements.

The block 82 is substantially fixed onto the actuator drive shaft 86 so that movement of the actuator lever 80*a* from one limit of travel to the other limit of travel results in movement of the clamp block 82 between associated bar release and bar retaining positions. More particularly, in the embodiment illustrated, the threaded portion 86*d* of link 86 is fed through opening 82*b* (FIG. 7H) in block 82 and through washer 86*f* and is secured thereto by nut 86*e* which is thread onto the end 86*d* of link 86. The block is then sandwiched between the nut and washer 86*e–f* and an end stop 86*g* (FIG. 7H) which may be a clip (e.g., E-clip, C-clip, etc.), a shoulder, or the like located on drive member 86. Thus, when the actuator lever 80*a* is shifted so as to move the block 82 to its bar retaining position, the pads 84*a–b* of the bar capturing mechanism 74*a* will resiliently engage the vertical walls 26*d–e* of the elongate member 26. The resiliency of the friction pads 84*a–b* allows the bar securing mechanism 74*a* to secure bars of different sizes without diminishing its capability of securing the bar 26. More particularly, the malleable nature of the friction pads 84*a–b* provide a means for compensating over traveling of the block 82, such as when the block 82 has securely engaged the elongate member 26 prior to the actuator 80 reaching its final bar retaining or securing position (i.e., its limit of travel).

The block 82 includes a lower support surface such as shelf 82*c* on which the elongated member 26 rests once inserted into the base slot 74*d*. An upper lip or overhanging portion 82*d* is formed on the block 82 and extends over the lower support surface 82*c* but is shorter than the support surface in terms of how far it extends toward the vertical wall 74*h*. In this manner, when the block 82 is extended to its bar release position, the overhanging portion 82*d* will clear the slot opening 74*d* of the bar securing mechanism 74*a* with a distal portion of the lower support surface 82*c* still aligned therewith in position to support the bar 26 thereon. With the bar 26 inserted through the slot opening 74*d* and resting on the lower surface portion 82*c*, operating the actuator 80 to shift the block 82 to its retaining position, causes the overhanging portion 82*d* to shift toward the vertical wall 74*f* for substantially closing the slot opening 74*d* and fitting over the top 26*a* of bar 26 to fix or secure the bar 26 to the base 30. In this regard, the spacing between the upper and lower block portions 82*c–d* is preferably only slightly greater than the height of the bar 26. In practice, the actuator 80 is pivoted counterclockwise (looking from the top in FIG. 7F) in order to shift the block 82 to the retaining position thereof. Such pivoting restricts the eccentric drive shaft 86 through the wall opening in vertical wall 74*f* to draw the block 82 toward the wall 74*f* until the friction pads 84*a–b* resiliently engage the bar 26. In this manner, the bar 26 is substantially fixed against sliding in the slot 74*d*, and cannot be lifted out of the slot 74*d* due to the overhanging lip portion 82*d* blocking the slot opening 74*d* and the frictional effect of pads 84*a–b*. To release the bar 26 such as for repositioning or removing the bar 26, the actuator handle 80*a* is pivoted clockwise which advances the drive shaft 86 through the opening in wall 74*f* causing the block to slide on rails 74*j* to its release position where the lip portion 82*d* no longer interferes with removal of the bar up and out from the slot opening 30*h*. In a preferred embodiment, the handle 80*a* need not be rotated all the way to its limit of travel in the bar release position in order to reposition the bar 26, but rather only needs to pivot enough so that the friction pads 84*a–b* substantially disengage from the bar 26. Depending on the size of the pads 84*a–b* used, lip portion 82*d* may still be partially obstructing the slot opening 74*d* and removal of the bar 26 therethrough.

The dome-shaped housing 74*b* and internal base frame 74*e* are connected, as shown in FIG. 7H, via fasteners 90 which are partially inserted through openings 74*k* in the internal base frame 74*e* and are threaded into corresponding bores attached to housing 74*b*. The housing 74*b* and base frame 74*e* further define a slot cutout 74*m* (FIGS. 7H–J) which allows for the actuating lever 80 to protrude therefrom with the cutout having end walls that define the final retain and release positions or limits of travel for lever 80*a*. An alignment tab 74*n* is also provided and is attached to the internal base frame 74*e*. When the housing 74*b* is attached to the internal base frame 74*e*, the alignment tab 74*n* is inserted into a tab receiving slot 74*p* thereby ensuring that the housing 74*b* and plate 74*e* are properly aligned with one another. As assembled, the lower most end surfaces of the receiving slot 74*d* are level or flush with block support surface 82*c* to provide additional support for the elongate member 26 received therein. The slot walls can also assist in limiting twisting or rotation of the bar held in the slot 74*d*. To this end, the slot wall spaced from wall 74*f* is preferably in alignment with the clamp block friction pad 84*a* when the block 82 is shifted to its bar retaining position.

The upper base portion 74 is connected to the lower base portion 76 via mounting plate 74*q* (FIG. 7H), which is cylindrical in shape and includes threaded bores 74*r* for receiving lower base portion fasteners 92. In FIG. 7H, the threaded portions of fasteners 92 are inserted through springs, such as conical compression springs 94 (which act similar to washers), and through openings 96*a* in lower indexing plate 96, which is positioned beneath the index mounting plate 98 in the circular opening 76*a* of lower base housing 76. The threaded portions of fasteners 92 are then screwed into engagement with the threaded bores 74*r* of mounting plate 74*q*, thereby securing the lower base portion 76 to upper base portion 74. In alternate embodiments, other types of washers such as Belleville washers or wave washers may be used in place of conical compression springs 94. The indexing plate 96 and indexing mounting plate 98 are part of an indexing mechanism 30*b* which allows the upper base portion 74 to be oriented in a plurality of different positions with respect to lower base portion 76. In this regard, the rotary position of the bar clamp assembly 28 (when secured to the base 30) can be adjusted to accommodate space constraints that may be present so that, with the selected position, the space available for working with the apparatus 20 is optimized.

More particularly, the indexing plate 96, which consists of a disk-shaped ring having a central opening 96*b*, a plurality of fastener openings 96*a*, and a plurality of projections or teeth 96*c* present about the periphery of the indexing plate 96. In a preferred form of apparatus 20, the fastener openings 96*a* are positioned one hundred and twenty degrees apart from one another and a total of sixteen teeth 96*c* are provided with the center of each tooth 96*c* being twenty-two and one-half degrees apart from the center of the next tooth 96*c*. The preferred configuration of indexing plate 96 will allow the upper base portion 74 to be rotated about the lower base portion 76 in twenty-two and one-half degree increments. These configurations are, however, purely exemplary and may be changed to provide rotations of differing degrees or increments.

As illustrated in FIGS. 7H and K–M, the indexing mounting plate 98 includes a disk-shaped ring having an interior opening 98*a* and a plurality of peripheral alignment openings 98*b* which are used to align the indexing mechanism 30*b* with lower base portion 76 and upper base portion 74. A pair of projecting members 98*c* extend downward from one end of plate 98 and include openings 98*d* through which pin 100 passes coupling index lock 102 and torsion spring 104 to the indexing mounting plate 98. The pin 100 is retained in the openings 98*d* via E-clip 106 and projecting members 98*c* provide the backstop for the end portions for the torsion spring 104. The index mechanism 30*b* consists of lock 102 having a stop portion 102*a*, a locking step 102*b*, and a pivot sleeve 102*c* through which clevis pin 100 is passed and on which torsion spring coils 104 are mounted.

As discussed above, when the indexing plate 96 is fastened to the mounting plate 74*q* of upper base portion 74, the indexing plate 96 is mounted flush to the indexing mounting plate 98. With this configuration, the stop portion 102*a* of torsion index lock mechanism 102 is normally pressed against the mounting plate 98 between the extending members 98*c*, and is aligned in generally the same plane as the plate 98. As such, the locking step 102*b* (extending down from the stop portion 102*a*) will be aligned in generally the same plane as the indexing plate 96 and will cause the locking step 102*b* to fill a gap between the teeth 96*c* of plate 96. By doing so, the locking step 102*b* operates as a lock holding the upper base portion 74 in the orientation it currently is in. If the orientation of the upper base portion 74 is desired to be changed, an operator need only press the lower portion 102*d* of index lock 102 inward toward the interior openings 98*a* and 96*b* causing the index lock 102 to pivot about the pivot axis defined by clevis pin 100 thereby pulling the locking step 102*b* out of engagement with the gap between teeth 96*c*. This allows the upper base portion 74 to be freely rotated about the lower base portion 76 until the index lock 102 is allowed to go back to its normally biased state with the locking step 102*b* filling a gap between teeth 96*c*.

In a preferred form of the apparatus 20, the lower portion 102*d* of index lock 102 is pressed inward toward the interior openings 98*a* and 96*b* via a rotational release user input such as push button 108. The rotational release input 108 consists of a large push button surface 108*a* hanging from a pivot axis 108*b*. The input 108 further includes a protruding strike member 108*c* which is used to press the lower portion 102*d* of index lock 102 and thereby remove the locking step 102*b* from the gap between teeth 96*c* so that the upper base portion 74 can be rotated with respect to lower base portion 76. The ends of the hanging pivot axis 108*b* are nested in recesses 76*b* formed above the opening through which the push button surface 108*a* is disposed, near the very top of lower base housing 76.

Below the indexing mechanism 30*b* there is provided a base securing mechanism 30*a* which secures the base 30 to a work surface such as a bench top. In a preferred form of apparatus 20 and as shown in FIGS. 7A–H and 7N–O, the base securing mechanism 30*a* consists of a clamp mechanism 110. The clamp mechanism 110 includes an actuator such as clamp screw 110*a*, a base support such as threaded engagement portion 76*d*, and a work surface engaging portion such as pad 110*b*. The clamp screw 110*a* includes a threaded shaft 110*c* having a bulbous handle 110*d* at one end, and an open bore 110*e* at the other end. The handle 110*d* is contoured with a plurality of recesses 110*f* to provide a gripping surface for a user to operate securing mechanism 30*a*. The clamp mechanism 110 has an inner collar recessed within bore 110*e* which defines a further inner opening within the bore 110*e*.

The work surface engaging pad 110*b* is inserted into bore 110*e*, and is secured thereto via a cam-and-socket type engagement. More particularly, the pad 110*b* includes a disk-shaped support member 110*g* having a base 110*h* and shaft 110*i* extending downward therefrom. The support member 110*g* makes physical contact with the work surface and is therefore preferably made of a non-marking material such as rubber. Located on the end of shaft 110*i* opposite base 110*h* is post 110*j* and anchor (or cam) member 110*k*, which are used to mate with the inner collar and opening of bore 110*e* in a cam-and-socket type engagement. The post 110*j* is of a smaller diameter than shaft 110*g* and anchor member 110*k* is of a slightly larger diameter than the inner opening of the collar within bore 110*e*. In a preferred embodiment, the anchor member 110*k* has a traditional angled cam surface with a shoulder, and may be pressed through the inner collar opening of bore 110*e* via the angled cam surface such that the shoulder prevents the anchor 110*k* from being easily removed back out of the collar. With this configuration, the pad 110*b* is inserted into bore 110*e* such that the anchor member 110*k* is pressed through the inner collar thereof, which results in the anchoring or securing of pad 110*b* to the clamp screw 110*a*. The post 110*j* rests within the collar of bore 110*e* and the remainder of the shaft 110*i* rests in bore 382. In a preferred embodiment, the base 110*h* is of a diameter slightly larger than the diameter of bore 110*e* to prevent it from passing therethrough, and will support the pad 110*g* as desired. In order to prevent unnecessary wear between the base 110*h* and threaded shaft 110*c*, a metal washer may be inserted over the shaft 110*i*, between the base 110*h* and threaded shaft 110*c*, to provide a protective bearing surface between components of the clamp mechanism 110*a*.

Figure 7N:
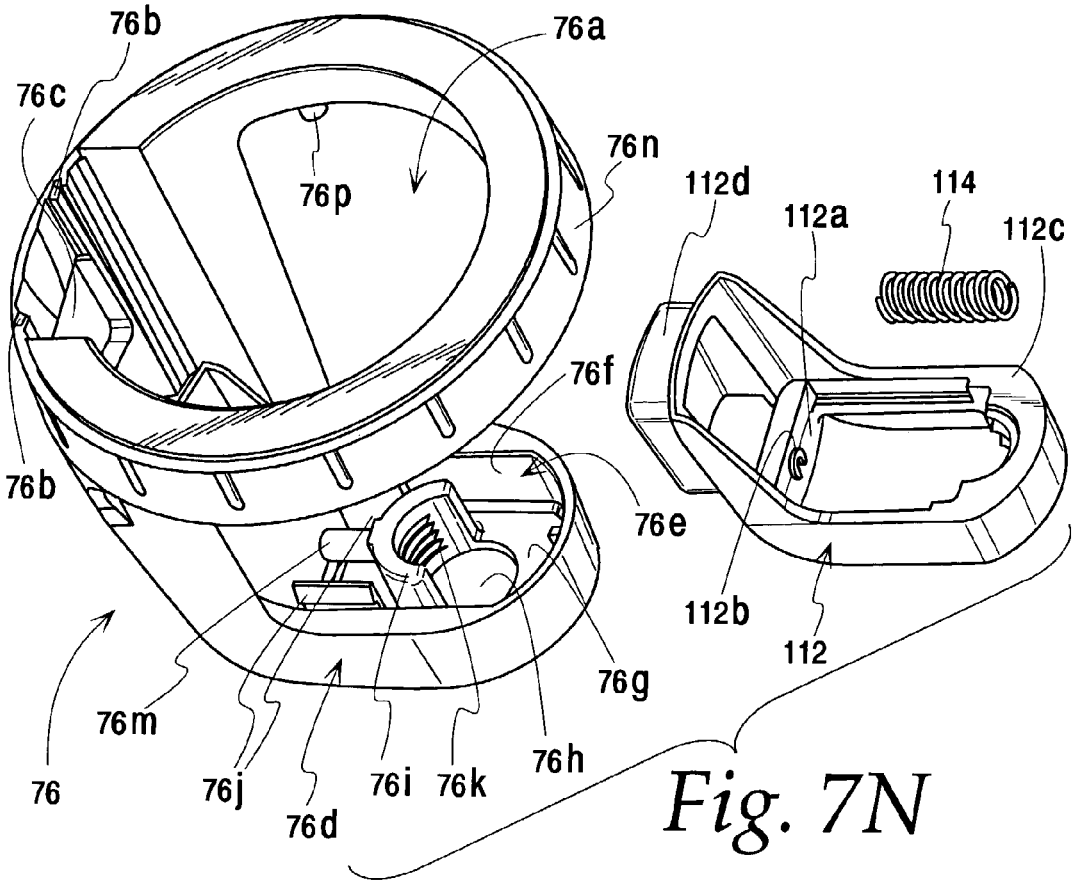
FIGS. 7N–O are perspective views of a portion of the base securing mechanism of FIG. 7H.
Figure 7O:
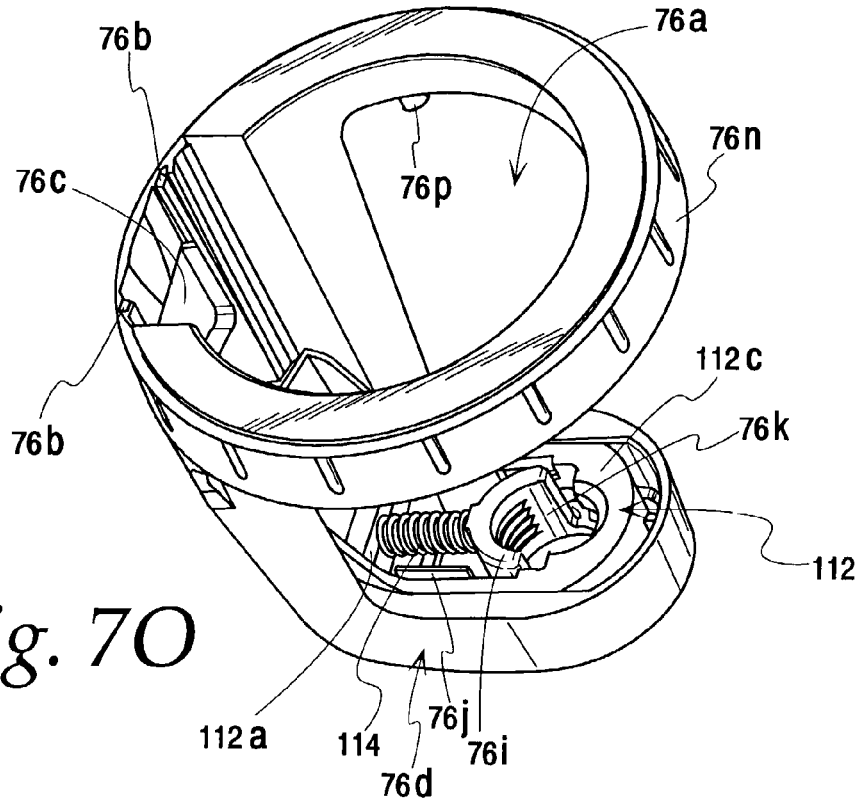
Figure 8:
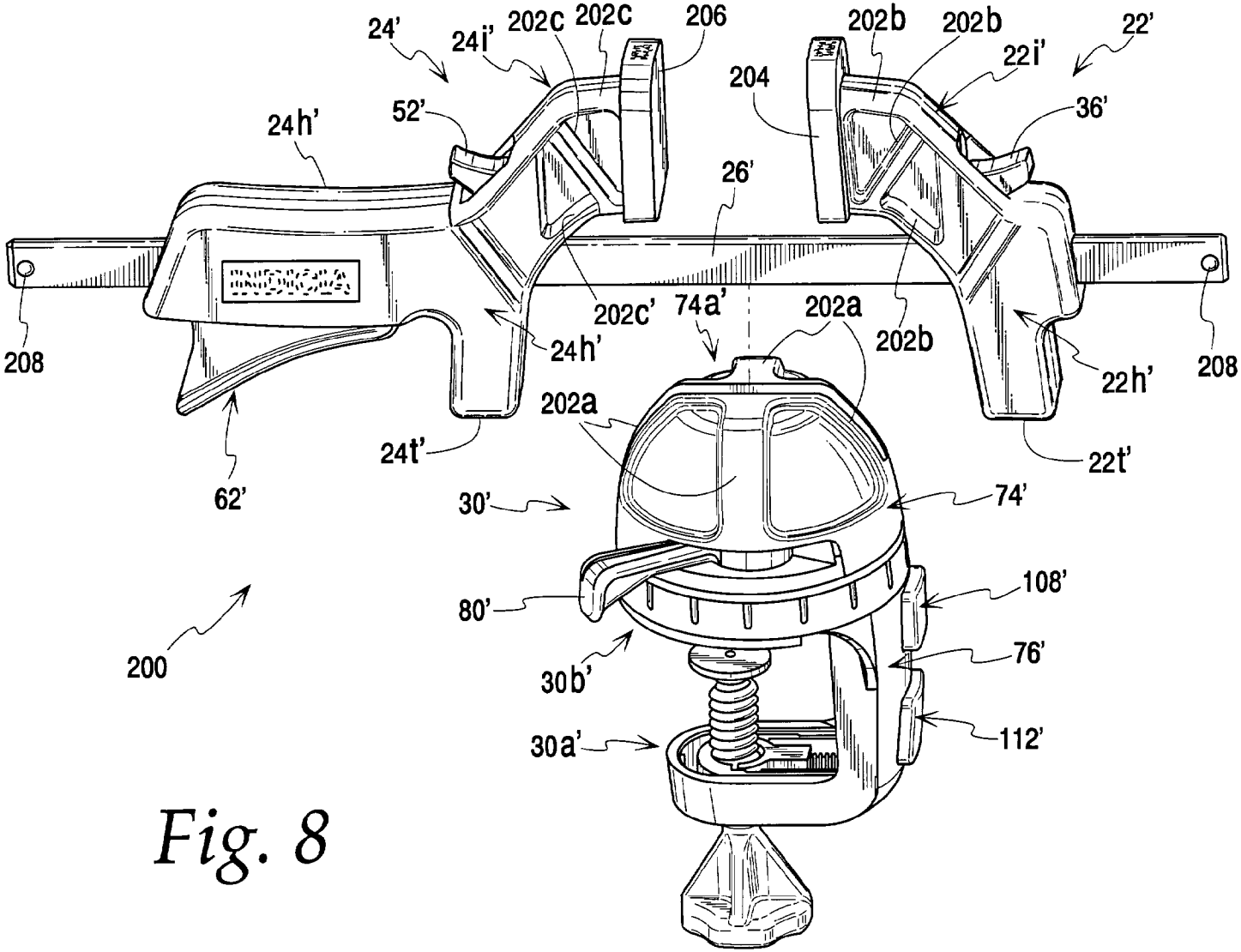
FIG. 8 is a perspective view of an alternate apparatus for securing a workpiece in accordance with the invention showing a removable bar clamp assembly exploded from a movable base.
Figure 9A:
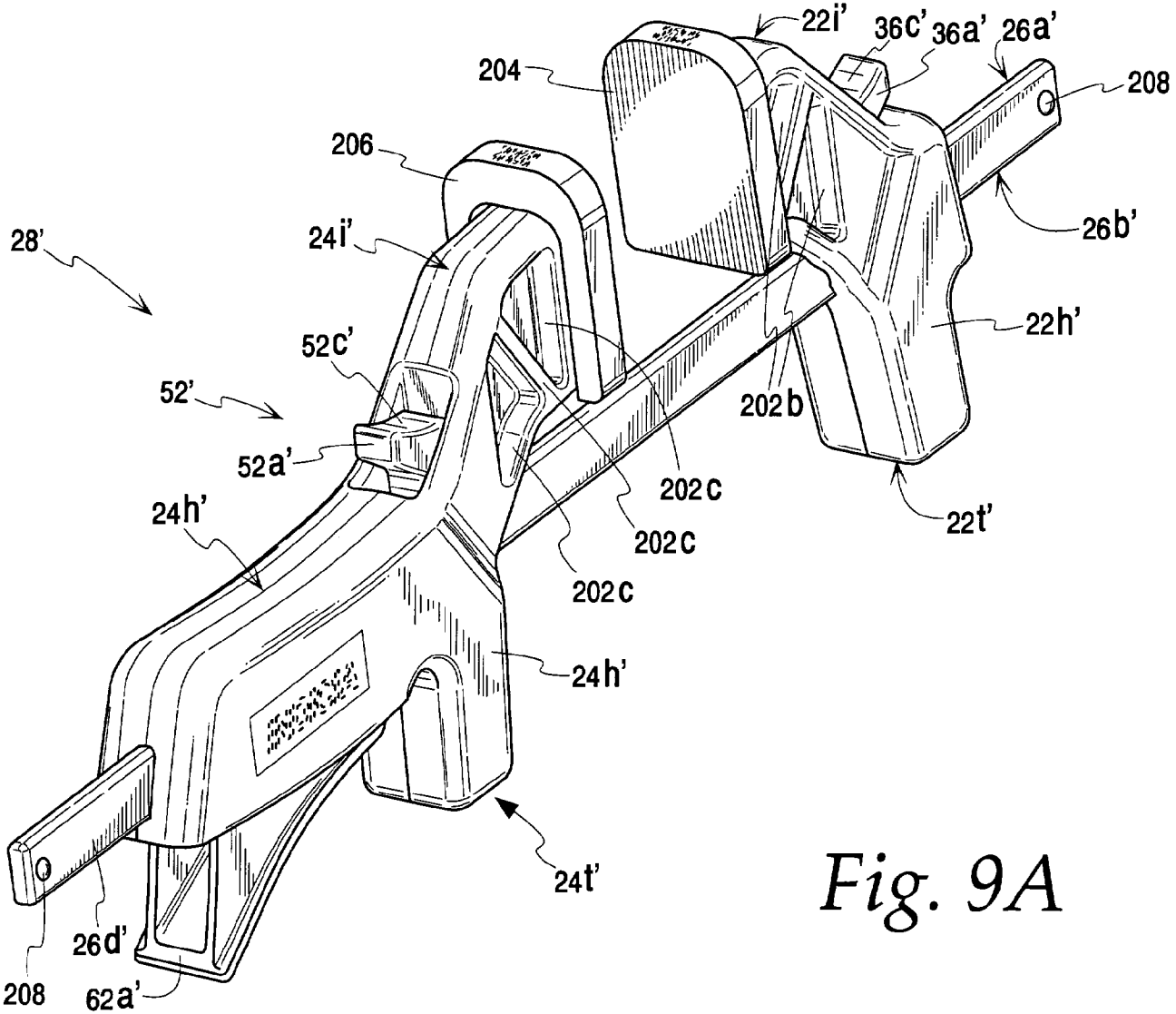
FIG. 9A is a perspective view of the bar clamp assembly of FIG. 8 wherein the clamp structures are positioned about an elongate bar member for applying a clamping force.
Figure 9B:
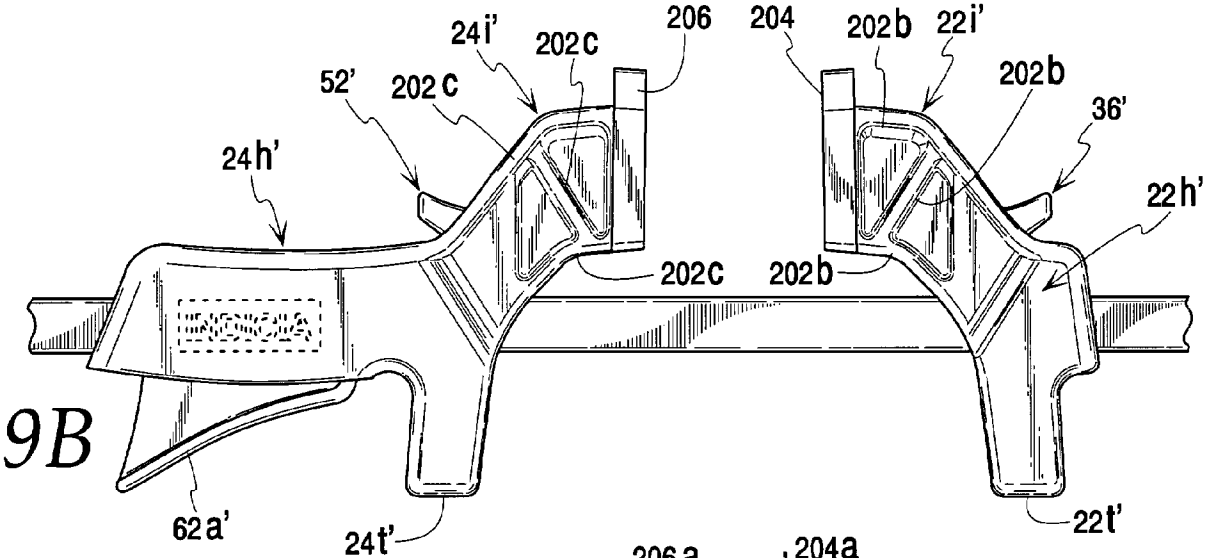
FIGS. 9B–C are a partial side elevational view and a partial cross-sectional view, respectively, of the bar clamp assembly of FIG. 8.
Figure 9C:
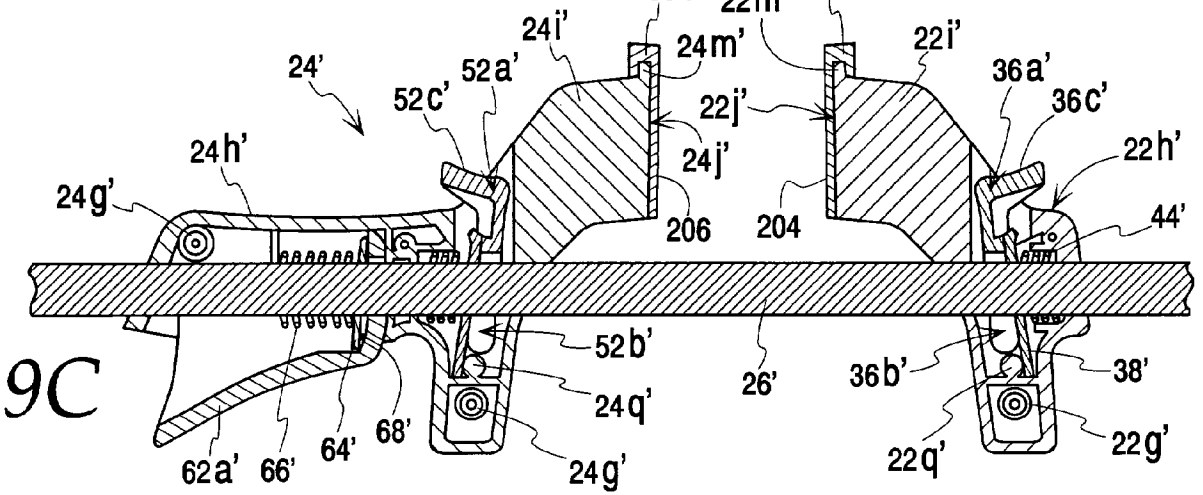
Figure 9D:
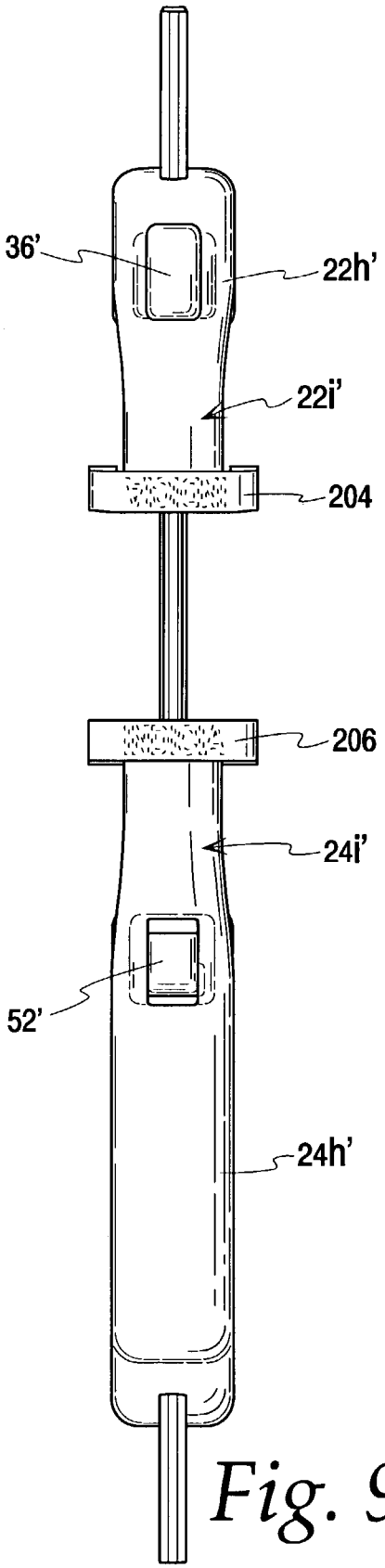
FIGS. 9D–E are partial top and bottom views, respectively, of the bar clamp assembly of FIG. 8.
Figure 9E:
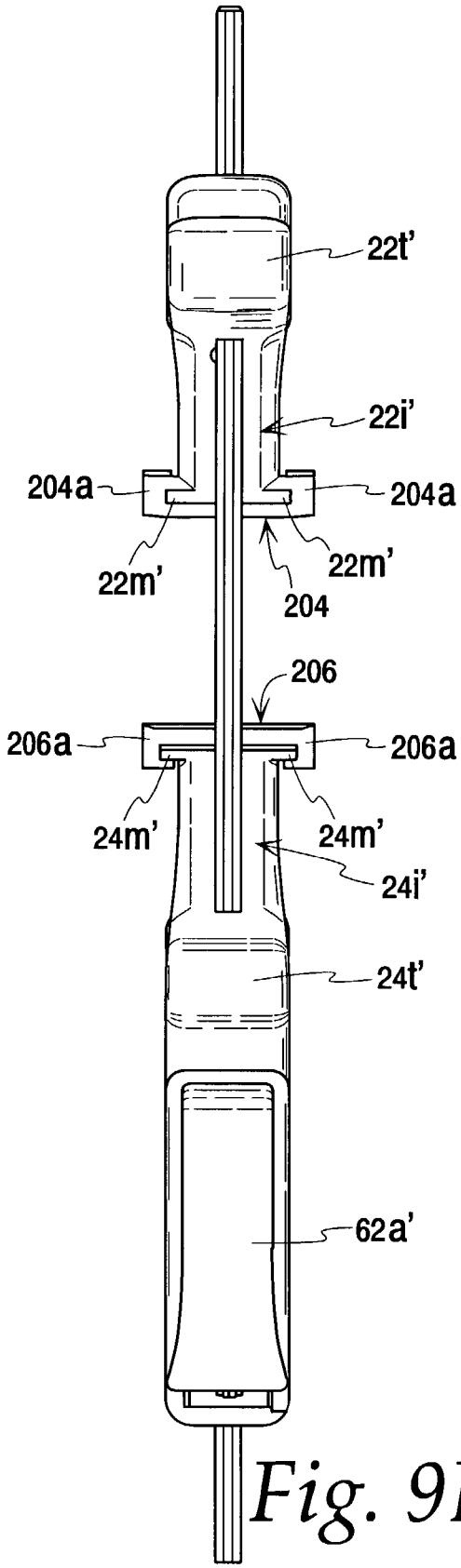
Figure 11:
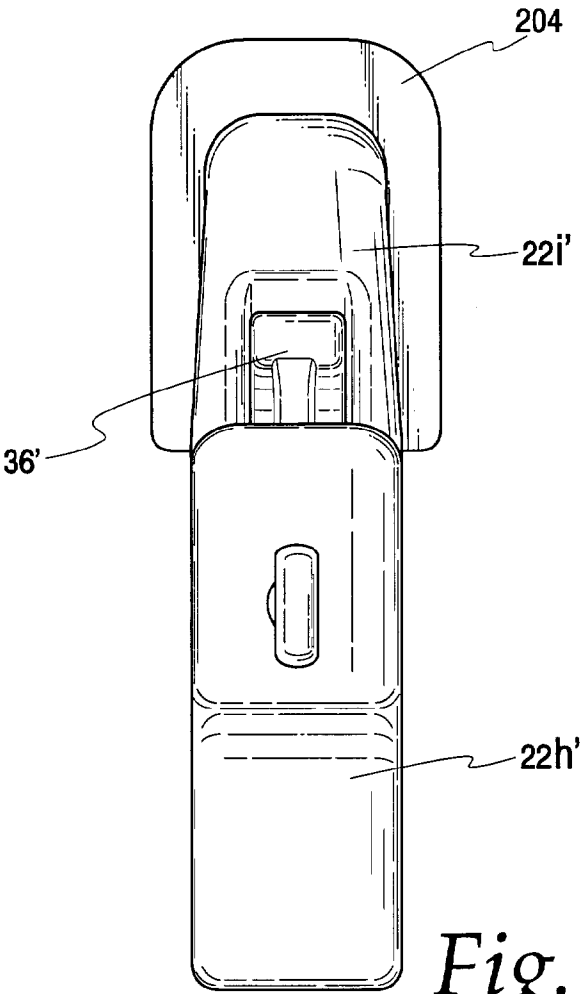
FIG. 11 is a rear elevational view of the stationary clamp of FIG. 8.
Figure 10:
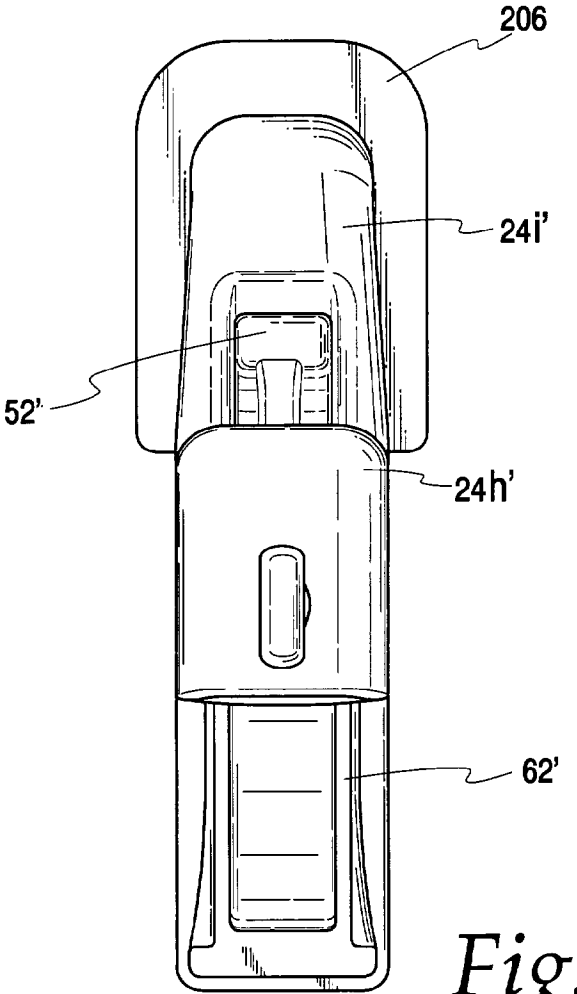
FIG. 10 is a rear elevational view of the movable clamp of FIG. 8.
Figure 12A:
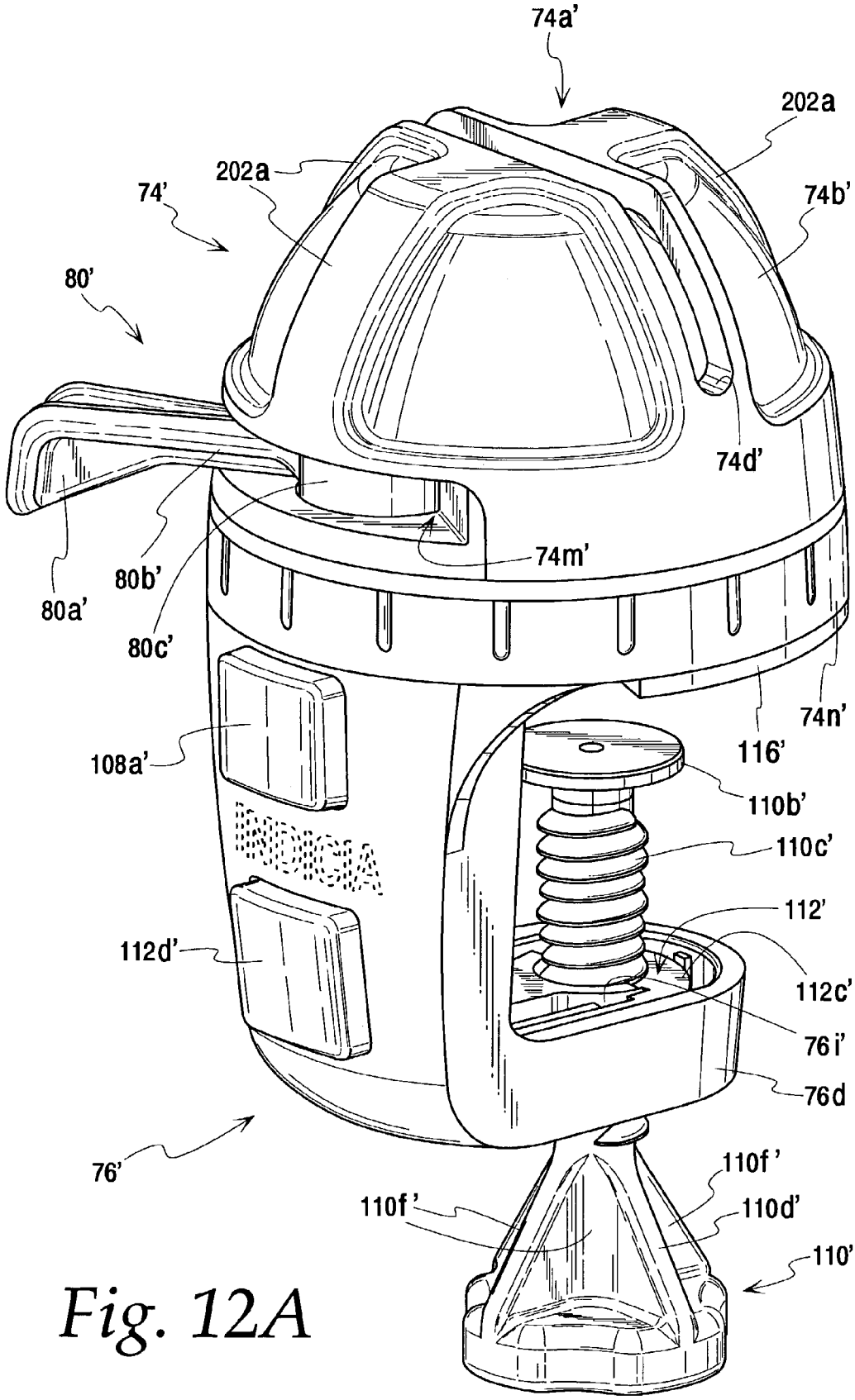
FIG. 12A is a perspective view of the movable base of FIG. 8.
Figure 12C:
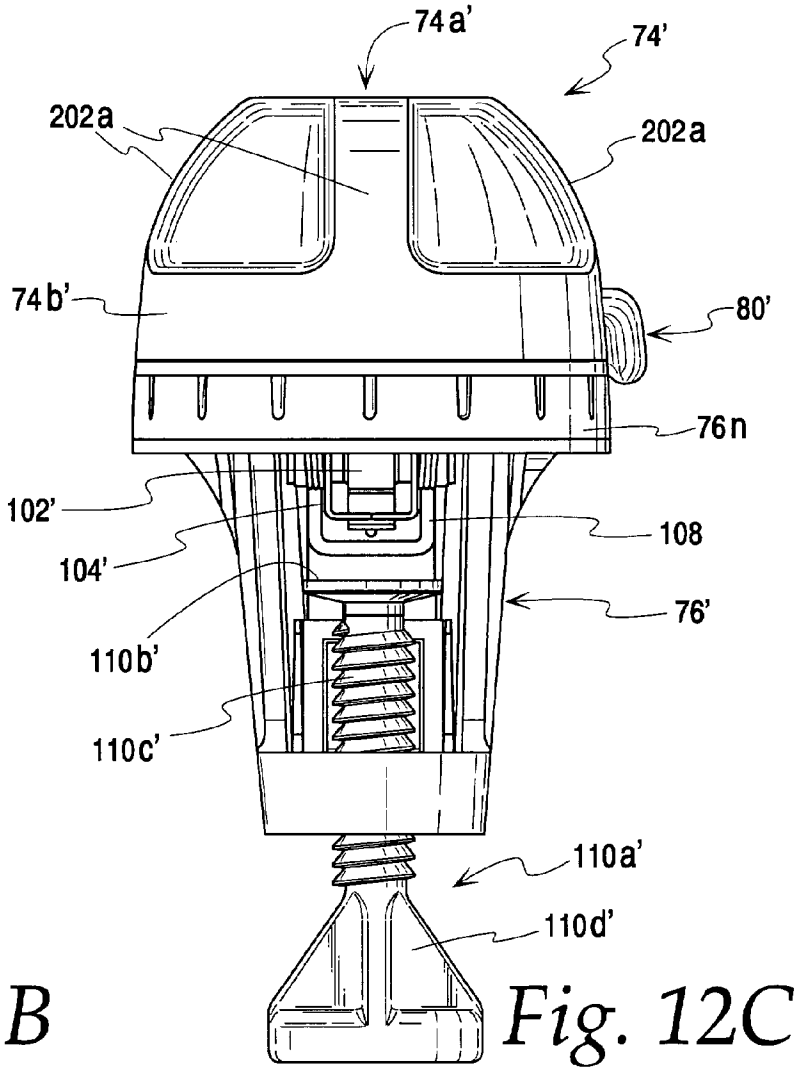
FIGS. 12B–C are front and rear elevational views, respectively, of the movable base of FIG. 8.
Figure 12B:
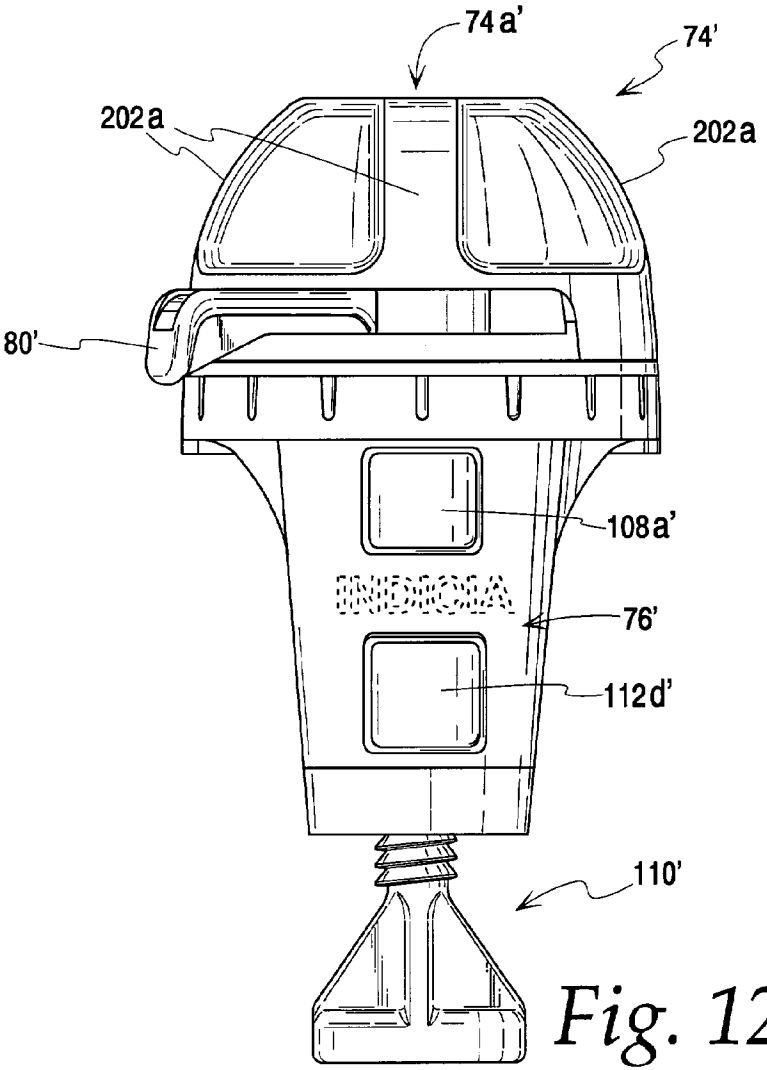
Figure 12E:
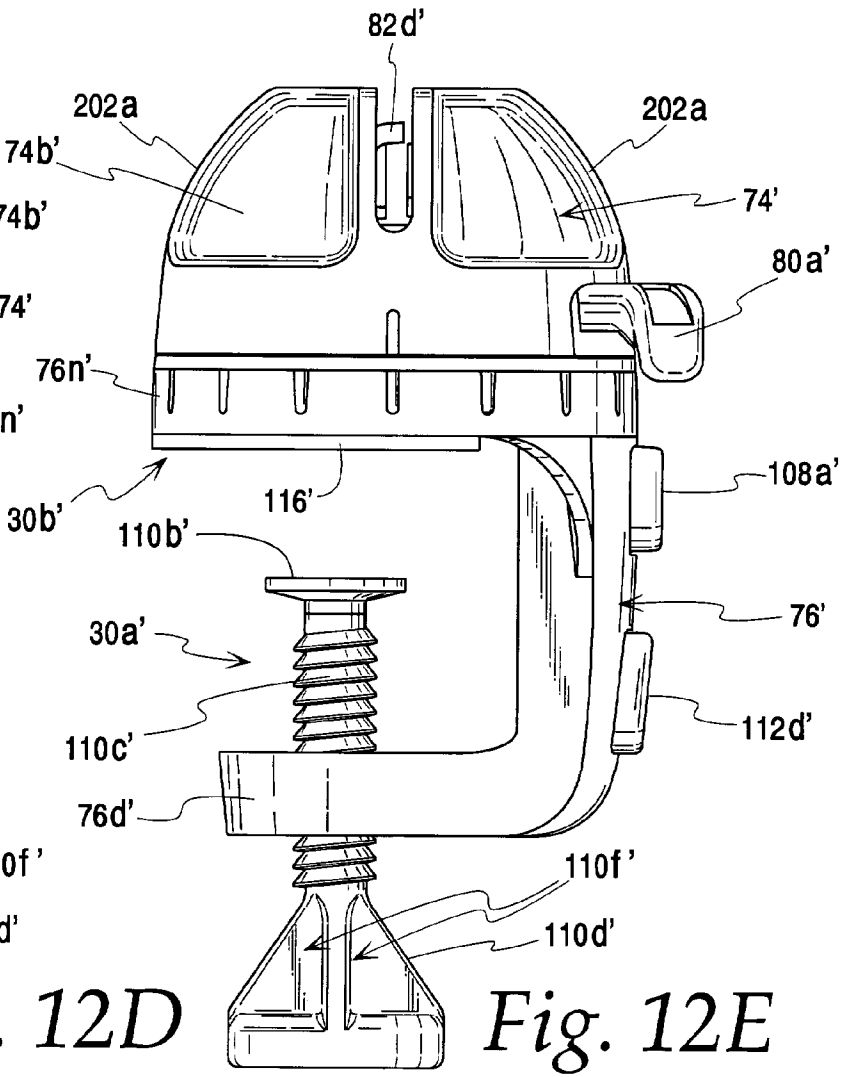
FIGS. 12D–E are left and right side elevational views, respectively, of the movable base of FIG. 8.
Figure 12D:
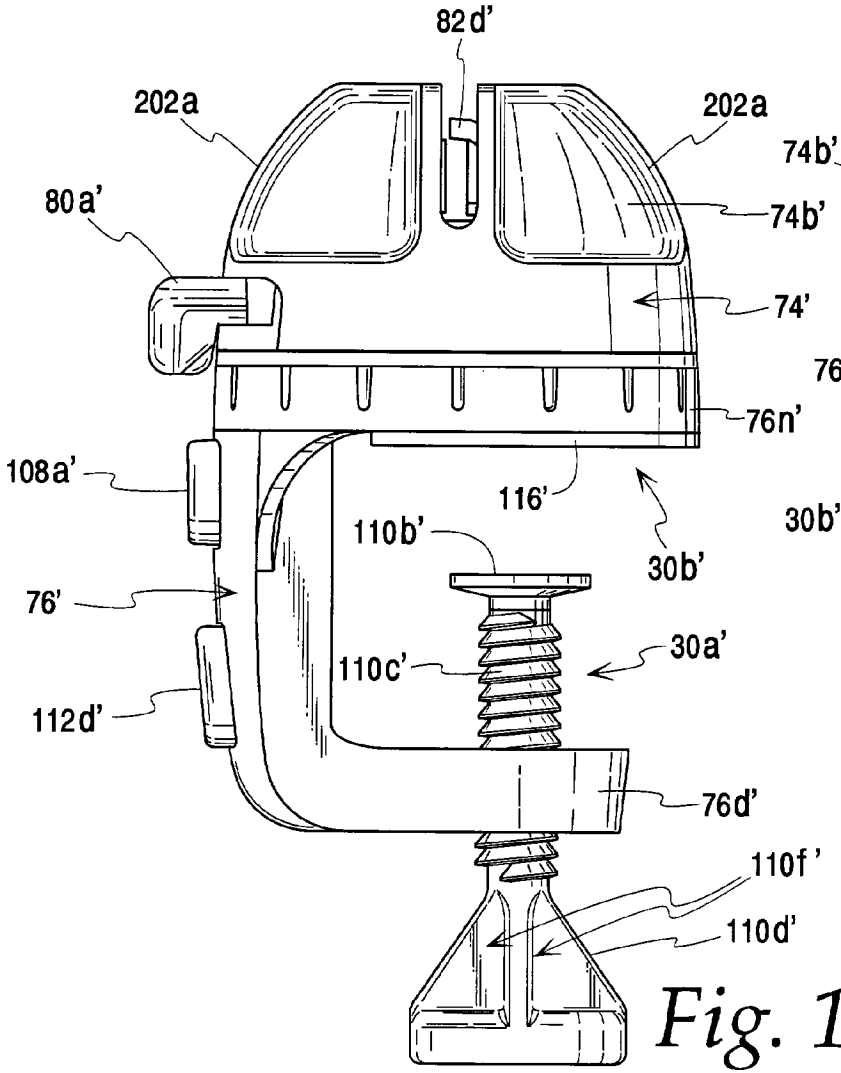
Figure 12F:
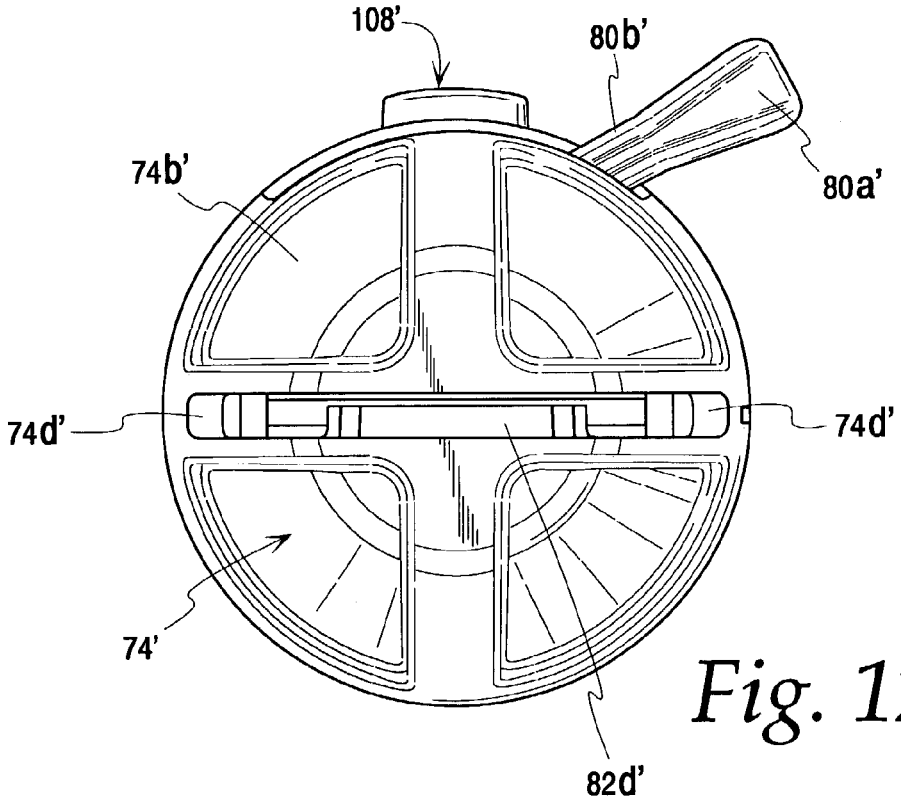
FIGS. 12F–G are top and bottom views, respectively, of the movable base of FIG. 8.
Figure 12G:
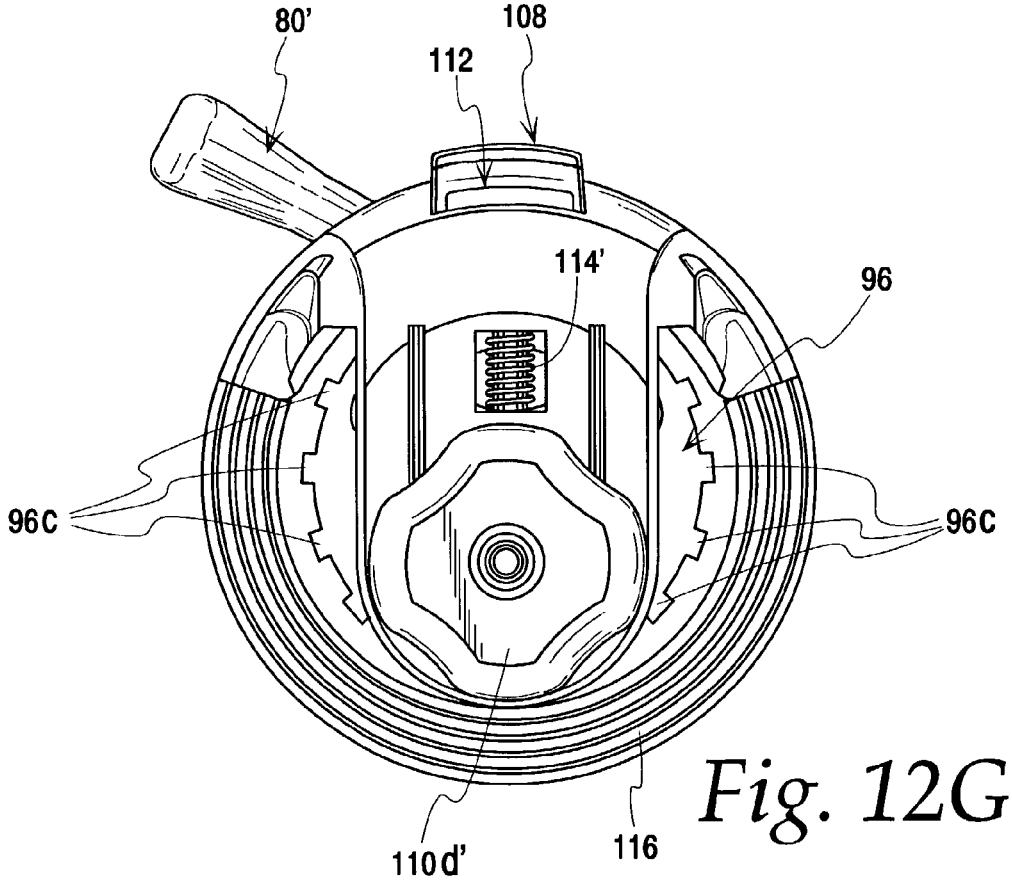
Figure 12H:
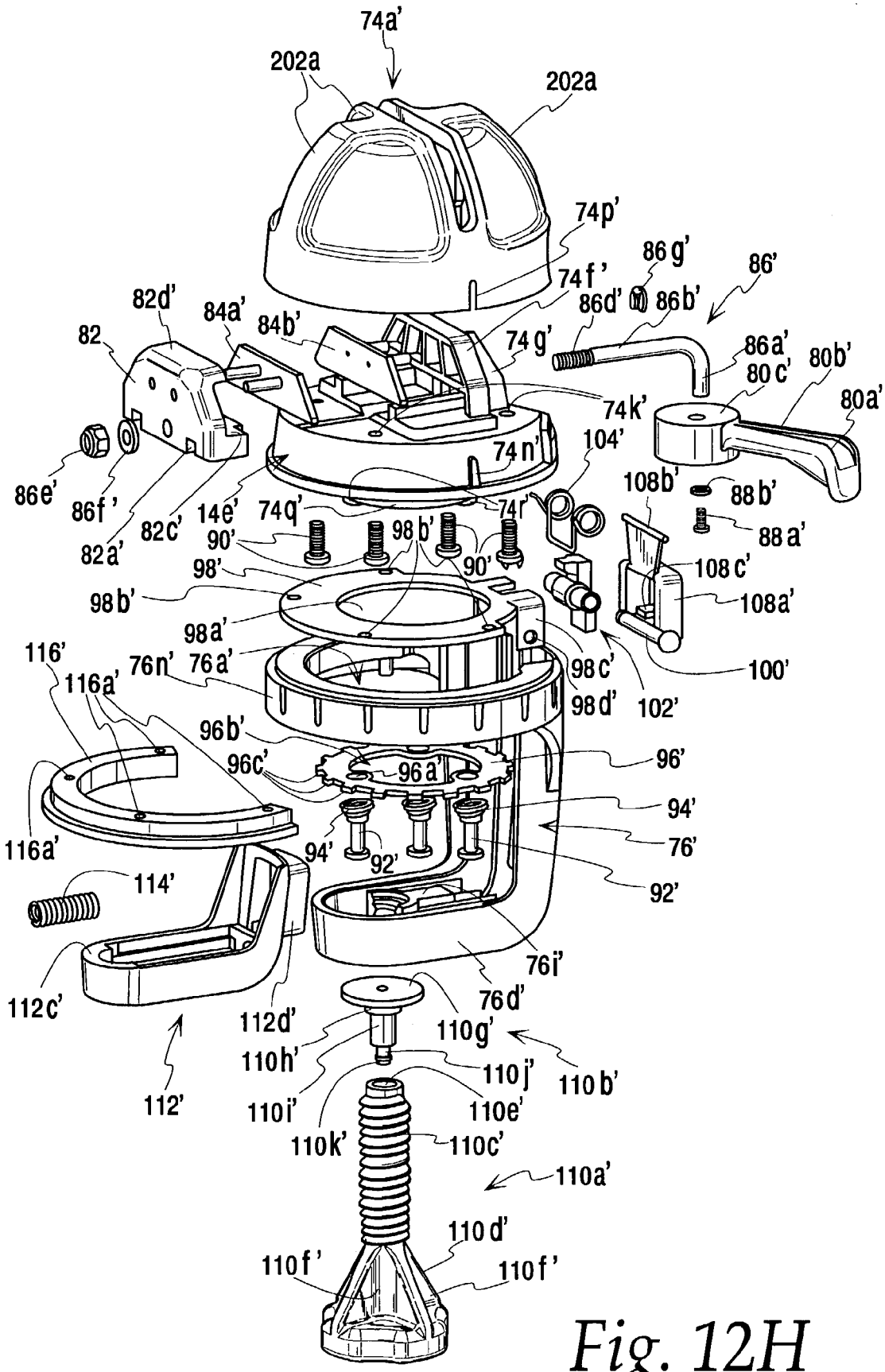
FIG. 12H is an exploded view of the movable base of FIG. 8.

In a preferred form of apparatus 20, and as shown in FIGS. 7H and 7N–O, the base support 76*d* consists of a lower base extension having a recessed inner region 76*e*. The recessed region 76*e* has side walls 76*f* and a lower floor 76*g* which defines an opening 76*h* through which at least a portion of the clamp mechanism 110 may pass. More particularly, the base extension 76*d* is a generally L-shaped member extending downward below the rotational release mechanism 30*b*, and has a semi-annular wall 76*i* extending upward from the floor 76*g* of recessed region 76*e* adjacent opening 76*h*. The semi-annular wall 76*i* further includes threading 76*k* along the inner surface of the wall 76*i*, thereby forming a half-nut member positioned to engage the threading 110*c* of clamp screw 110*a* once it is inserted through opening 76*h*.

Also extending upward from the floor 76*g* are nesting clips 76*j* which are used to secure a release mechanism 112 for base securing mechanism 30*a*. In a preferred embodiment, release mechanism 112 includes a manually operable push button which is capable of rapidly releasing the base securing mechanism 30*a* so that the base 30 and/or apparatus 20 can be repositioned or moved rapidly.

Extending outward from the wall 76*i* is a spring alignment mechanism or guide, such as post 76*m*, which is used to position a spring 114 between the semi-annular wall 76*i* and a back stop 112*a* located on the release mechanism 112. The spring guide or post 76*m* is generally cylindrical in shape and extends out from the non-threaded side of wall 76*i*, generally parallel to the floor 76*g* of recessed region 76*e*. The post 76*m* is of a smaller diameter than spring 114 so that an end of the spring 114 may be fitted over the post 76*m* like a sleeve to maintain the spring's alignment. In a preferred form of apparatus 20, the back stop 112*a* also includes a guide 112*b* which consists of a raised surface or projection about which the other end of spring 114 is fitted like a sleeve.

The release mechanism 112, as illustrated in FIGS. 7N–O, further includes a threaded half-nut portion 112*c* and a user input, such as pushbutton 112*d*. Like semi-annular wall 76*i*, the threaded half-nut portion 112*c* of release mechanism 112 includes a semi-annular wall having threading for engaging the threaded portion 110*c* of clamp screw 110*a* once it is inserted through opening 76*h*. Thus, when the release mechanism is nested in recessed region 76*e*, annular-wall 76*i* and half nut 112*c* cooperate to form a threaded opening through which screw mechanism 110 is fed. In addition, shoulder surfaces 112*e* are located on the inner walls of the release mechanism 112 which are engaged by the lip portions of nesting clips 76*j* in order to secure the release mechanism 112 to the lower base portion 76.

FIG. 7O is a partially assembled view of the lower base portion 76 in which the release mechanism 112 is nested in the recess 76*e* via clips 76*j*. The spring 114 is placed over the spring guide 434 and against the back stop 438. As mentioned above, the back stop will preferably have a guide 440 in order to center the spring 436 thereon. The spring 114, once installed, is compressed between the guide members 76*m* and 112*b* in order to apply a force against the backstop 112*a*. This force, causes the threaded half-nut portion 112 to be pulled towards the semi-annular wall 76*i* of base extension 76*d*, which effectively biases these portions to operate as a threaded annular ring or nut through which the clamp mechanism 110 is fed.

In order to tighten the base 30 to a work surface, the base 30 is positioned so that at least a portion of the work surface is placed between the upper rim 76*n* of lower base portion 76 (which defines opening 76*a*), and pad 110*b*. In a preferred embodiment, a rubber foot member 116 (FIG. 7H) is positioned on the lower side of rim 76*n* in order to grip the work surface to which the apparatus 20 is clamped. The foot member 116 is arcuate in shape and preferably consists of a single arched rubber strip having a plurality of alignment openings 116*a* into which mating alignment posts 76*p* extending downward from the lower surface of rim 76*n* are disposed. In one form, the alignment posts 76*p* and openings 116*a* engage one another via a frictional fit in order to prevent the foot member 116 from unintentional removal when the base 30 is removed from a work surface. In alternate embodiments, however, the foot member 116 may be secured to the lower base portion 76 via fasteners such as screws or adhesives.

The one piece construction of rubber foot 116 improves apparatus stability and ease of assembly over alternate embodiments in which multiple feet may be provided. For example, by having one long foot rather than a plurality of smaller feet, the foot 116 offers a larger surface area with which to engage and grip a work surface, thereby improving the base's grip on the work surface. The enlarged surface area also helps to ensure that the foot 116, or at least a portion thereof, will be able to engage the work surface. For example, if the work surface is relatively small and the base used a plurality of feet, there is a chance the work surface might pass between the plurality of feet and not make sufficient contact with the foot 116. To further improve the stability of the base 30, the clamping mechanism 110 is preferably centered with respect to opening 76*a* defined by rim 76*n* of lower base portion 76. This ensures that the clamping or securing force applied to the work surface by the base 30 will generally be in the center of the base rather than off to one side of the base so that the force with which the base 30 is attached to the work surface is improved. For example, an offset base may provide a stronger resistance to movement of the base and/or bar clamp on the side the clamp is offset towards, but may also make unwanted movement on the side opposite the offset easier to occur.

In order to secure the base 30 to the workpiece, the clamp mechanism 110 is threaded through the threaded opening defined by opening 76*h* and half-nut members 76*i* and 112*c* until the work surface is securely held between the foot member 116 and pad 110*b*. Should the user accidentally tighten the clamp mechanism 110 too tight, the spring actuated release mechanism 112 will release a sufficient amount in order to prevent the threaded portion 110*c* of screw 110*a* from being stripped by the threaded nut portions 76*i* and 112*c*.

In order to release the base 30 from a work surface, the operator may reverse the clamp member 110 or back the screw 110*a* out of the lower base extension 76*d* until a sufficient amount of space is created between foot member 116 and pad 110*b* so that the base 30 may be moved with respect to the work surface. Alternatively, if the apparatus user wishes to rapidly release the securing mechanism 30*a*, he or she may simply actuate the release mechanism 112 via input 112*d* thereby disengaging the clamp screw 110*a* from the annular ring defined by 76*i* and 112*c* and releasing the work surface.

Once the base 30 has been secured, the elongate member 26 can be attached to the base 30 by checking to make sure the actuating lever 80 is in the bar release position and sliding the member 26 into the receiving slot 74*d*. Once the elongate member 26 is fully inserted therein, the actuating lever 80 can be moved to the bar securing position thereby causing the securing mechanism 74*a* to secure member 26 to base 30. The orientation of the upper base portion 74 (and elongate member 26 if attached thereto) can be adjusted by actuating the rotational release mechanism 30*b* via input 108 and rotating the upper base portion 74 about the lower base portion 76 until the member 26 is in the desired orientation or position.

Thus, with this configuration, the apparatus 20 may be used in a variety of ways, including: a vise; work station; bar clamp; spreader; and free standing bar clamp/spreader. For example, the base 30 may be secured to a work surface and the bar clamp assembly 28 may be secured to the base 30 so that the apparatus may be used as a vise. Preferably, in the vise configuration, the stationary clamp 22 will be positioned adjacent the base or flush thereto and the movable clamp 24 will be used to engage and secure the workpiece between the clamp member 22 and 24. With the low profile of the base 30, the flat bottom surfaces 22*t* and 24*t* of clamps 22 and 24 may be used to support the clamp members on the work surface. Thus, no additional members, such as a foot or pedestal, are required in order to allow the clamps 22 and 24 to be supported by the work surface. A second apparatus 20 may be added and used in a vise type configuration so that both apparatus can be used collectively as a work station to secure various types of workpieces. Alternatively, the clamps 22 and 24 may be used as a bar clamp or spreader by arranging the clamps 22 and 24 on the bar 26 in either a clamping fashion (e.g., with the jaws 22*j* and 24*j* of the clamps 22 and 24 facing each other) or a spreading fashion (e.g., with jaws 22*j* and 24*j* facing in opposite directions). The bar clamp and spreader may be used apart from the work surface, or may be rested on the flat surfaces 22*t* and 24*t* of clamps 22 and 24 to be used as a freestanding bar clamp or spreader.

Turning now to FIGS. 8–12H, there is illustrated an alternate embodiment of apparatus 20 embodying features in accordance with the present invention. In this embodiment, a trade version of the apparatus for securing a workpiece 20 is illustrated. For convenience, features of the alternate embodiments illustrated in FIGS. 8–12H that correspond to features already discussed with respect to the embodiment of FIGS. 1–7O are identified using the same reference numeral in combination with an apostrophe (') merely to distinguish one embodiment from the other, but otherwise such features are similar.

The trade version of apparatus 20, hereinafter apparatus 200, includes clamp members 22' and 24', and a transportable elongate member 26' to which the clamp members 22' and 24' are adjustably mounted for being shifted between clamped and unclamped positions to secure a workpiece. As shown, clamp member 22' remains stationary on member 26' during a workpiece clamping operation while the other clamp member 24' is advanced therealong by a trigger mechanism 62' thereof to form a bar clamp portion 28' of the preferred apparatus 200 herein. The apparatus 200 further includes a base 30' having an upper portion 74' for connecting the elongate member 26' to the base 30', and a lower portion 76' with a base securing mechanism 30*a*', such as a clamp mechanism, for mounting the base to a support surface such as a bench or table top. Preferably, the base 30 incorporates a rotational release mechanism 30*b* that allows a user to select a plurality of predetermined rotary positions at which the upper base portion 74 can be fixed to the lower base portion 76. Except as described below, the clamp members 22' and 24' and base 30' of trade apparatus 200 operate similar to the apparatus 20 discussed above, (e.g., the internal clamp mechanisms 26*a'*–*w'* and 24*a'*–*w'* and base mechanism 30*a'*–*b'*, 74*a'*–*r'* and 76*a'*–*p'* operate the same as their respective components 26*a*–*w*, 24*a*–*w*, 30*a*–*b*, 74*a*–*r* and 76*a*–*p*, etc.).

Unlike the embodiment discussed above with respect to FIGS. 1–7O, however, the clamp members 22' and 24' and base 30' of apparatus 200 have reinforced structures in order to ensure that the apparatus 200 will withstand the rigors of daily use by tradesmen. For example, the dome 74*b'* and jaw support structures 22*i'* and 24*i'* include reinforced rib structures 202*a*–*c*, respectively, which provide additional structural support and assist the apparatus 200 in heavy duty applications. The rib members 200*a*–*c* provide a strengthened exoskeleton for the base 30', first clamp 22' and second clamp 24', which allows these components to support heavier workpieces and withstand and/or exert additional force against the workpieces in either a clamping or spreading manner.

In a preferred embodiment, the jaw support structures 22*i'* and 24*i'* and associated jaw plates 22*j'* and 24*j'* and jaw pads are smaller and/or narrowed to center and increase the force with which the clamp members may be exerted against a workpiece. More particularly, by reducing the size of the clamp heads (or jaws), the force of each clamp member will be exerted on a smaller area of the workpiece. Since the clamp braking mechanism and actuator 62' are similar (if not identical) to the braking mechanism and actuator 62 of apparatus 20, the force exerted by the trade version 200 will be more centered and greater over a smaller area of the workpiece. In addition, the jaw supports 22*i'* and 24*i'* are solid, rather than hollow, in order to strengthen the clamp members 22 and 24. The strengthened clamp members allow the jaw plates 22*j'* and 24*j'* to withstand greater forces so that the bar clamp assembly 28' may be used in industrial or heavy duty applications.

The first clamp member 22' and second clamp member 24' include jaw pads 204 and 206, which differ from pads 34 and 50 discussed above in that the illustrated pads 204 and 206 do not lock onto the jaw plates 22*j'* and 24*j'*. Rather, jaw pads 204 and 206 contain bent over or u-shaped peripheral rim portions 204*a* and 206*a*, respectively, which form channels at the rear of the pads 204 and 206 for receiving the outer lips 22*m'* and 24*m'* of jaws 22*j'* and 24*j'*, respectively. The jaw pads 204 and 206 may be secured onto the jaws 22*j'* and 24*j'* by sliding the pads 204 and 206 over the jaws 22*j'* and 24*j'*, respectively, so that the lip portions 22*m'* and 24*m'* are positioned within the channels defined by rims 204*a* and 206*a*. Conversely, the jaw pads 204 and 206 may be removed by pulling the pads 204 and 206 off of the jaws 22*j'* and 24*j'*, thereby sliding the pads 204 and 206 off of the jaws 22*j'* and 24*j'* until the outer lip portions 22*m'* and 24*m'* are fully removed from the channels 204*a* and 206*a* of pads 204 and 206. Preferably, the channels 204*a* and 206*a* and lip portions 22*m'* and 24*m'* are sized so that a friction fit is created between the jaw pads 204 and 206 and the lip portions 22*m'* and 24*m'*. Thus, the pads 204 and 206 will be retained on the jaws 22*j'* and 24*j'*, respectively, against unintentional removal, until the operator removes them off of the jaw pads 22*j'* and 24*j'*. The jaw pads 204 and 206 are not locked onto the jaws 22*j'* and 24*j'* as in the apparatus in FIGS. 1–7O so that tradesmen may quickly and easily remove pads 204 and 206 from the clamp members 22' and 24' and replace them with alternate pads if desired. This is particularly helpful given that tradesmen often use the clamp assemblies 22' and 24' for a variety of different applications which may require the swapping on and off of different pads, (e.g., when using bar clamp assembly 28' to grip round objects such as pipe, pads with curved surfaces may be used; when using assembly 28' to grip workpieces with sharp edges or corners, pads with sharp indentations may be used; etc.). In a preferred embodiment, the jaw pads 204 and 206 will have indicia containing trademark or brand labeling located on a surface of the pad, such as on the top of pads 204 and 206 as illustrated in FIGS. 8–11. Similar labeling or indicia may appear on the body of the clamps 22' and 24' and the base 30'.

Internally, the clamp members 22' and 24' will operate similar to clamp members 22 and 24, however, in a preferred embodiment, movable clamp member 24' will not contain the various structures needed to keep the internal clamp mechanisms aligned once the movable clamp 24' is removed from elongate member 26', (e.g., alignment rib 24*r*, spring alignment rib 24*s* and 24*u*, stud 24*w*, trigger guide recess 62*c*, etc.). Thus, the movable clamp 24' of trade apparatus 200 will preferably not be fully removable from elongate member 26'. More particularly, elongate member 26' will have a stop 208 (FIGS. 8 and 9A) at either end thereof (or on both ends as illustrated) that cooperates with clamp member 24' so that it cannot be slid off the end of the bar 26' at which the stop is disposed. As shown, clamp member 24' abuts the stop members 208 when shifted to the ends of the bar 26', and clamp member 22' is provided with notched openings throughout housing portions 22*c'–d'*, brake release mechanism 36' and brake plate 38' sufficient in clearance with respect to the stop members 208 to allow clamp 22' to be removed from the ends of the bar 26'. This allows the clamp member 22' to be reoriented on the bar 26' relative to the clamp member 24' so that clamp jaws 22*j'* and 24*j'* may be faced toward one another or away from one another in order to support clamp and spreader configurations, respectively. It should be noted, however, that in alternate embodiments, the apparatus 200 may be designed with the necessary alignment structures (as discussed above with respect to apparatus 20) so that clamp members 22' and 24' may be fully removed from the elongate member 26' if desired.

With respect to base 30' of trade apparatus 200, the bar capturing mechanism 74*a'*, base securing mechanism 30*a'* and rotational release mechanism 30*b'* work in similar fashion to their corresponding components discussed above with respect to FIGS. 1–7O. As mentioned above, however, the base 30' includes reinforced structures such as rib structures 202*a* which provide additional structural support to the dome portion 74*b'* of base 30'. The rib members 200*a* allow the base to support heavier workpieces on the generally flat upper surface or top portion of the dome 74*b'*.

In addition to the additional structural rib members 200*a*, the actuator 80' and clamp mechanism 110' of apparatus 200 have slightly different configurations which allow the operator to grip these components more easily and apply more pressure thereto when operating the same. More particularly, the actuator 80' includes a wedge shaped handle portion 80*a'* having more squared off edges which the operator can use to grip and move the actuator 80 between the bar securing and bar releasing positions. The clamp mechanism 110' includes a handle portion 110*d'* having deep recesses 110*f'* which the operator can use to grip the handle more firmly and rotate the clamp mechanism 110' between the base securing and releasing positions. In the embodiment illustrated, the recesses 110*f'* are so deep that the remainder of the handle portion 110*d'* forms gusset members which support the bottom surface of the handle 110*d'*.

Turning now to FIGS. 13A–D, there is illustrated an alternate clamp assembly of apparatus 28 embodying features in accordance with the present invention. In this embodiment, a version of the bar clamp assembly 28 is illustrated having a bar clamp assembly with selectively positionable jaw members, hereinafter apparatus 250. Thus, allowing the clamp assembly 250 and apparatus 20 to be used to secure workpieces of varying size and in a variety of positions. For example, the apparatus 250 may be used to secure a workpiece extending up from the floor of a workshop along the side of the work holding apparatus 20 when attached to a work surface such as a bench top.

The bar clamp assembly apparatus 250 includes clamp members 252 and 254, and a transportable elongate member 256 to which the clamp members 252 and 254 are adjustably mounted for being shifted between clamped and unclamped positions to secure a workpiece. As shown in FIGS. 13A–D, clamp member 252 remains stationary on elongate member 256 during a workpiece clamping operation while the other clamp member 254 is advanced therealong by a trigger mechanism 262 thereof to form the bar clamp assembly 250. Both clamp members 252 and 254 may be freely moved about the elongate member 256 by actuating the brake release mechanisms 258 and 260, respectively, located thereon. Except as described below, the clamp members 252 and 254 of apparatus 250 operate similar to their corresponding parts with respect to apparatuses 20 and 200 discussed above, (e.g., the internal clamp mechanisms of clamps 252 and 254 operate the same as their respective components 26*a–w*, 24*a–w*, 30*a–b*, 74*a–r* and 76*a–p*, etc.).

Unlike the embodiments discussed above, however, the clamp members 252 and 254 of apparatus 250 allow the clamp pads to be selectively positioned so that the apparatus 250 may be used to secure workpieces of varying sizes and shapes in a variety of ways. In a preferred embodiment, the clamp members 252 and 254 include clamp pad assemblies 252*a* and 254*a*, respectively, which may be selectively positioned about the clamp members 252 and 254. For example, in the embodiment illustrated, the pad assemblies 252*a* and 254*a* include jaw support structures 252*b* and 254*b*, respectively, which include corresponding jaw plate portions 252*c* and 254*c*. The jaw plates 252*c* and 254*c* have flat faces 252*d* and 254*d*, respectively, which are used to exert clamping or spreading forces on the desired workpiece. In a preferred form of apparatus 250, the jaws 252*c* and 254*c* are rectangular in shape (similar to the jaws of the trade apparatus 200) and have outer lips 252*e* and 254*e* which protrude from the jaw supports 252*b* and 254*b*, respectively, so that a removable jaw pad (not shown) can be applied over the jaws 252*c* and 254*c*.

The jaw assemblies 252*a* and 254*b* also are removable, which may allow an operator to remove and replace the jaw assemblies 252*a* and 254*a* as desired. For example, the operator may remove and replace one of the jaw assemblies with a similar jaw assembly if the original jaw assembly has become too worn, fatigued, or broken. Alternatively, an operator may replace a clamp jaw assembly with a different clamp jaw assembly in order to use the apparatus 250 with different types of workpieces or in order to accomplish a different task with the apparatus 250. For example, an operator may replace flat jaw assemblies like those illustrated in FIGS. 13A–D, with rounded jaw assemblies in order to hold a rounded workpiece such as a section of pipe. Although the illustrated embodiment of apparatus 250 has a similar shape to the trade apparatus 200 discussed above, it should be understood that the apparatus 250 may take any form, including that of apparatus 20 and its T-shaped jaws, which incorporate the concepts of having selectively positionable clamp jaw assemblies and/or removable clamp jaw assemblies.

The clamp jaw assemblies 252*a* and 254*a* are secured to the bodies 252*f* and 254*f* of clamps 252 and 254 via couplings. In the embodiment illustrated, the couplings include projections, such as tenons 252*g* and 254*g*, which are coupled to one of the plurality of mating mortises 252*h* and 254*h* located about the clamp bodies 252*f* and 254*f*. In this manner, the clamp jaw assemblies 252*a* and 254*a* are connected to the clamp bodies 252*f* and 254*f* via the resulting dovetail joint formed by the tenons and mortises. Preferably, the tenons and mortises will form a friction fit between the clamp jaw assemblies 252*a* and 254*a* and bodies 252*f* and 254*f* so that the clamp jaw assemblies cannot be unintentionally removed from the bodies; however, such a fit is not necessary in that the couplings need only prevent the clamp jaw assemblies 252*a* and 254*a* from moving in the direction indicated by arrows 252*i* and 254*i* (FIG. 13B), respectively.

In alternate embodiments of apparatus 250, the clamp jaw assemblies 252*a* and 254*a* may include the tenons and the bodies 252*f* and 254*f* may have the mortises, or the assemblies 252*a* and 254*a* and bodies 252*f* and 254*f* may include a variety of mating tenons and mortises. Furthermore, in yet other embodiments, the couplings may include other types of securing mechanisms in addition to, or in place of, the dovetail joint configuration. For example, a detent mechanism or ball and socket mechanism may be used to secure the jaw assemblies 252*a* and 254*a* to bodies 252*f* and 254*f*, or a releasing fastener such as a clasp may be used to secure the jaw assemblies 252*a* and 254*a* to bodies 252*f* and 254*f*. Thus, it should be understood that the mechanism used to secure the jaw assemblies 252*a* and 254*a* to bodies 252*f* and 254*f* may be selected from a wide variety of couplings.

Figure 13A:
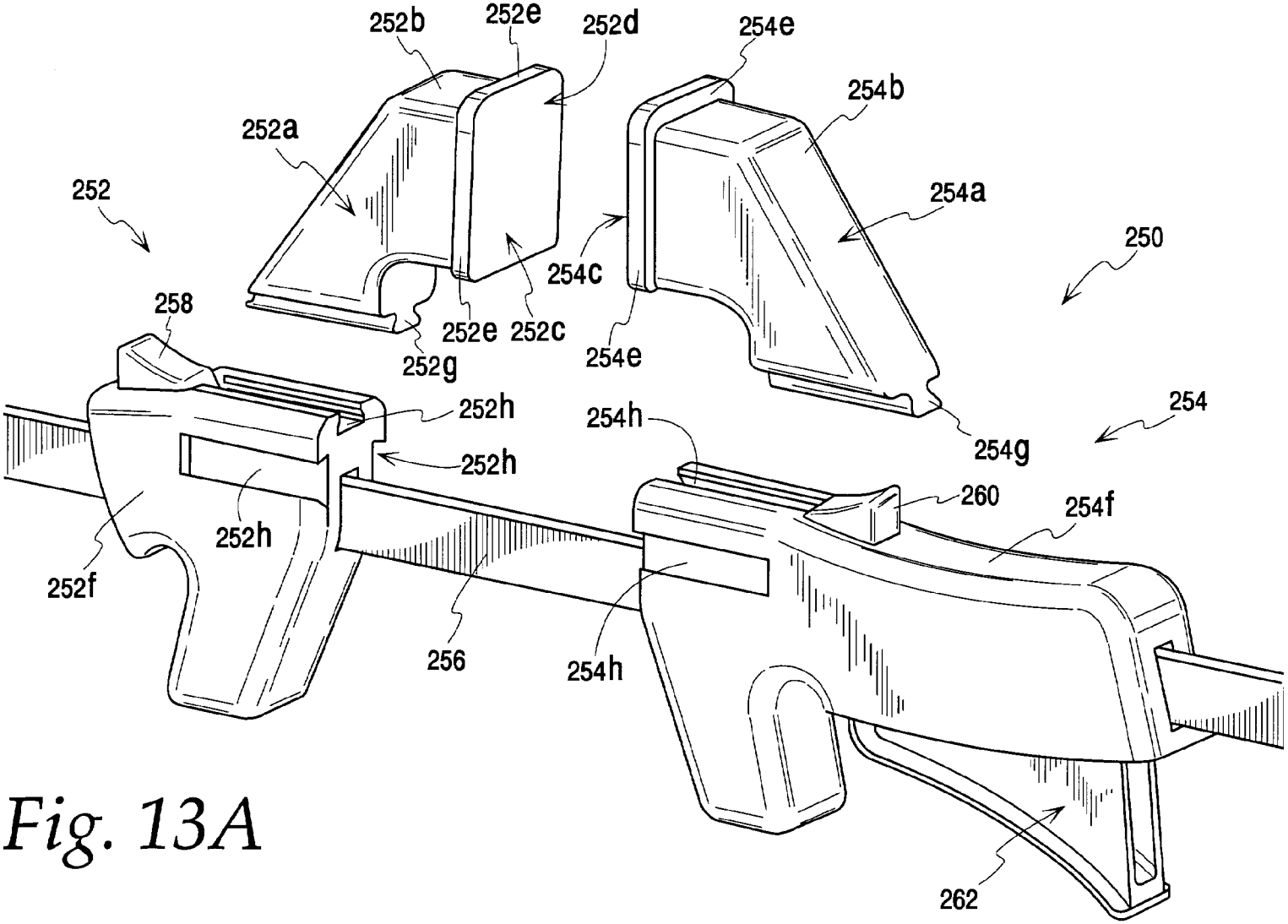
FIG. 13A is a perspective view of an alternate apparatus for securing a workpiece in accordance with the invention showing a partial bar clamp assembly with selectively positionable jaw assemblies exploded from the main bodies of the clamp members.
Figure 13B:
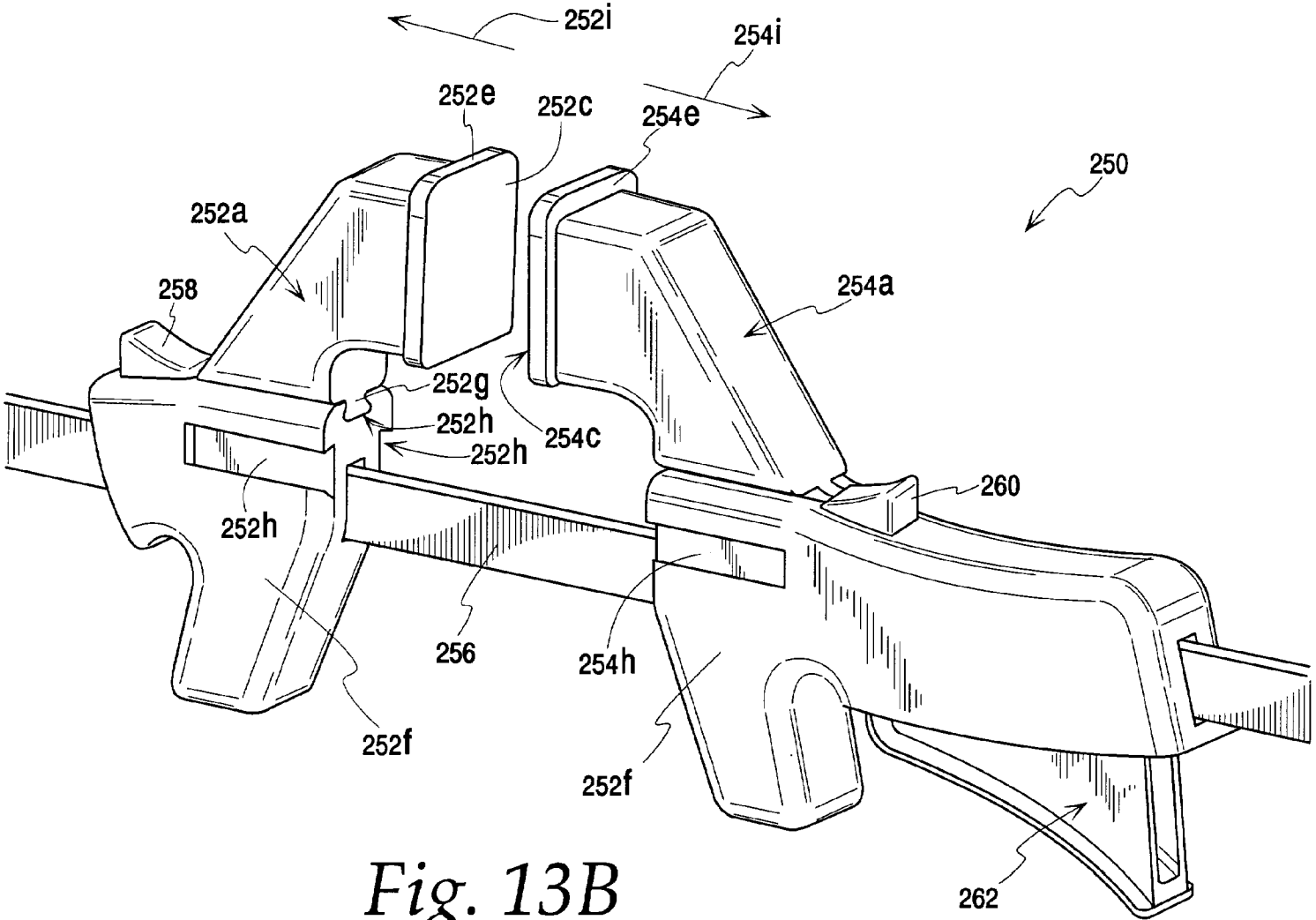
FIG. 13B is a perspective view of the bar clamp assembly of FIG. 13A showing the jaw assemblies secured to the main bodies of the clamp members in an upright or vertical orientation.
Figure 13C:
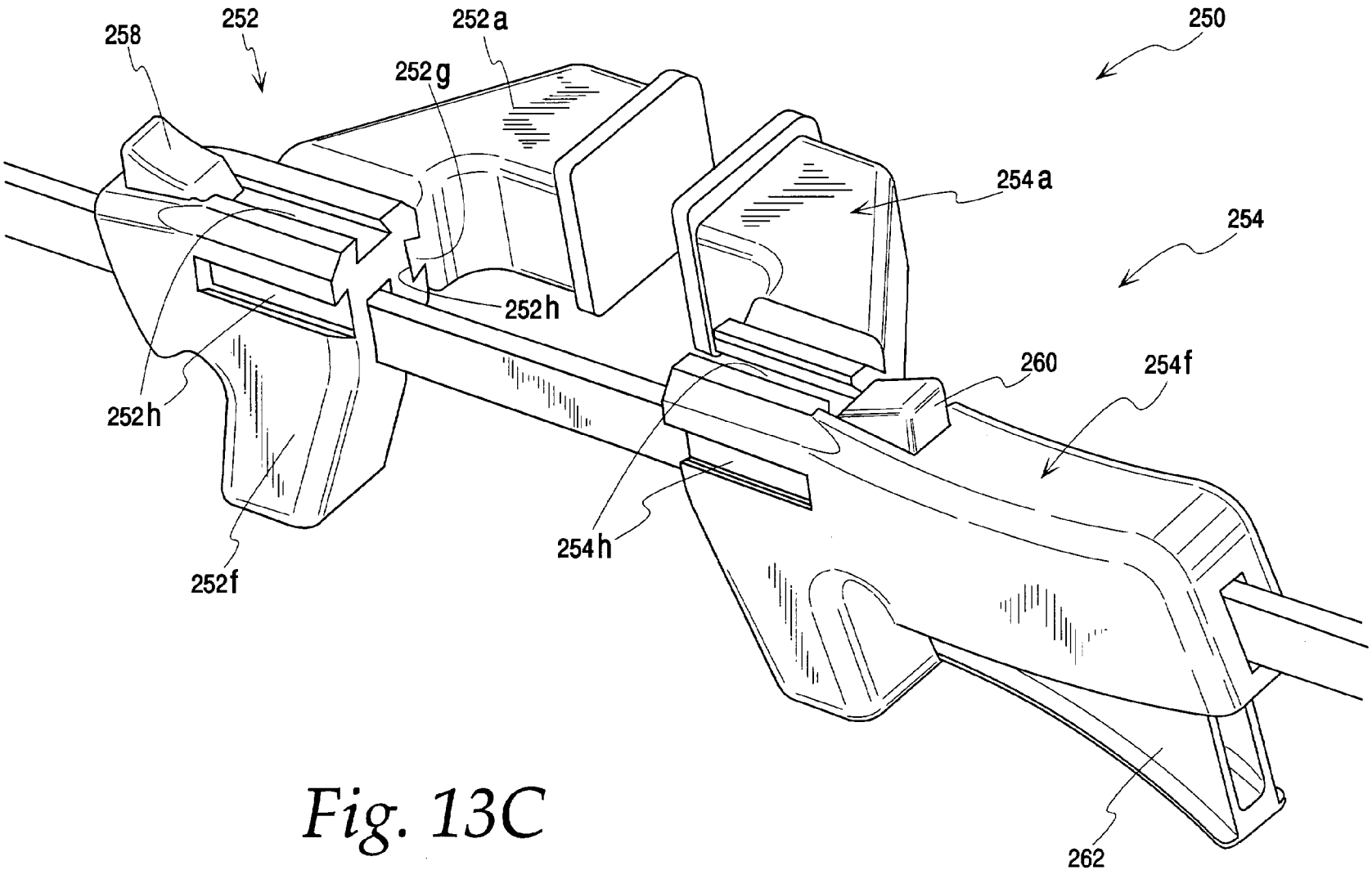
FIG. 13C is a perspective view of the bar clamp assembly of FIG. 13A showing the jaw assemblies secured to the main bodies of the clamp members in a horizontal orientation.

With this configuration, the bar clamp assembly 250 may be used in a variety of fashions. For example, in some applications, the workpiece may be of such a size or shape that it is difficult to place the workpiece above the bar 256, between the jaws 252*c* and 254*c*. In such instances, an operator may selectively position the jaw assemblies 252*a* and 254*a* of apparatus 250 about the clamps 252 and 254 to accommodate the workpiece. More particularly, the operator may rotate the clamp jaw assemblies to one of the plurality of mortises 252*h* and 254*h* located on the sides of the clamp bodies 252*f* and 254*f*, as illustrated in FIG. 13C, in order to clamp the workpiece off to the side of the assembly 250.

Figure 13D:
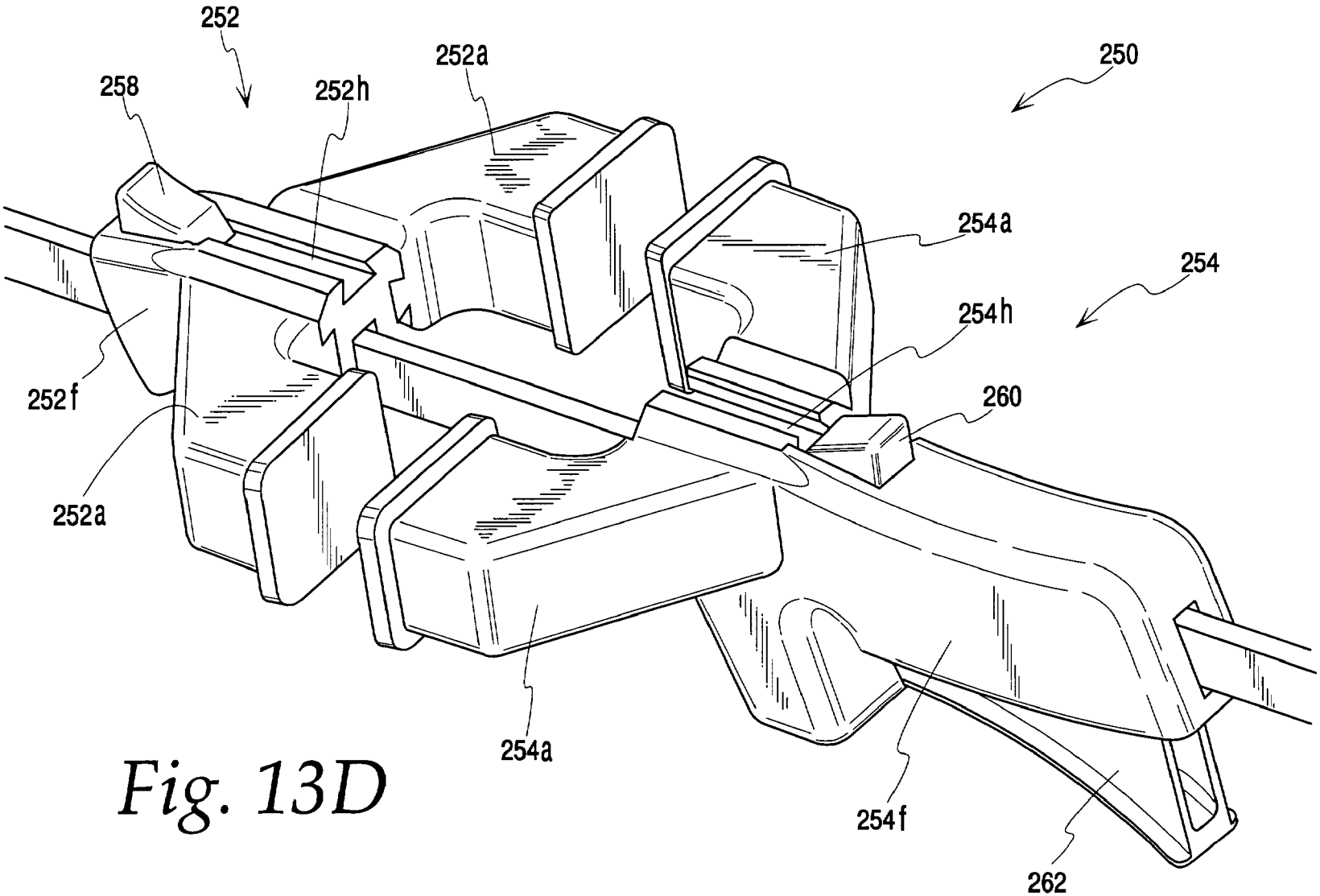
FIG. 13D is a perspective view of the bar clamp assembly of FIG. 13A showing two sets of jaw assemblies secured to the main bodies of the clamp members in horizontal orientations.

Other workpieces may be of such size or shape that they may be best secured via a plurality of pad assemblies on each side. As illustrated in FIG. 13D, the apparatus 250 may be configured with a plurality of clamp members 252*a* and 254*a* attached to each clamp body 252*f* and 254*f* in order to secure such a workpiece in the desired fashion. More particularly, in the embodiment illustrated, the clamp members 252 and 254 are configured with clamp jaw assemblies 252*a* and 254*a* extending from opposite sides of clamp bodies 252*f* and 254*f*, respectively. Such a configuration may be used when trying to clamp a U-shaped workpiece or the like, or may be used when trying to secure a workpiece at multiple locations on each side. In another embodiment, the apparatus 250 may be configured with three clamp jaw assemblies 252*a* and 254*a* on each clamp member 252 and 254 so that a workpiece can be secured at three different points on each side. The added points of engagement on each side of the workpiece may allow the apparatus 250 to better secure the workpiece and/or may allow the apparatus 250 to apply clamping/spreading forces about the workpiece in specific locations as desired and selected by the operator.

In FIGS. 14A–D, an alternate embodiment of the apparatus for securing a workpiece is shown, (hereinafter referred to by reference numeral 300), in which the bar clamp assembly is positionable on the base in a vertical position or a horizontal position rather than having selectively positionable pad assemblies. More particularly, the apparatus 300 includes clamp members 302 and 304 which are positionable about the elongate member 306 to form a bar clamp assembly 308. The bar clamp assembly 308 may be positioned and secured onto a base 310 in a manner similar to that discussed above with respect to apparatuses 20 and 200 via slot 310*a*, or may be positioned and secured onto the side of base 30 via slot 310*b*. Thus, the assembly 300 maybe used to secure workpieces in a vertical manner above the base 310, or in a horizontal manner off to the sides thereof. Preferably, the base 310 will utilize the same actuating arm 310*c* to secure bars inserted in either the vertical slot 310*a* or the horizontal/side slot 310*b*. For example, rotating the actuating arm 310*c* from its bar releasing position to its bar securing position will result in the internal base portion and vertical wall portion sliding toward the actuator handle 310*c* and closing the openings of slots 310*a–b* to secure the elongate member 306 to the base.

Figure 14A:
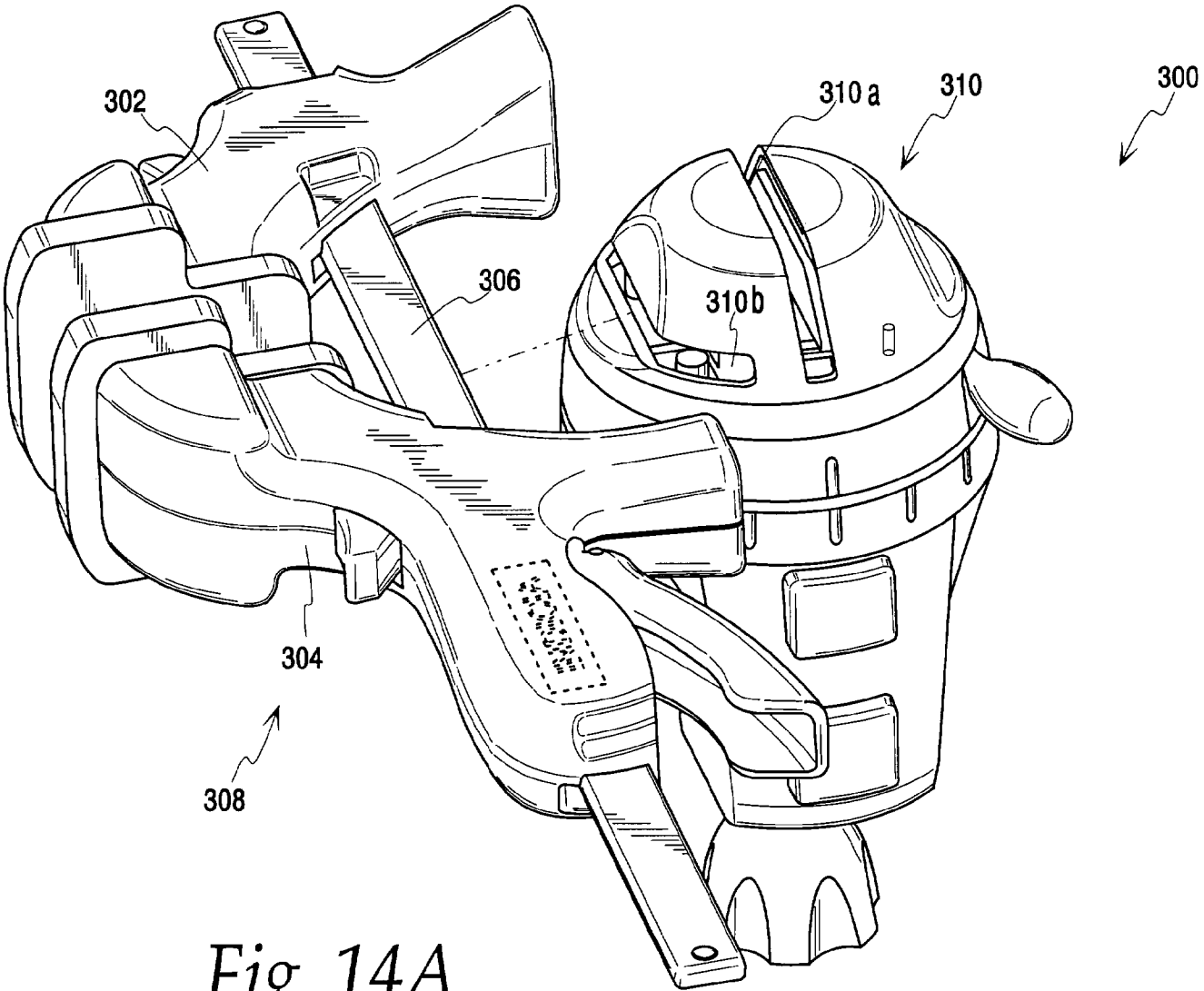
FIG. 14A is a perspective view of an alternate apparatus for securing a workpiece in accordance with the invention showing a removable bar clamp assembly exploded from a movable base that is capable of receiving and securing the bar clamp assembly in a plurality of directions and positions.
Figure 14B:
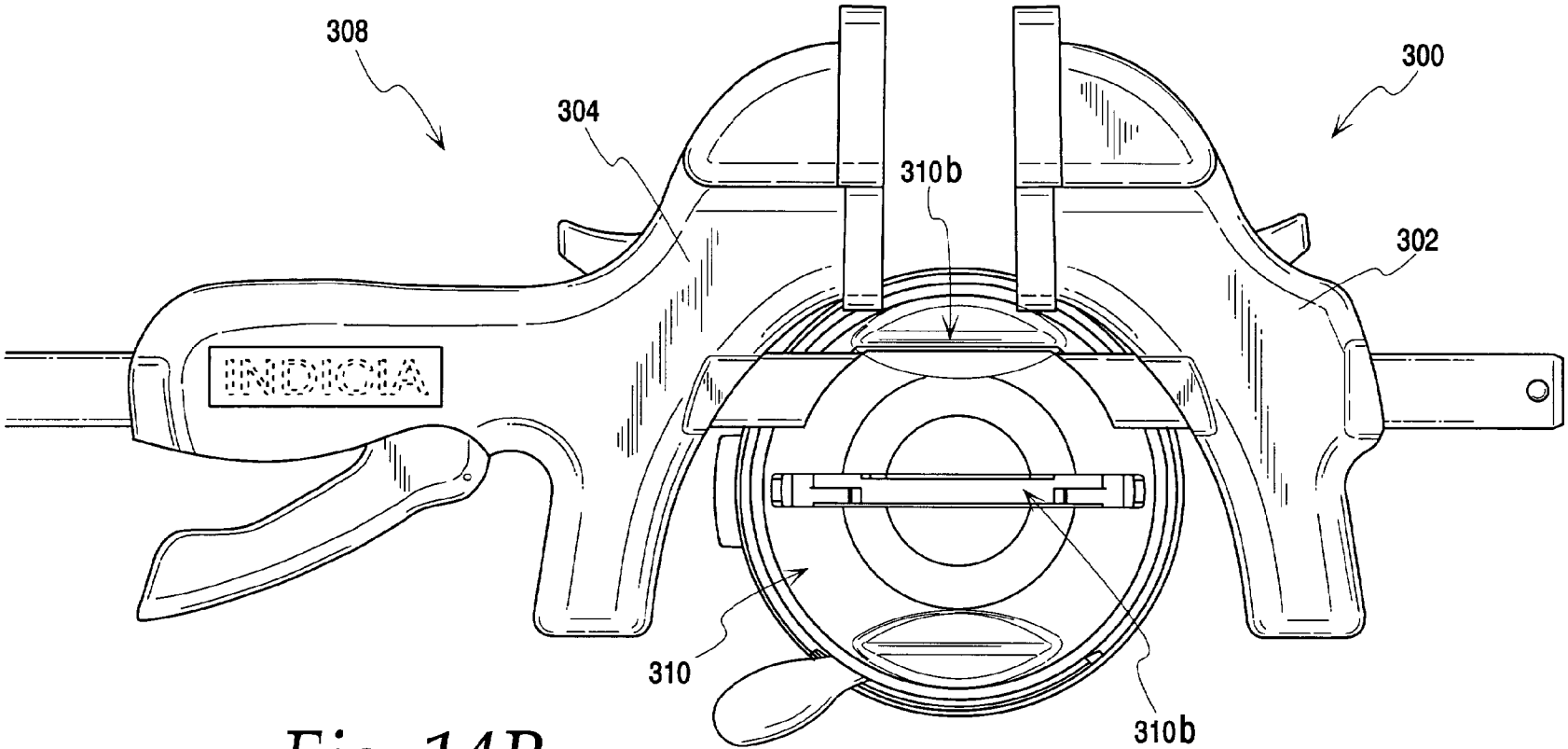
FIG. 14B is a top plan view of the movable base of FIG. 14A showing the bar clamp positioned within the side slot of the base.
Figure 14C:
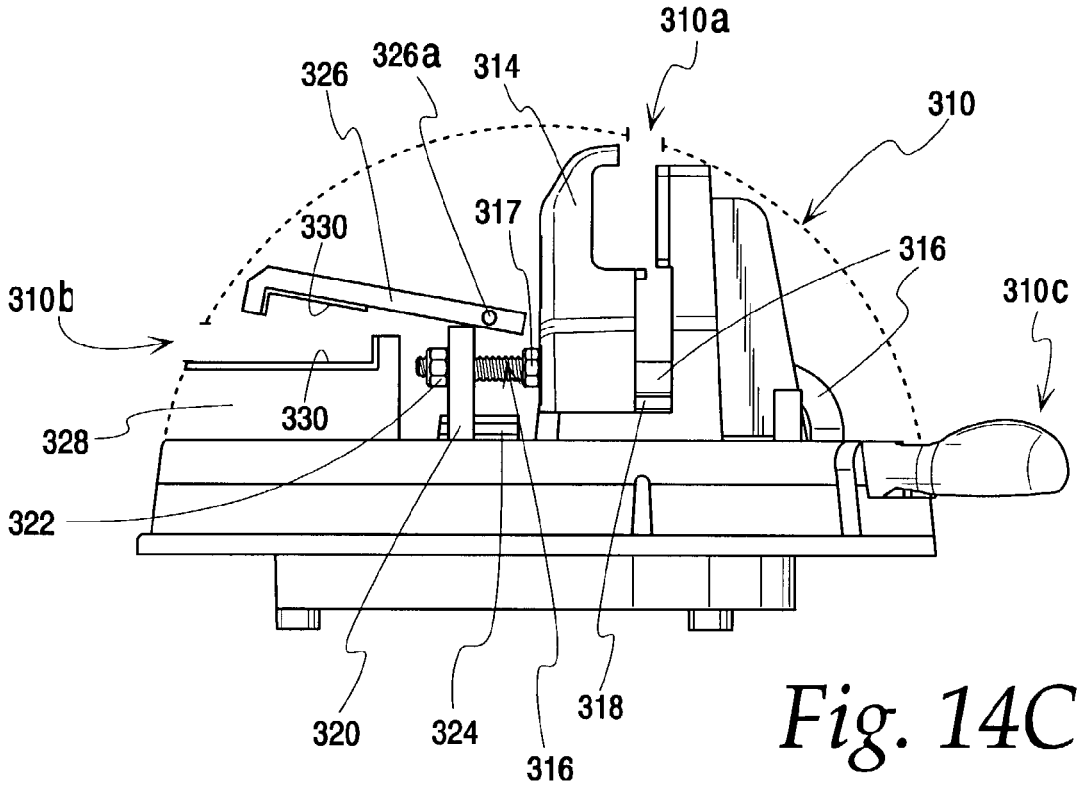
FIGS. 14C–D are partial side elevational views of bar securing mechanisms which may be used with the movable base of FIG. 14A showing the base cover in broken line and the bar securing mechanisms in open and closed positions, respectively.
Figure 14D:
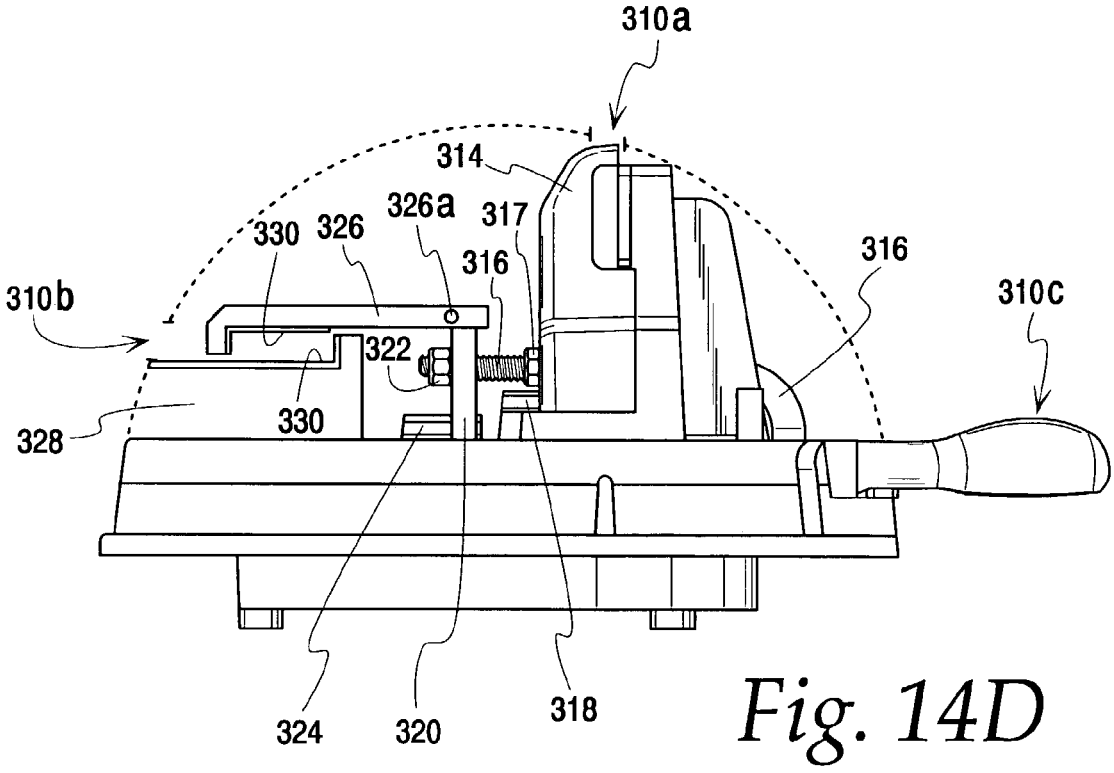
Figure 15A:
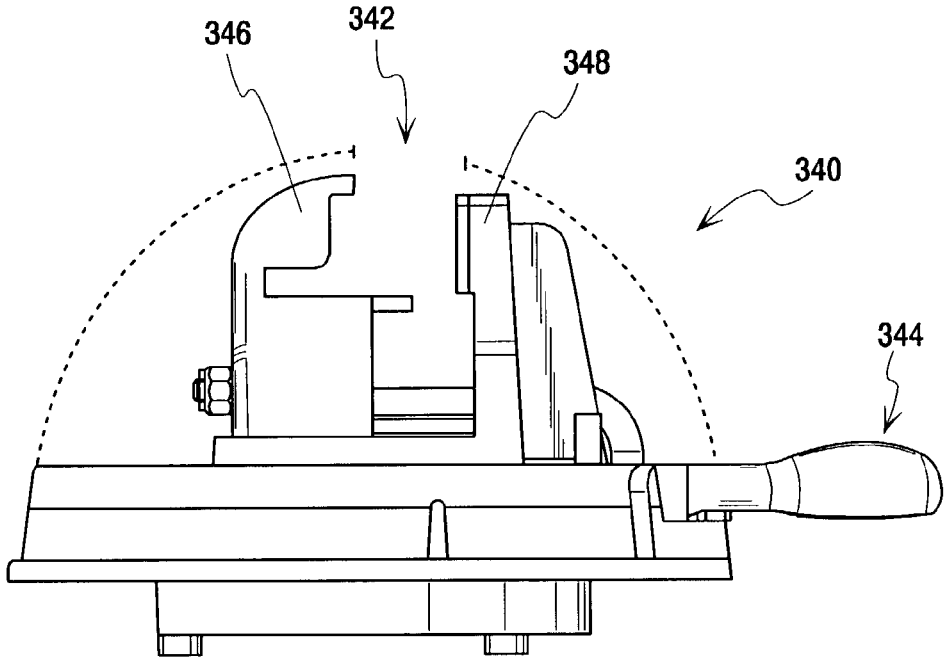
FIGS. 15A–B are partial side elevational views of an alternate bar securing mechanism in accordance with the invention, showing the base cover in broken line and the bar securing mechanism in open and closed positions, respectively.
Figure 15B:
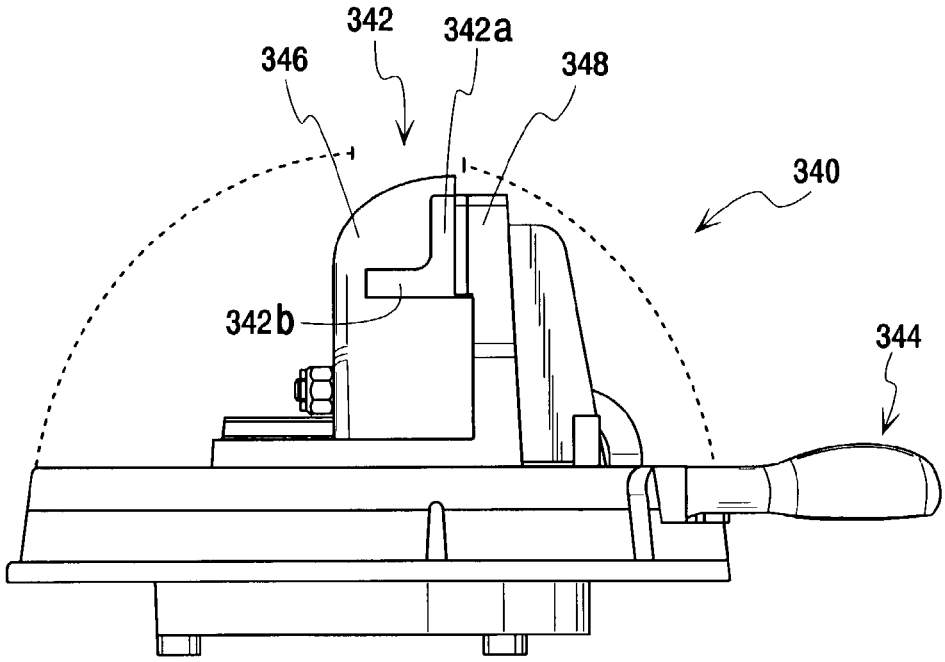

More particularly, in one form, the apparatus 300 may include a bar securing mechanism 312 having an upright or vertical bar securing mechanism 312*a* and a horizontal bar securing mechanism 312*b* which are both operated via the actuator 310*c* as illustrated in FIGS. 14C–D. The vertical bar securing mechanism 312*a* operates in a similar manner to the bar securing mechanism 74*a* discussed above with respect to FIGS. 1–7O. For example, the actuator 310*c* is connected to clamp block 314 via shaft 316 and nut 317, and drives the clamp block 314 along guide rails 318 between bar securing (FIG. 14D) and bar releasing (FIG. 14C) positions. The shaft 316 of FIGS. 14C–D, however, is longer than shaft 86 of apparatus 74*a* and extends beyond clamp block 314 and through a cam block 320 to which it is connected via a fastener such as nut 322. The bar securing mechanism 312 further includes a support, such as horizontal wall 328, which forms a bed upon which the bar 306 (FIGS. 14A–B) of bar clamp assembly 308 rests once inserted into the horizontal slot 310*b*. The bar 306 is secured to the base 310 in slot 310*b* via an arm 326 which is moveable between a bar securing and a bar releasing position.

In a preferred embodiment, the arm 326 moves about an axis of rotation, such as fulcrum or pivot point 326*a*, and is normally biased in its bar releasing position as shown in FIG. 14C. In the embodiment illustrated, the pivots 326*a* of arm 326 are trunnion mounts which connect to and pivot in upstanding walls located on each side of the arm 326. In a preferred form, the upstanding walls (not shown) form part of the dome-shaped base housing 310. It should be understood, however, that the upstanding walls may alternatively be attached to and extend from the base plate of the housing and that other means may be used to provide an axis of rotation in general.

When the actuator 310*c* is placed into its bar securing position, the shaft 316 drives the clamp block 320 along the guide rails 324 and into engagement with pivot arm 326, causing the pivot arm 326 to pivot about its axis of rotation 326*a* thereby closing the horizontal slot 310*b* (see FIG. 14D) and securing any bar located therein. By moving the actuator 310*c* back to its bar releasing position, the shaft 316 drives the cam block 320 back along the guide rails 324 until the cam block 320 is generally out of engagement with the pivot arm 324, thereby allowing the pivot arm to return to its biased bar releasing position (see FIG. 14C). In a preferred embodiment, at least one of the horizontal wall 328 and pivot arm 326 include friction pads, such as rubber pads 330, for engaging bar 306 and assisting in preventing the bar 306 from moving about while secured in the horizontal slot 310*b*. If desired, the dimensions of the base 310 may be altered to space the slots 310*a–b* sufficiently apart so that a plurality of bar clamp assemblies may be attached to the base 310 at a time (e.g., one bar clamp assembly secured in slot 310*a* and another secured in slot 310*b*).

In yet another embodiment, the opening of the horizontal slots in the bases discussed above with respect to FIGS. 1–14D may be made wide enough to accept the elongate member in either a vertical or horizontal manner. Such an option may prevent the need for a second, separate, horizontal slot, or may be used in a similar base to that of FIGS. 14A–D to provide additional ways in which bar clamp assemblies may be attached to the base. By way of example and not limitation, the following will discuss one form in which this may be done and in particular will focus on the first bar securing mechanism discussed above with respect to FIGS. 1–7O. In such an embodiment, at least one of the vertical wall and clamp block of the bar securing mechanism may be designed with horizontal notches that cooperate to receive and secure the elongate member when inserted into the elongate member receiving slot in a horizontal fashion. The remainder of the vertical wall and clamp block could retain the shape and structure discussed above with respect to apparatus 20 so that the elongate bar could also secure the bar when inserted in the slot in a vertical fashion.

For example, in FIGS. 15A–D, an alternate bar securing mechanism 340 is shown having an enlarged slot 342 which is designed to accept an elongate member in either a vertical or horizontal direction. More particularly, the actuator 344 is capable of driving the clamp block 346 in a manner similar to that discussed above with respect to apparatus 20 between a bar securing (FIG. 15B) and a bar releasing (FIG. 15A) position in which the elongate member may be received and secured in either a vertical or horizontal position. In the embodiment illustrated, the clamp block 346 and vertical wall 348 cooperate with one another to collectively form vertical slot portion 342*a* and horizontal slot portion 342*b*. It should be understood, however, that a variety of configurations may be used to provide the vertical and horizontal slot portions 342*a–b* of slot 342 and that the slot portions 342*a–b* need not intersect with one another in order to provide the desired clamping capability.

In an alternate embodiment, the apparatus for securing a workpiece may be configured so that the clamp members themselves, rather than the pads or elongate member, are rotatable from a first position to a second position. For example, in FIG. 16, an apparatus for securing a workpiece 350 includes clamp members 352 and 354 which may be positioned on an elongate member 356 in either a vertical or horizontal position in order to form a bar clamp assembly 358. More particularly, the clamp members 352 and 354 may be configured similar to clamp members 22 and 24 of apparatus 20 above so that both clamp members 352 and 354 are fully removable from the elongate member 356. In such an embodiment, the openings through which the elongate member passes with respect to each clamp member (e.g., the openings in the block portions, brake plate, clutch plate, trigger, springs, etc.) are t-shaped or in the form of a cross, rather than a simple oval or oblong slot shape, so that the clamp members 352 and 354 may be positioned on the bar, and moved about the bar, in either the vertical or horizontal orientation. Thus, regardless of whether the bar clamp assembly 358 is used with base 30 or base 310 or with removable and/or selectively positionable clamp jaw assemblies as discussed above, the bar clamp 358 may be used to secure a workpiece above, below or off to either side of the elongate member 356. Although the t-shaped openings may require the clamp members 352 and 354, and there internal mechanisms (e.g., brake plates, trigger clutches, etc.), to be larger and/or wider than in the alternate embodiments discussed above in order to accommodate the t-shaped openings, the versatility of the clamp members 352 and 354 will make the clamps 352 and 354 and apparatus 350 useful in a wide variety of applications, (e.g., applications which require the clamp members to be capable of being mounted on the elongate member in a variety of positions and directions or capable of receiving an elongated member in a variety of orientations).

Figure 16:
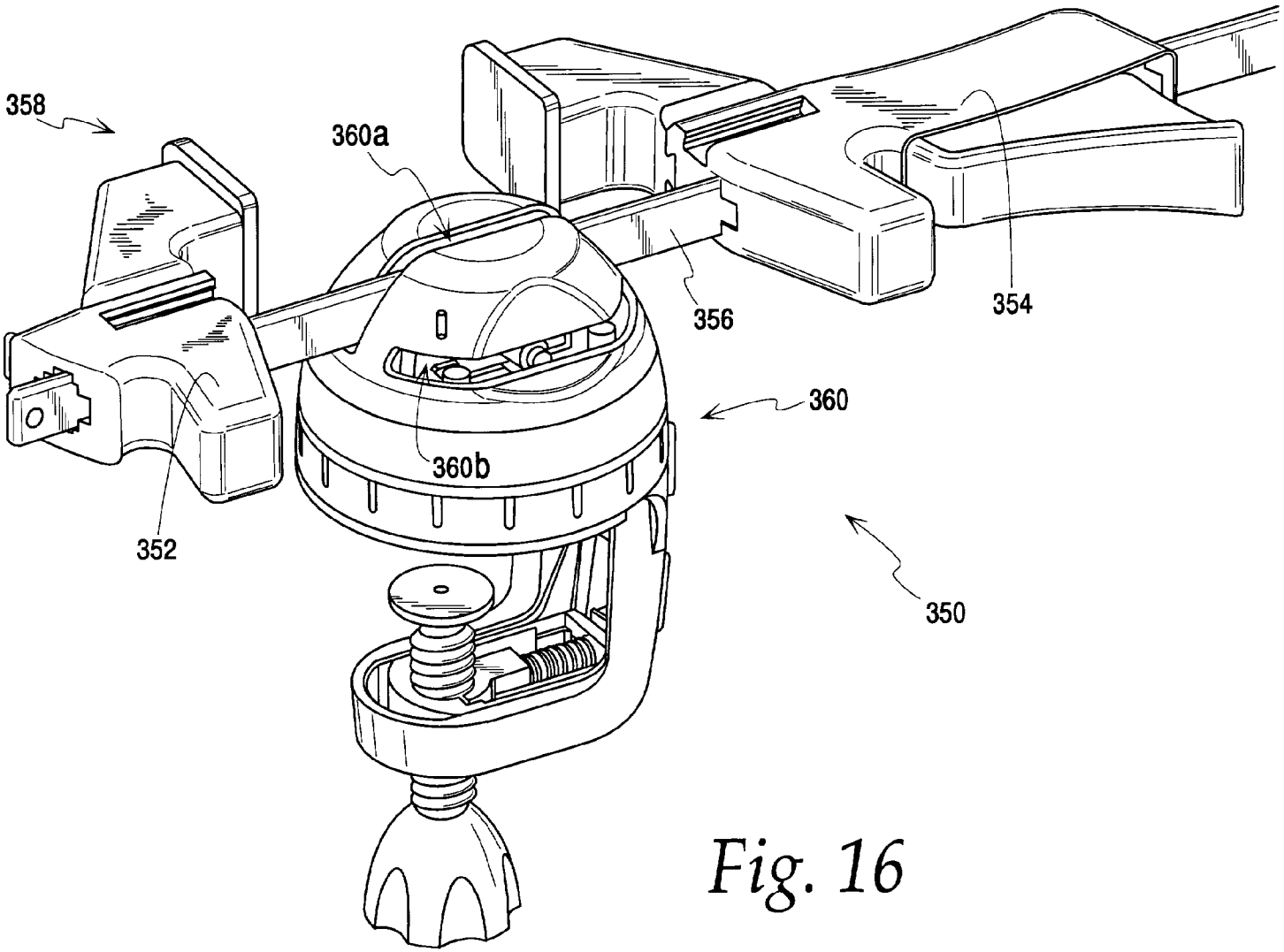
FIG. 16 is a perspective view of an alternate apparatus for securing a workpiece showing clamp members which are capable of being mounted on the bar in a plurality of different directions and positions, the illustration showing the clamp members in an optional horizontal orientation rather than a vertical orientation.

In the embodiment illustrated in FIG. 16, several features of the alternate embodiments discussed above are combined in order to show the variety of configurations an apparatus in accordance with the invention may be provided in. For example, the apparatus of FIG. 16 includes clamp members 352 and 354 which can be rotated from a first position to a second position with respect to the elongate bar member 356 in the manner discussed above. In addition, these clamp members may include the removable and/or repositionable clamp jaw assemblies discussed above with respect to apparatus 250. Furthermore, the bar clamp assembly 358 illustrated in FIG. 16 is shown attached to a base 360 capable of receiving the elongated member 356 in a variety of orientations similar to the base 310 discussed above with respect to apparatus 300. Thus, it should be understood that a variety of the features discussed above may be incorporated into an apparatus for securing a workpiece in accordance with the invention disclosed herein.

Although the bar clamp assemblies 28, 28', 250, 308 and 358 illustrated herein show the clamp members connected to the elongate member in a clamping arrangement, it should be understood that the clamp members may be arranged in either a clamping or spreading configuration depending on the application at hand. Additional features which may be incorporated in the apparatus for securing a workpiece disclosed herein may be found in U.S. Patent Application No. 60/332,130 filed Nov. 13, 2001 and U.S. patent application Ser. No. 10/189,938 filed Jul. 3, 2002 which are hereby incorporated herein by reference in their entirety.

Thus it is apparent that there has been provided, in accordance with the invention, an apparatus for securing a workpiece that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. It is also intended to embrace all methods associated with the use and operation of the apparatus discussed herein, including, but not limited to, the method of manufacturing said apparatus, and the method of securing workpieces as described herein.

What is claimed is:

1. An apparatus for securing a workpiece, the apparatus comprising:

a transportable elongate member;

first and second clamp members mounted to the elongate member and operable for being shifted between workpiece engaging and workpiece releasing positions, the clamp members having alignment structures for allowing the clamp members to be fully removed from the transportable elongate structure and placed back thereon while maintaining the operability of the clamp members; and a base having a catch for holding the elongate structure when inserted therein.

2. An apparatus according to claim 1, wherein the base includes a lower base portion for mounting the base to a work surface and an upper base portion about which the catch is coupled.

3. An apparatus according to claim 2, wherein the upper base portion is rotationally coupled to the lower base portion so that the upper base portion can rotate with respect to the lower base portion.

4. An apparatus according to claim 3, wherein the upper and lower base portions are rotationally coupled via an indexing mechanism capable of orienting the base in a plurality of different positions.

5. An apparatus according to claim 2, wherein the lower base portion includes a base securing mechanism for securing the base to a work surface so that the base is generally fixed thereto.

6. An apparatus according to claim 5, wherein the base securing mechanism comprises a clamp for securing the base to the work surface, the clamp being movable between a securing position wherein the base is secured to the work surface and a releasing position wherein the base is capable of being moved with respect to the work surface.

7. An apparatus according to claim 6, comprising a clamp release button for moving the clamp to the releasing position so that the base may be moved with respect to the work surface.

8. An apparatus according to claim 1, wherein the base has an elongated foot coupled thereto for engaging an upper surface of the work surface when the base is secured to the work surface.

9. An apparatus according to claim 1, wherein the elongated member is a bar having a generally rectangular cross-section and the catch is capable of receiving and securing the bar in a plurality of positions.

10. An apparatus according to claim 9, wherein the catch has a generally vertical slot for receiving the bar in a vertical orientation so that the clamp members extend upward above the base and a generally horizontal slot for receiving the bar in a horizontal orientation so that clamp members extend out from a side of the base.

11. An apparatus for securing a workpiece, the apparatus comprising:

a transportable elongate member;

first and second clamp members mounted to the elongate member and operable for being shifted between workpiece engaging and workpiece releasing positions, wherein at least one of the clamp members has a selectively positionable jaw assembly for being moved between a first position and a second position;

a tenon coupled to one of the jaw assembly and the clamp having the selectively positionable jaw assembly; and a mortise defined by the other of the jaw assembly and the clamp having the selectively positionable jaw assembly so that the tenon and mortise form a joint connecting the jaw assembly and the clamp having the selectively positionable jaw assembly.

12. An apparatus according to claim 11, wherein the mortise comprises a plurality of mortises within which the tenon may be inserted so that the jaw assembly may be coupled to the clamp in a variety of different positions.

13. An apparatus for securing a workpiece, the apparatus comprising:

a transportable elongate member;

first and second clamp members mounted to the elongate member and operable for being shifted between workpiece engaging and workpiece releasing positions, wherein at least one of the clamp members has a selectively positionable jaw assembly for being moved between a first position and a second position; and a base having a catch for holding the elongate structure when inserted therein.

14. An apparatus according to claim 13, wherein the base includes a lower base portion for mounting the base to a work surface and an upper base portion about which the catch is coupled.

15. An apparatus according to claim 14, wherein the upper base portion is rotationally coupled to the lower base portion so that the upper base portion can rotate with respect to the lower base portion.

16. An apparatus according to claim 15, wherein the upper and lower base portions are rotationally coupled via an indexing mechanism capable of orienting the base in a plurality of different positions.

17. An apparatus according to claim 14, wherein the lower base portion includes a base securing mechanism for securing the base to a work surface so that the base is generally fixed thereto.

18. An apparatus according to claim 17, wherein the base securing mechanism comprises a clamp for securing the base to the work surface, the clamp being movable between a securing position wherein the base is secured to the work surface and a releasing position wherein the base is capable of being moved with respect to the work surface.

19. An apparatus according to claim 18, comprising a clamp release button for moving the clamp to the releasing position so that the base may be moved with respect to the work surface.

20. An apparatus according to claim 14, wherein the base has an elongated foot coupled thereto for engaging an upper surface of the work surface when the base is secured to the work surface.

21. An apparatus according to claim 13, wherein the elongated member is a bar having a generally rectangular cross-section and the catch is capable of receiving and securing the bar in a plurality of directions.

22. An apparatus according to claim 21, wherein the catch has a generally vertical slot for receiving the bar in a vertical orientation so that the clamp members extend upward above the base and a generally horizontal slot for receiving the bar in a horizontal orientation so that clamp members extend out from a side of the base.

23. An apparatus for securing a workpiece, the apparatus comprising:

a transportable elongate member;

first and second clamp members mounted to the elongate member and operable for being shifted between workpiece engaging and workpiece releasing positions; and a base having a catch for holding the elongate member when inserted therein, the catch being capable of receiving and securing the elongate member in a plurality of directions.

24. An apparatus according to claim 23, wherein the catch has a generally vertical slot for receiving the bar in a vertical orientation so that the clamp members extend upward above the base and a generally horizontal slot for receiving the bar in a horizontal orientation so that clamp members extend out from a side of the base.

* * * * *